US007481338B1

(12) United States Patent
Stern et al.

(10) Patent No.: US 7,481,338 B1
(45) Date of Patent: Jan. 27, 2009

(54) AEROSOL SPRAY TEXTURE APPARATUS FOR A PARTICULATE CONTAINING MATERIAL

(75) Inventors: Donald J. Stern, Clackamas, OR (US); James A. Tryon, Seattle, WA (US)

(73) Assignee: Homax Products, Inc.., Bellingham, WA (US)

( * ) Notice: Subject to any disclaimer, the term of this patent is extended or adjusted under 35 U.S.C. 154(b) by 30 days.

(21) Appl. No.: 10/991,611

(22) Filed: Nov. 18, 2004

Related U.S. Application Data

(63) Continuation of application No. 10/691,897, filed on Oct. 22, 2003, now Pat. No. 7,014,073, which is a continuation of application No. 10/047,041, filed on Jan. 14, 2002, now Pat. No. 6,641,005, which is a continuation of application No. 09/703,409, filed on Oct. 31, 2000, now Pat. No. 6,352,184, which is a continuation of application No. 09/203,547, filed on Dec. 1, 1998, now Pat. No. 6,152,335, which is a continuation-in-part of application No. 08/950,202, filed on Oct. 14, 1997, now abandoned, which is a continuation of application No. 08/782,142, filed on Jan. 10, 1997, now abandoned, which is a continuation of application No. 08/534,344, filed on Sep. 27, 1995, now abandoned, which is a continuation of application No. 08/496,386, filed on Jun. 29, 1995, now abandoned, which is a continuation of application No. 08/327,111, filed on Oct. 21, 1994, now abandoned, which is a continuation-in-part of application No. 08/216,155, filed on Mar. 22, 1994, now Pat. No. 5,450,983, which is a continuation-in-part of application No. 08/202,691, filed on Feb. 24, 1994, now abandoned, which is a continuation of application No. 08/030,673, filed on Mar. 12, 1993, now abandoned.

(51) Int. Cl.
*B65D 83/00* (2006.01)

(52) U.S. Cl. ..... 222/402.1; 222/394; 222/402.25; 239/337

(58) Field of Classification Search ..... 222/402.1, 222/402.18, 402.24, 402.25, 394, 402.21, 222/402.22, 402.23, 365; 239/337, 340, 239/592, 597
See application file for complete search history.

(56) References Cited

U.S. PATENT DOCUMENTS 2,565,954 A * 8/1951 Dey ..... 222/402.24

(Continued)

FOREIGN PATENT DOCUMENTS

DE 3806991 A 9/1989

OTHER PUBLICATIONS

Homax Brochure, EasyTouch Spray Texture, released Mar. 1982.

*Primary Examiner*—Steven J Ganey
(74) *Attorney, Agent, or Firm*—Michael R. Schacht; Schacht Law Office, Inc.

(57) ABSTRACT

An aerosol device for dispensing texture material for matching existing acoustical ceiling texture. The device comprises a container, a valve assembly, a dispensing nozzle, a hardenable material, and pressurized inert gas as a propelling mechanism. The hardenable material and pressurized inert gas are placed into the container. When the valve assembly is opened, the inert gas forces the hardenable material out of the container through the dispensing nozzle. The dispensing nozzle diverts at least a portion of the hardenable material exiting the container to develop a spray suitable for the application of the hardenable material onto the ceiling surface being textured. The hardenable material preferably comprises at least water, filler, binder, and polystyrene particles. The inert gas is preferably nitrogen.

18 Claims, 45 Drawing Sheets

U.S. PATENT DOCUMENTS 2,686,652 A 8/1954 Carlson et al.
2,723,200 A * 11/1955 Pyenson ..... 222/402.22
2,764,454 A 9/1956 Edelstein
2,785,926 A 3/1957 Lataste
2,831,618 A 4/1958 Soffer et al.
2,839,225 A 6/1958 Soffer et al.
2,965,270 A 12/1960 Soffer et al.
3,191,809 A 6/1965 Schultz et al.
3,196,819 A 7/1965 Lechner et al.
3,346,195 A 10/1967 Groth
3,415,425 A 12/1968 Knight et al.
3,433,391 A 3/1969 Krizka et al.
3,450,314 A 6/1969 Gross
3,467,283 A 9/1969 Kinnavy
3,482,738 A 12/1969 Bartels
3,544,258 A 12/1970 Presant et al.
3,548,564 A 12/1970 Bruce et al.
3,592,359 A 7/1971 Marrafino
3,700,136 A 10/1972 Ruekberg
3,788,521 A 1/1974 Laauwe
3,806,005 A 4/1974 Prussin et al.
3,828,977 A 8/1974 Borchert
3,862,705 A 1/1975 Beres et al.
3,913,842 A 10/1975 Singer
3,938,708 A 2/1976 Burger
3,989,165 A 11/1976 Shaw et al.
3,992,003 A 11/1976 Visceglia et al.
4,032,064 A 6/1977 Giggard
4,045,860 A 9/1977 Winckler
4,089,443 A 5/1978 Zrinyi
4,117,951 A 10/1978 Winckler
4,148,416 A 4/1979 Gunn-Smith
4,154,378 A 5/1979 Paoletti et al.
RE30,093 E 9/1979 Burger
4,171,757 A 10/1979 Diamond
4,185,758 A 1/1980 Giggard
4,187,959 A 2/1980 Pelton
4,198,365 A 4/1980 Pelton
4,238,264 A 12/1980 Pelton
4,293,353 A 10/1981 Pelton et al.
4,308,973 A 1/1982 Irland
4,322,020 A 3/1982 Stone
4,346,743 A 8/1982 Miller
4,370,930 A 2/1983 Strasser et al.
4,401,271 A 8/1983 Hansen
4,401,272 A 8/1983 Merton et al.
4,411,387 A 10/1983 Stern et al.
4,417,674 A 11/1983 Giuffredi
4,442,959 A 4/1984 Del Bon et al.
4,641,765 A 2/1987 Diamond
4,854,482 A 8/1989 Bergner
4,870,805 A 10/1989 Morane
4,896,832 A 1/1990 Howlett
4,940,171 A 7/1990 Gilroy
4,949,871 A 8/1990 Flanner
4,955,545 A 9/1990 Stern et al.
4,969,577 A 11/1990 Werding
5,007,556 A 4/1991 Lover
5,037,011 A 8/1991 Woods
5,038,964 A 8/1991 Bouix
5,059,187 A 10/1991 Sperry et al.
5,069,390 A 12/1991 Stern et al.
5,115,944 A 5/1992 Nikolich
5,126,086 A 6/1992 Stoffel
5,188,263 A 2/1993 Woods
5,188,295 A 2/1993 Stern et al.
5,211,317 A 5/1993 Diamond et al.
5,341,970 A 8/1994 Woods
5,450,983 A 9/1995 Stern et al.
6,152,335 A 11/2000 Stern et al.
6,352,184 B1 3/2002 Stern et al.
6,641,005 B1 11/2003 Stern et al.

* cited by examiner

AEROSOL SPRAY TEXTURE APPARATUS FOR A PARTICULATE CONTAINING MATERIAL

RELATED APPLICATIONS

This application is a continuation of U.S. Ser. No. 10/691,897 filed Oct. 22, 2003, now U.S. Pat. No. 7,014,073 which is a continuation of U.S. Ser. No. 10/047,041 filed Jan. 14, 2002, now U.S. Pat. No. 6,641,005, which is a continuation of U.S. Ser. No. 09/703,409 filed Oct. 31, 2000, now U.S. Pat. No. 6,352,184 which is a continuation of U.S. Ser. No. 09/203,547 filed Dec. 1, 1998, now U.S. Pat. No. 6,152,335, which is a continuation-in-part of U.S. Ser. No. 08/950,202 filed Oct. 14, 1997, now abandoned, which is a continuation of Ser. No. 08/782,142 filed Jan. 10, 1997, now abandoned, which is a continuation of Ser. No. 08/534,344 filed Sep. 27, 1995, now abandoned, which is a continuation of Ser. No. 08/496,386 filed Jun. 29, 1995, now abandoned, which is a continuation of Ser. No. 08/327,111 filed Oct. 21, 1994, now abandoned, which is a continuation-in-part of Ser. No. 08/216,155 filed Mar. 22, 1994, now U.S. Pat. No. 5,450,983, which is a continuation-in-part of Ser. No. 08/202,691 filed Feb. 24, 1994, now abandoned, which is a continuation of Ser. No. 08/030,673 filed Mar. 12, 1993, now abandoned.

FIELD OF THE INVENTION

The present invention relates to a texture spraying apparatus for discharging a texture material onto a surface, and more particularly to an aerosol spray texture apparatus particularly adapted to discharge a texture material having particulate matter contained therein.

BACKGROUND OF THE INVENTION

Buildings are commonly comprised of a frame to which a roof, exterior walls, and interior walls and ceilings are attached. The interior walls and ceilings are commonly formed using sheets of drywall material that are attached to frame, usually by screws. Gaps are normally formed between adjacent sheets of drywall material. In addition, the screws are countersunk slightly, and the screw heads are visible.

To hide the gaps and screw heads, they are covered with tape and/or drywall compound and sanded so that the interior surfaces (wall and ceiling) are smooth and continuous. The interior surfaces are then primed for further finishing.

After the priming step, a texture material is often applied to interior surfaces before painting. The texture material forms a bumpy, irregular surface that is aesthetically pleasing. The textured interior surface also helps to hide irregularities in the interior surface.

Some interior surfaces, especially ceilings, are covered with a special type of texture material referred to as acoustic texture material. Acoustic texture material contains particulate material that adheres to the interior surface. The purpose of the particulate material is partly aesthetic and partly functional. The particles absorb rather than reflect sound and thus can reduce echo in a room. The term "acoustic" texture material is used because of the sound absorptive property of this type of texture material.

When repairs are made to interior walls and ceilings, the texture material often must be reapplied. The newly applied texture material should match the original texture material.

A number of products are available that allow the application of texture material in small quantities for the purpose of matching existing texture material. In addition to hopper based dispensing systems, texture material may be applied in small quantities using aerosol systems. With conventional texture material that does not include particles, a variety of oil and water based texture materials in aerosol dispensing systems are available.

Acoustic texture materials pose problems that have heretofore limited the acceptance of aerosol dispensing systems. In particular, most acoustic texture materials contain polystyrene chips that dissolve in commercially available aerosol propellant materials. Thus, conventional aerosol propellant materials are not available for use with acoustic texture materials.

The Applicants have sold since approximately 1995 a product that employs compressed inert gas, such as air or nitrogen, as the propellant. The compressed gas does not interact with the particles in the acoustic texture material. The compressed air resides in the upper portion of the aerosol container and forces the acoustic texture material out of the container through a dip tube that extends to the bottom of the container.

While commercially viable, the use of compressed inert gas to dispense acoustic texture material from an aerosol container assembly presents several problems. First, if the aerosol system is operated while inverted, the compressed inert gas escapes and the system becomes inoperative. Second, the compressed inert gas can force all of the acoustic texture material out of the aerosol container in a matter of seconds. An inexperienced user can thus inadvertently and ineffectively empty the entire container of acoustic texture material.

The Applicants are also aware of an aerosol product that sprays a foam material instead of a true acoustic texture material. The foam material does not contain particulate material, and thus the resulting texture formed does not match an existing coat of true acoustic texture material.

The need thus exists for a system for dispensing acoustic texture material that provides the convenience of an aerosol dispensing system, employs true acoustic texture material, and is easily used by inexperienced users.

RELATED ART

There are in the prior art various devices to spray a texture material onto a wall surface or a ceiling. Depending upon the nature of the composition and other factors, the material that is sprayed onto the surface as a coating can have varying degrees of "roughness".

In some instances, the somewhat roughened texture is achieved by utilizing a textured composition that forms into droplets when it is dispensed, with the material then hardening with these droplets providing the textured surface. In other instances, solid particulate material is mixed with the liquid texture material so that with the particulate material being deposited with the hardenable liquid material on the wall surface, these particles provide the textured surface. However, such prior art aerosol spray texture devices have not been properly adapted to deliver a texture having particulate matter therein to provide the rougher texture.

In particular, the Applicants are aware of prior art spray texture devices using an aerosol container which contains the texture material mixed with a propellant under pressure and from which the textured material is discharged onto a surface. Such aerosol dispensers are commonly used when there is a relatively small surface area to be covered with the spray texture material. Two such spray texture devices are disclosed in U.S. Pat. No. 5,037,011, issued Aug. 6, 1991, and more recently U.S. Pat. No. 5,188,263, issued Feb. 23, 1993 with John R. Woods being named inventor of both of these patents.

Additionally, the Assignee of the present invention has since approximately 1983 manufactured and sold manually operated devices for applying spray texture material onto walls and ceilings. These spray texture devices are described in one or more of the following U.S. Pat. Nos. 4,411,387; 4,955,545; 5,069,390; 5,188,295.

Basically, these spray texture devices comprised a hopper containing hardenable material, a manually operated pump, and a nozzle. By pointing the device at the area being patched and operating the manual pump, the hardenable material and pressurized air generated by the pump were mixed in the nozzle and subsequently sprayed onto the area being patched.

When applied to a ceiling, the hardenable material employed by these prior art spray texture devices basically comprised a mixture of the following ingredients:

a. water to form a base substance and a carrier for the remaining ingredients;
b. a filler substance comprising clay, mica, and/or calcium carbonate;
c. an adhesive binder comprising natural and/or synthetic polymers; and
d. an aggregate comprising polystyrene particles.

The filler, adhesive binder, and aggregate are commercially available from Hamilton Materials, Inc. under the tradename PurTex.

The hardenable material employed by these prior art spray texture devices further comprised one or more of the following additional ingredients, depending upon the circumstances: thickeners, surfactants, defoamers, antimicrobial materials, and pigments.

SUMMARY OF THE INVENTION

The present invention is a dispensing system that allows a predetermined, metered quantity of material to be dispensed from an aerosol container. The dispensing system is particularly adapted to dispense acoustic texture material including particles of polystyrene mixed throughout.

The present invention comprises a container system for containing the texture material and a compressed inert gas as a propellant, a valve assembly operable in an open and close configuration for allowing or preventing fluid flow from the container assembly, an outlet assembly for dispersing the texture material dispensed thereby, and a metering assembly that interacts either with the valve assembly or the outlet assembly to allow the user to control the amount of texture material dispensed.

The metering system may be as simple as a collar that limits the outlet assembly to limit the flow rate of the texture material exiting the system and thus provide the user with more control over the amount of texture material dispensed.

A more complex system requires the user to depress an actuator member fully at which point the metering assembly will release the valve assembly and cause the valve assembly to return to its closed position without any interaction by the user.

An even more complex system may require the user to press an actuator member to energize the system. After the actuator member has been depressed by a predetermined amount, the valve is triggered open and then released to close without further input from the user. In this case, the user has no control over the amount of texture material dispensed and thus cannot inadvertently dispense the entire contents of the can.

The metering assembly can be mounted within the container assembly or above the container assembly around the valve stem. Another type of metering assembly is located completely outside of the container and simply acts on a conventional valve assembly.

DESCRIPTION OF THE PREFERRED EMBODIMENTS

Figure 1:
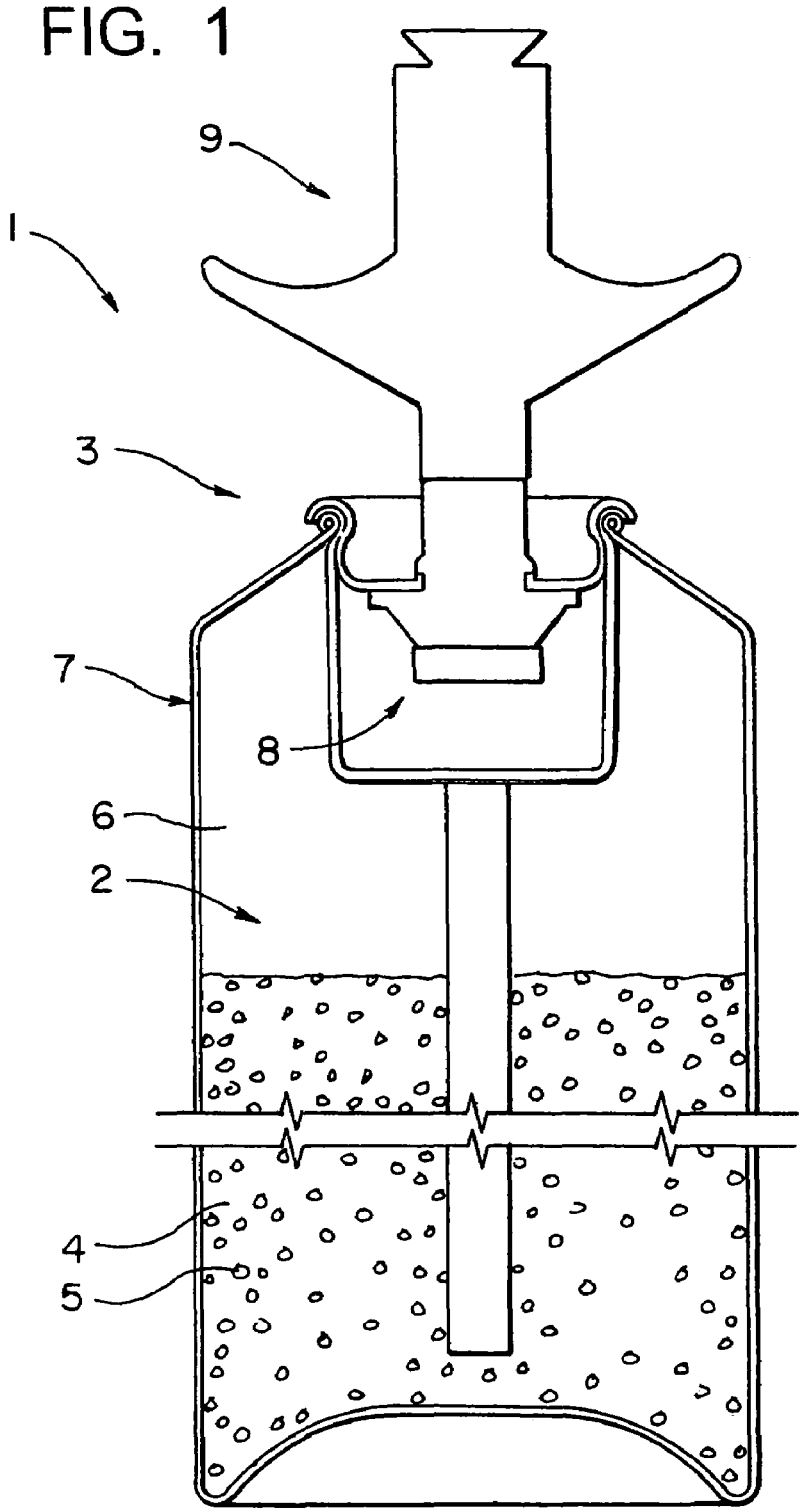
FIG. 1 is a highly schematic view depicting the major components of an aerosol dispenser for acoustic texture material constructed in accordance with, and embodying, the principles of the present invention.

As schematically depicted in FIG. 1, the present invention is an aerosol dispensing system 1 comprising a number of individual components that are designed to work together in a manner that allows acoustic texture material to be applied to a surface to be coated.

The aerosol dispensing system 1 comprises a fluid portion 2 and a mechanical portion 3. The fluid portion 2 comprises a hardenable acoustic texture material 4 containing particles 5 and a propellant material 6. The mechanical portion 3 comprises a container assembly 7, a valve assembly 8, and an actuator assembly 9.

Each of these individual components will be described in general below, and following that will be described a number of specific embodiments of the present invention that illustrate how these components work together to obtain an aerosol system or method for dispensing acoustic texture material.

I. Fluid Portion

The fluid portion 1 of the dispensing system and method of the present invention comprises the material 4 to be dispensed, hereinafter the acoustic texture material or hardenable material, and the propellant material 6.

Referring initially to the hardenable acoustic texture material 4, the Applicants determined that, in the context of applying ceiling texture material to an interior surface such as a ceiling, the composition of the hardenable material was limited by the result desired. In particular, the Applicants determined that the hardenable acoustic texture material 4 must, at a minimum, include polystyrene chips or beads as the particles 5 in order to obtain a textured surface that would satisfactorily match the surrounding original textured surface.

In general, the particles may be polystyrene, cork or other types of foam material, such as 88% polyethylene and 12% ethylene vinyl acetate, natural or synthetic rubber, elastomer, etc.

When particulate material comprising particles other than expanded polystyrene were used, however, either the spray texture material would not spray properly (i.e., the particles would bounce off the ceiling), the spray texture material would not match the original texture on the ceiling, and/or it would clog or bridge in the pick-up opening in the tube.

Accordingly, the Applicants determined that, in order to develop an aerosol product that would obtain acceptable results for patching a textured ceiling, commercially available ceiling spray texture material as has long been used by prior art non-aerosol spray texture devices is preferably used as part of the hardenable material.

The hardenable material 4 may include:

(a) water as a base and carrier;

(b) PurTex, a commercially available acoustical ceiling texture material; and (c) Foammaster 1119A, a commercially available defoamer.

The PurTex product basically comprises a calcium carbonated, mica, and/or clay as filler material, natural and/or synthetic binder, a preservative, and polystyrene chopped beads.

In addition to the ingredients recited above, the hardenable material may also comprise the following ingredients:

(a) a thickener that controls the film integrity of the composition;

(b) a surfactant;

(c) an antimicrobial component; and (d) a pigment compound (often a whitener).

Of the foregoing ingredients, the commercially available ceiling texture material could not be eliminated or altered without materially altering the appearance of the texture pattern formed thereby. This texture material is a mixture that comprises a carrier fluid component and a particulate material having particles which are mixed throughout the carrier fluid. The particulate material is made from an expanded polystyrene having a predetermined particle size. Commonly, the particles of the mixture have a variety of sizes to provide a texture surface having different particle sizes.

One preferred formulation of the texture mixture is comprised of the following ingredients:

a. a thickener that controls the film integrity of the composition;

b. a surfactant;

c. a defoamer to facilitate the processing and minimize bubbles when spraying;

d. an antimicrobial component;

e. a pigment component (often a whitener);

f. a commercially available ceiling texture material with the particles distributed therein.

g. water.

The commercially available ceiling texture material basically comprises calcium carbonate, mica, and/or clay as a filler, a synthetic or natural binder, a preservative, and polystyrene chopped beads.

Attached hereto in Appendix A are Tables A-F. These tables contain the formulas employed by the Applicants to obtain the hardenable material dispensed by the present invention. Currently, the formula contained in Table F describes the preferred commercial form of the hardenable material dispensed by the present invention.

In the attached tables, trade names are used to identify certain commercially available ingredients. The ingredient PureTex was described above. The purpose of each of the remaining ingredients will be described below: PMO 30 is a preservative; BENTONE LT is a thickener; NUOSEPT 95 is a preservative; KTPP is a surfactant; COLLOIDS 648 is a defoamer; BUSAN 11M1 is a filler, preservative, antifoamant, dispersant; TITAN 2101 l is a white pigment, MINUGEL 400 is a thickener; BENTONE EW is a thickener; and FOAMASTER 1119A is a defoamer.

The other major component of the fluid portion 2 is the propellant material 6. The propellant employed may be a compressed inert gas such as air or nitrogen that is separate from and acts on the hardenable material. The propellant may also be comprised of 50% propane and 50% isobutane, but the particles, or aggregate, cannot be formed of polystyrene in this case.

As discussed above, in the preferred case the hardenable acoustic texture material 4 should, for aesthetic purposes, include the polystyrene chips or beads 5. Accordingly, in the preferred case the propellant material 6 is preferably a compressed inert gas. Appropriate inert gasses include air, nitrogen, or a combination thereof. The compressed inert gas will not adversely affect the hardenable material 4 and, in particular, will not dissolve or otherwise cause the deterioration of the polystyrene chips or beads 5 contained therein.

II. Mechanical Portion

A shown in FIG. 1, the valve assembly 8 is mounted within the container assembly 7, and the actuator assembly 9 is mounted on the valve assembly 8. The valve assembly 7 is normally in a closed configuration in which fluid, namely the hardenable material 4, is prevented from exiting the container assembly 7. The operator depresses the actuator assembly 9 to place the valve assembly 7 into its open configuration. When the valve assembly 7 is in its open configuration, an exit passageway is created that allows fluid to flow out of the container assembly 7 through the actuator assembly 9.

The container assembly 7 is generally conventional, except that it may be modified slightly as necessary to mount the valve assembly 8 and actuator assembly 9.

The valve assembly 8 and actuator assembly 9 are unique to the present invention and will be described as necessary below in the discussion of the preferred embodiments.

III. First Embodiment

Figure 1A:
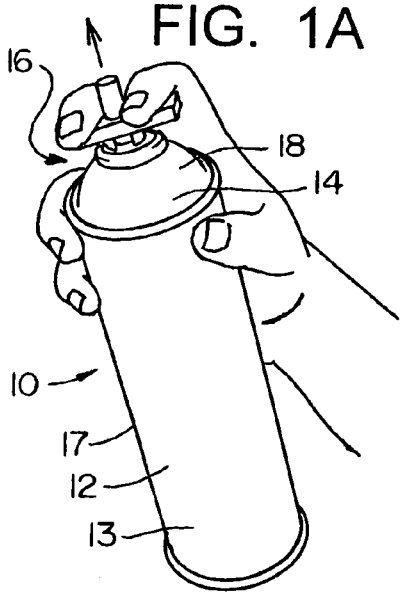
FIG. 1A is an isometric view showing a first embodiment the present invention being held in a person's hand in a manner to operate the apparatus to dispense the textured material therefrom.

In FIG. 1A, it can be seen that the apparatus 10 of the present invention comprises an aerosol container 12 defining a main pressure chamber 13, and having at its upper end 14 a valve assembly 16. The container 12 has an overall cylindrical configuration, comprising a cylindrical sidewall 17, a top wall 18 (either integral with the sidewall 17 or made separately), and a bottom wall (not shown for ease of illustration). The valve assembly 16 is mounted at the center of the top wall 18.

Figure 2:
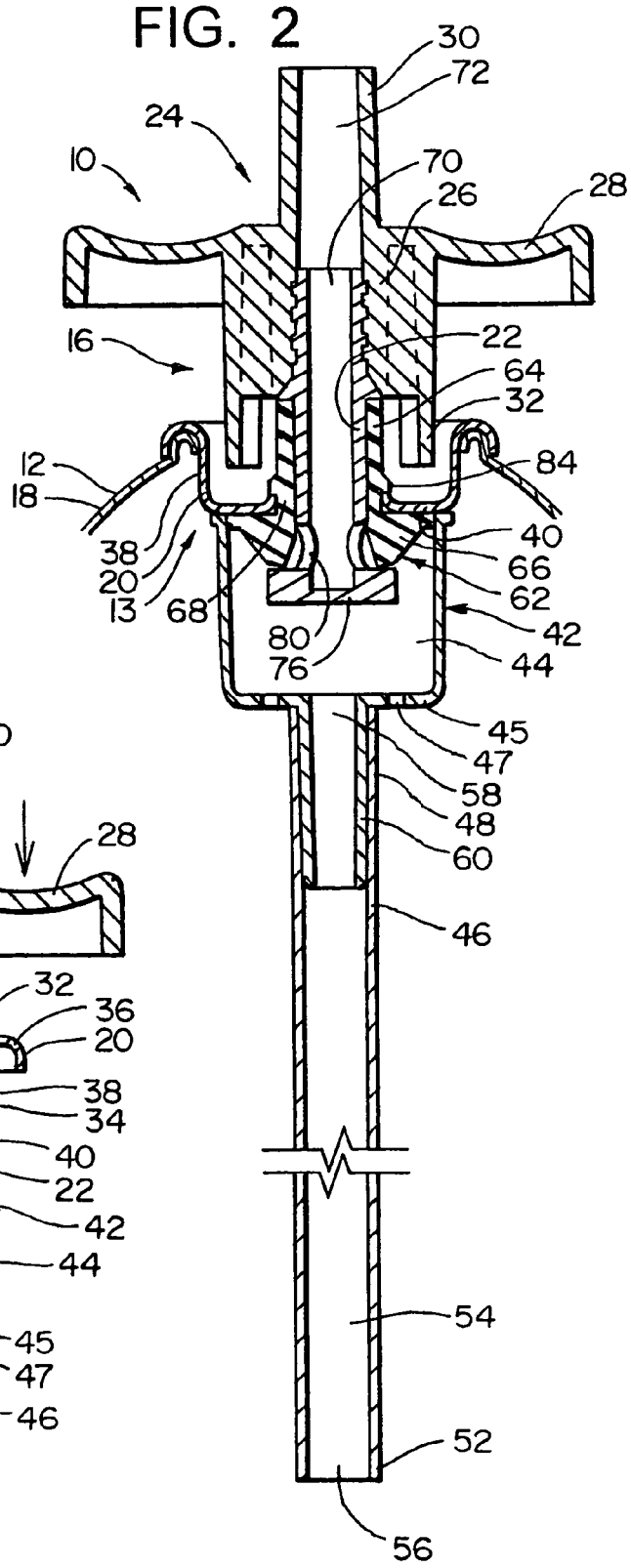
FIG. 2 is a longitudinal sectional view showing the valve assembly of the first embodiment and a small portion of the aerosol container, with the valve assembly in its closed position.
Figure 3:
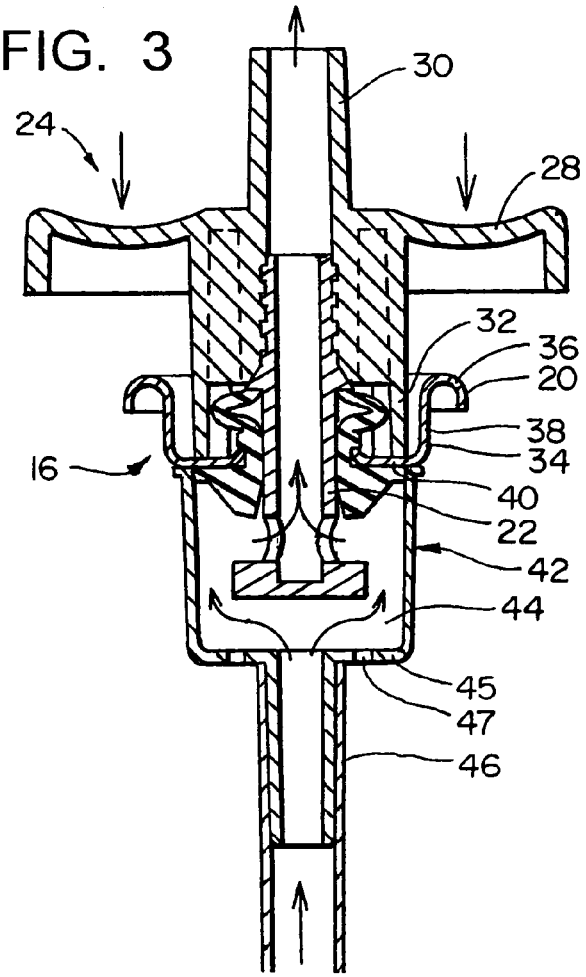
FIG. 3 is a view similar to FIG. 2, but showing the valve assembly in its open position.

The valve assembly 16 comprises a valve housing 20 mounted to the top container wall 18, and a valve stem or element 22 positioned within the housing 20 for movement between the closed position of FIG. 2 to the open position of FIG. 3. Fixedly attached to the upper end of the valve element 22 is a manually operable actuating and discharge portion 24, comprising a mounting portion 26, a cross bar 28, a discharge nozzle 30 extending upwardly from the mounting portion of 26, and a pair of positioning legs 32 extending downwardly from the mounting portion 26 and positioned diametrically opposite from one another.

The valve housing 20 comprises an annular mounting collar 34 having an outer circumferential mounting lip 36, having in cross section a semi-circular configuration so as to provide a downwardly facing circular recess to be attached to a matching circular lip formed in the top wall 18 of the container 12. The collar 34 extends downwardly a short distance from the lip 36 as a side wall 38 and has a lower inwardly extending annular wall portion 40.

The valve housing 20 also comprises a lower cylindrical housing portion 42 which defines a lower valve chamber 44 located at the lower end of the valve stem 22, and a lower wall 45. Extending downwardly from the housing portion 42 is a lower intake tube 46. It will be noted that there is formed in the lower wall 45 of the housing portion 42 a plurality of vent openings 47 positioned radially outwardly of a tube 46 and leading from the main chamber 13 in the container 12 into the lower valve chamber 44. The function of these vent openings 47 will be discussed later herein in connection with the overall operation of the apparatus 10 of the present invention.

The tube 46 has an upper end 48 connecting to the center part of a lower wall 45 of the housing portion 42 and a lower end 52 that is positioned at the lower end of the container 12. This tube 46 defines a vertical passageway 54 extending from the lower intake opening 56 of the tube 46 upwardly to an upper outlet opening 58 leading into the lower valve chamber 44. The lower housing portion 42 has a downwardly extending stub 60 that fits within the upper end of the tube 46 and defines the upper opening 58.

Figure 5:
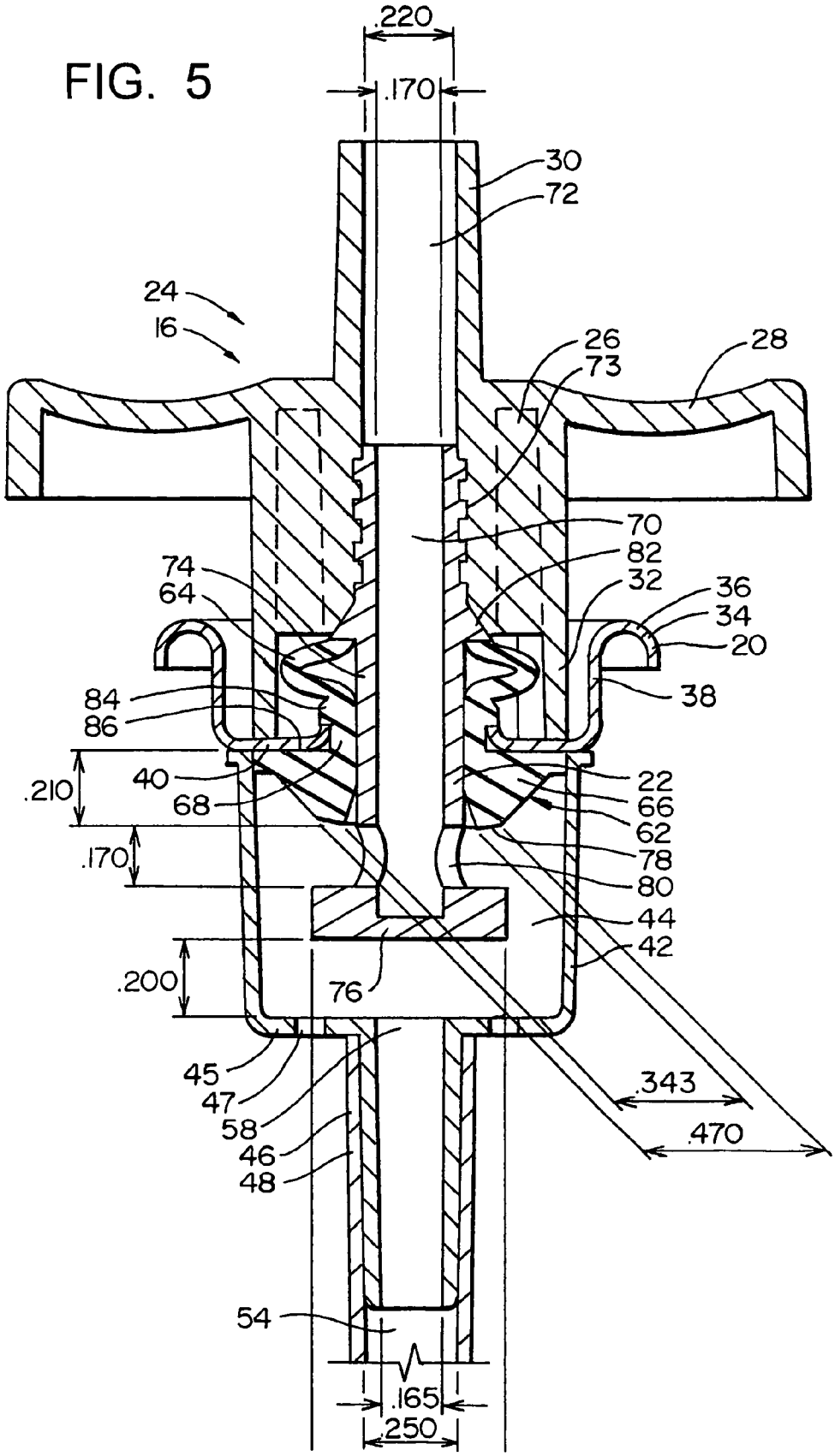
FIG. 5 is a drawing similar to FIG. 3, but drawn to an enlarged scale, and giving various dimensions which in a prototype have been proved to be suitable in the present invention.

There is an intermediate flexible fitting 62 which is operably connected and positioned between the valve housing 20 and the valve element 22. As can be seen in FIG. 5, this fitting 22 comprises an upper tubular portion 64, a lower seal portion 66 and a middle connecting portion 68 interconnecting the upper tubular portion 64 and lower seal portion 66.

This intermediate fitting 62 can be made of a moderately flexible rubber or synthetic rubber material, and it performs a number of functions. First, the upper tubular portion 64 serves as a resilient spring member which urges the valve element 22 toward its upper closed position of FIG. 2. The lower seal portion 66, as its name implies, serves to create a seal between the valve element 22 and the valve housing 20 in the closed position of FIG. 2. The connecting portion 68 functions to position the valve element 22 relative to the housing 20, and also interconnects portion 64 and 66.

Before describing this flexible fitting 62 in more detail, there will be a further description of the valve stem or element 22. The valve element 22 has an overall cylindrical configuration and defines a central vertical discharge passageway 70 that leads to the nozzle 30 that defines the upper portion 72 of the passageway 70. The upper part of the valve element 22 has exterior threads 73 which interconnect with the interior threads formed in the mounting portion 26 of the actuating and discharge portion 24. The lower middle portion 74 of the valve element has the same cylindrical configuration as the upper portion, with a smooth outer surface, and the upper tubular portion 64 of the flexible fitting 62, in the closed position of FIG. 2, fits snugly around the outer surface of this lower cylindrical portion 74.

At the lower end of the valve element 22 there is fixedly attached thereto a circular horizontal closure disc or plate 76 that closes the lower end of the discharge passageway 70. The upper perimeter surface of this closure planar disc 76 fits against a lower circumferential seal surface 78 of the seal portion 66 of the fitting 62. There is a plurality of side openings 80 formed in the side wall at the lower end of the valve element 22, at a location immediately above the lower closure plate 76. In the preferred configuration shown herein, there are two such openings 80, positioned diametrically opposed to one another.

To describe further the intermediate flexible fitting 62, the upper circular edge of the tubular portion 64 bears against an annular protrusion 82 of the valve element 22. The lower end of the tubular portion 64 has a moderately expanded circumferential lip 84 that extends over and engages the inner edge of the lower housing wall 40 that defines an opening that receives the flexible fitting 62 and the valve element 22. Thus, it can be seen from observing FIGS. 2, 3 and 5 that as the actuating and discharge portion 24 (fixedly connected to the valve element 22) is pushed downwardly, the tubular portion 64 of the flexible fitting 62 is compressed axially (see FIGS. 3 and 5) so as to urge the valve element 22 with the actuating and discharge portion upwardly to the position of FIG. 2. At the same time, the connecting portion 68 of the flexible fitting 62 continues to position the valve element 22 centrally within the collar 34 of the valve housing 20.

With regard to the seal portion 66 of the flexible fitting 62, this has in cross section a generally frusto conical configuration, with an inner cylindrical wall that fits around the lower part of the valve element 22. The upper circumferential surface 86 of the seal portion 66 fits against the lower surface of the inner lower wall 40 of the housing collar 34. In the position of FIG. 2, the aforementioned seal surface 78 is in sealing engagement with the upper surface of the closure plate 76 of the valve element 22 so as to form a seal so that the texture material that is positioned in the valve chamber 44 is sealed from the discharge passageway 70 in the valve element 22.

However, when the actuating and discharge portion 24 with the valve element 22 is depressed to the position of FIGS. 3 and 5, it can be seen that the lower closure plate 76 moves away from the seal surface 78 of the seal portion 66 to open the two intake openings 80 at the bottom of the valve element 22 so that the texture material in the valve chamber 44 is able to move through the openings 80 upwardly through the discharge passageway 70 and out the upper nozzle portion 72 of the discharge passageway 70 to pass outwardly therefrom in a spray pattern against a wall or ceiling surface or the like.

The texture material within the container 12 is a mixture that comprises a carrier fluid component and a particulate material having particles which are mixed throughout the carrier fluid. The mixture is contained within the container 12 at a predetermined pressure level which is above ambient pressure. At this predetermined pressure level a propellant portion of the carrier fluid remains liquid. Normally, there will be gas in the form of vaporized propellant in the upper portion of the container 12 in pressure equilibrium with the liquid phase. However, when the pressure is reduced to a predetermined lower level, this propellant component vaporizes.

The particulate material is made from a polystyrene material having a predetermined maximum particle size (e.g. an eighth of an inch), with each particle being compressible to a smaller particle size dimension. Commonly, the particles of the mixture will have a variety of sizes, to provide a varying texture surface. Other compressible materials, such as cork, that are compatible with the fluid components could be used.

To describe the operation of the present invention, the apparatus 10 is provided to the end user with the pressurized texture material mixture contained within the container 12, and with the particulate material distributed throughout the liquid component. The actuating and discharge portion 24 remains in the closed position of FIG. 2, where the valve element 22 is in the closed position. When it is desired to use the spray texture apparatus 10, the apparatus 10 is grasped in a person's hand as indicated in FIG. 1A, with two of the person's fingers engaging the opposite sides of the cross bar 28 to depress the cross bar 28 so as to move the valve element 22 downwardly, against the urging of the tubular portion 64 of the intermediate flexible fitting 62 so as to open the intake openings 80 of the valve element 22. Obviously, other types of handles and triggering mechanisms could be used.

With the valve element 22 in the open position of FIG. 3 or 5, it can be seen that the lower valve chamber 44 becomes exposed to ambient pressure through the valve element openings 80. When this occurs, the pressurized material in the main chamber 13 forces the texture material upwardly through the tube 46 into the valve chamber 44, with the material flowing from this chamber 44 into the openings 80 and thence out the discharge passageway 70. At the same time, the vaporized propellant portion of the fluid component of the texture material passes upwardly through the vent openings 47 into the valve chamber 44 and mixes and/or atomizes. This increases the percentage of the gaseous component of the carrier fluid that is passing into and through the valve chamber 44 and out the passageway 70.

It has been found that the particular arrangement of the present invention functions to reliably pass the particles in the mixture through the intake openings 80 to be discharged out the passageway 70. In addition to the propellant gas passing upwardly through the vents 47, the fluid component of the mixture is able to have at least the vaporizable portion thereof pass upwardly through the tube 46 into the chamber 44, with this component vaporizing at least partially to form gaseous bubbles in the texture mixture. Within the broader scope of the present invention, a propellant in gaseous form or dissolved in a medium at higher pressure could be utilized. By empirical testing, it is believed that the vaporizable portion or propellant serves at least two functions. First, it adds gas to the mixture to some extent so that as it passes from the discharge nozzle opening portion 72, it is in a desired spray pattern to be distributed on the wall or ceiling surface. Further, even though the particles in the mixture are close to the same size as the diameters of the openings 80, these particles pass reliably through these openings 80 and outwardly through the passageway 70 and the nozzle end opening 72. It is surmised that the action of the vaporizable fluid component or propellant being transformed at least partially into the gaseous state or as expanded gas cause a certain turbulence and localized pressure variations to jostle or move or force any particles loose that may temporarily be caught in the openings 80, or possibly in other parts of the valve chamber 44.

IV. Second Embodiment

Figure 4:
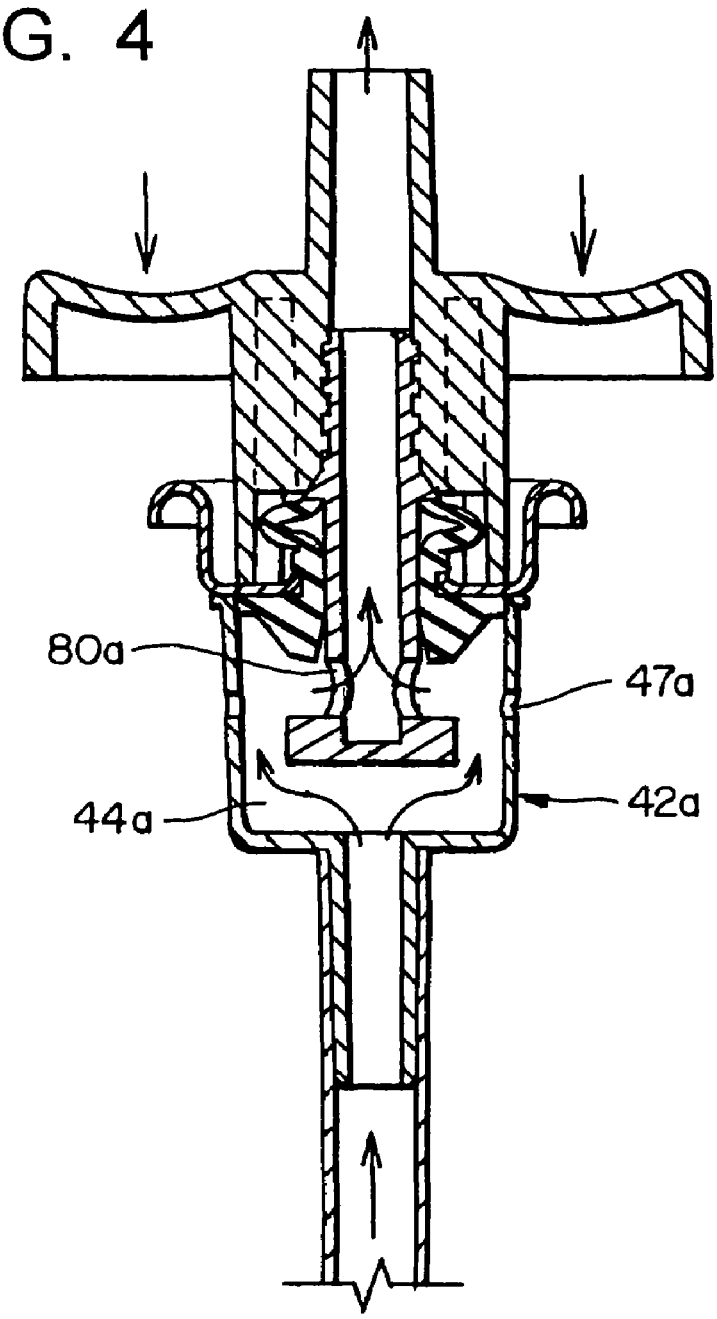
FIG. 4 is a view similar to FIG. 3, but showing a second embodiment of the present invention, where the valve assembly has a different arrangement for the vent openings of the valve assembly.

A second embodiment of the present invention is shown in FIG. 4. This is substantially the same as the first embodiment, except that the vent openings (designated 47*a*) are positioned in the sidewall of the housing 42*a* so that these direct flow laterally into the chamber 44*a* at the location of the intake openings 80*a*. It is surmised that this location of the vent openings 47*a* are able to be oriented to effect a tangential swirling pattern, or oriented more radially to provide a more direct force, in the vicinity of the openings 80*a* to enhance proper movement of the particles.

FIG. 5 is an enlarged view giving in inches the dimensions of a prototype built in accordance with the teachings of the present invention, and also to show the components more clearly. It is to be recognized, of course, that these dimensions could be increased or decreased within certain limits (e.g. ten percent, twenty percent, or possibly as high as fifty percent or higher, and in some instances changed to provide different proportional relationships in these dimensions) to obtain certain design objectives. Further, the openings 80 could be made moderately larger than the maximum dimension of the particles, or in some instances even smaller than the particle dimension, if the particles are sufficiently compressible.

V. Third Embodiment

Figure 6:
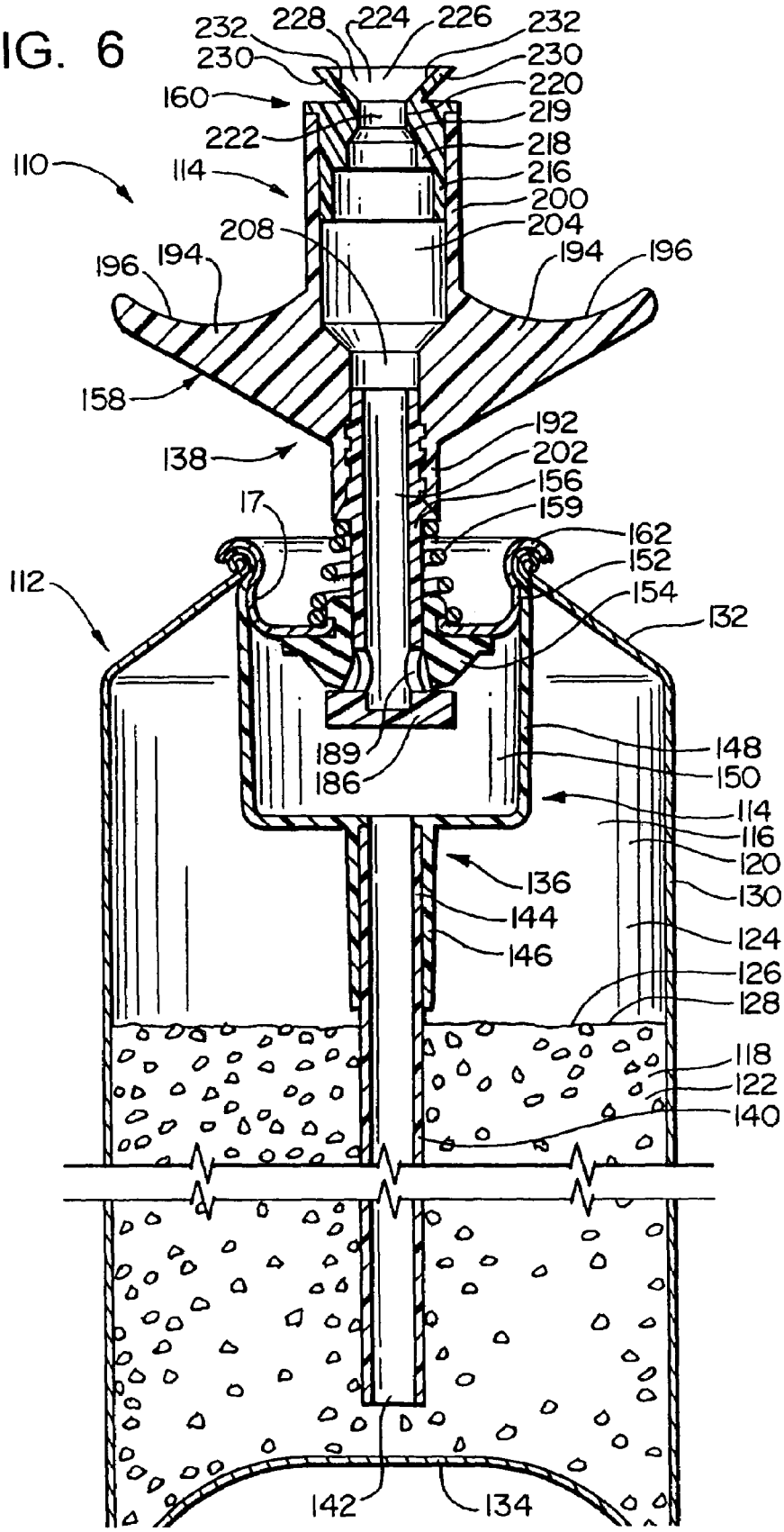
FIG. 6 is a longitudinal sectional view of a third embodiment of the present invention.
Figure 7:
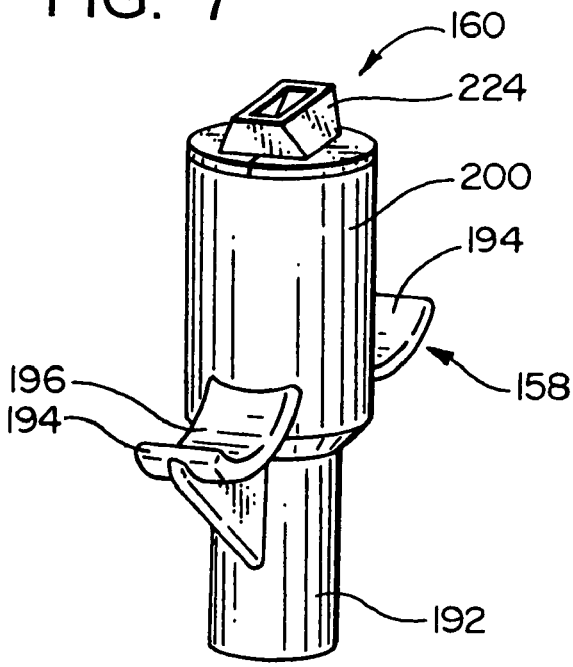
FIG. 7 is an isometric view of an upper portion of the valve assembly of the third embodiment.

FIG. 6 illustrates at 110 of the third embodiment of the present invention which is particularly adapted to apply an acoustic texture material to the surface of a ceiling. This apparatus 110 comprises a container 112 and a discharge assembly 114. The container 112 defines a chamber 116 having a texture material containing portion 118 and a propellant containing portion 120. In this third embodiment, the texture material containing portion 118 is located in the bottom part of the chamber 116 since the apparatus 110 is normally operated in a vertically aligned position so that the texture material 122 is positioned by gravity in the lower part of the chamber 116. The propellant containing portion 120 is in the upper part of the chamber 116, and the propellant 124 is a gaseous substance which is substantially inert, such as nitrogen or atmospheric air, relative to the texture material 122. There is a pressure interface 126 between the upper surface 28 of the texture material 122 and the gaseous propellant 124 that is immediately above, with the propellant 124 being (in this third embodiment) in direct contact with the texture material 122.

The container 112 comprises a cylindrical side wall 130, having an upper frusto-conical wall section 132, and a bottom wall 134. The discharge assembly 114 comprises an infeed section 136 and a valve section 138.

The infeed section 136 comprises a feed tube 140 having a lower open end 142 positioned adjacent to and just above the bottom wall 134, and an upper end 144 which fits within a downwardly extending stub 146 that is part of an entry chamber housing 148 that defines an entry chamber 150. To describe briefly the function of this infeed section 136, in operation the texture material 122 is forced by pressure from the propellant 124 to flow into the lower open end 142 of the tube 140 and into the entry chamber 150. From this chamber 150, the texture material flows into the valve section 138.

The valve section 138 comprises a mounting collar 152 (sometimes referred to as a "cup"), a flexible valve seal and mounting member 154, a valve stem 156, a valve handle portion 158, a positioning spring 159, and an end nozzle section 160.

Figure 9:
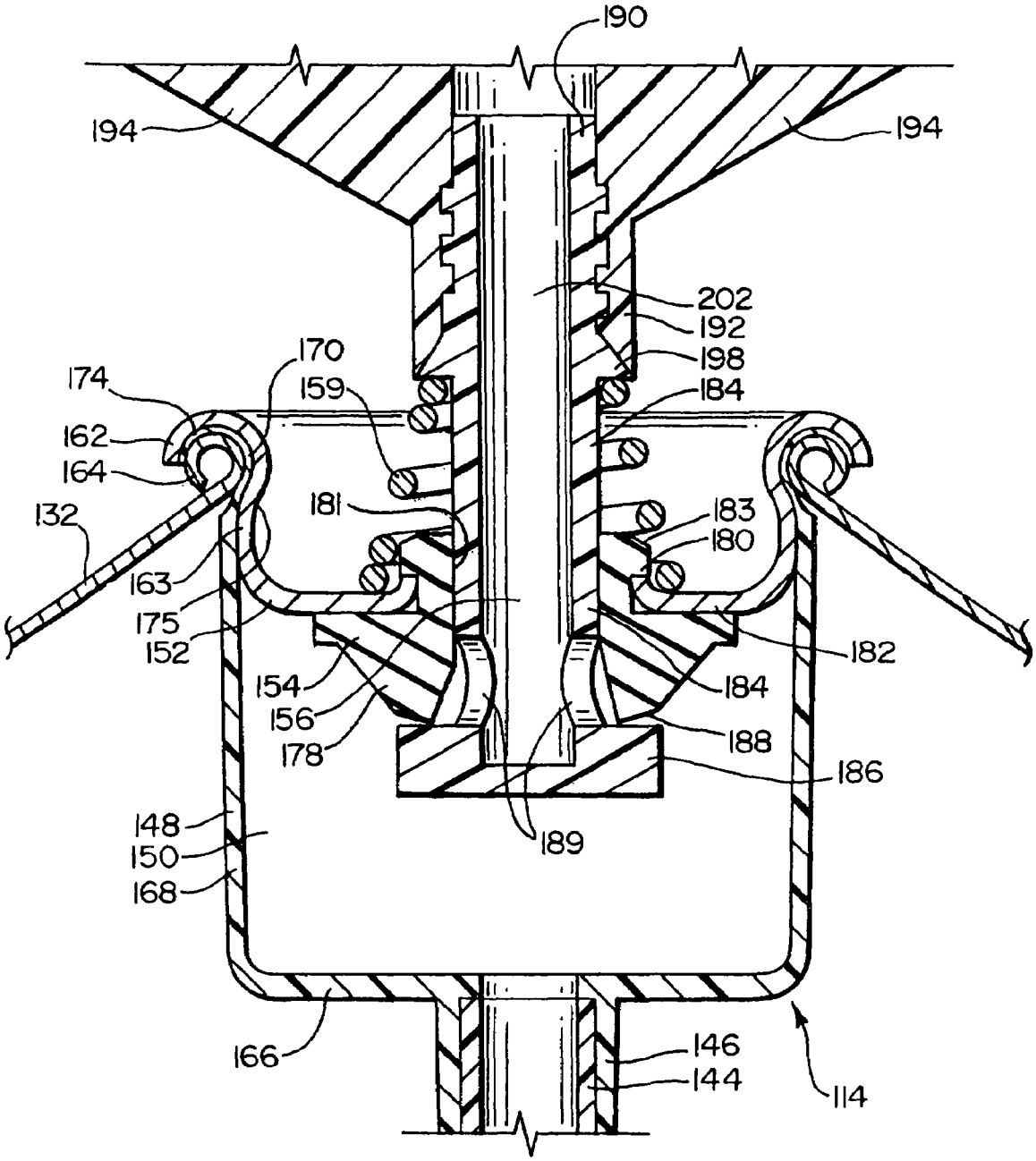
FIG. 9 is a longitudinal sectional view of the lower and middle portion of the valve assembly of the third embodiment of FIG. 6, with the valve in the closed position.
Figure 10:
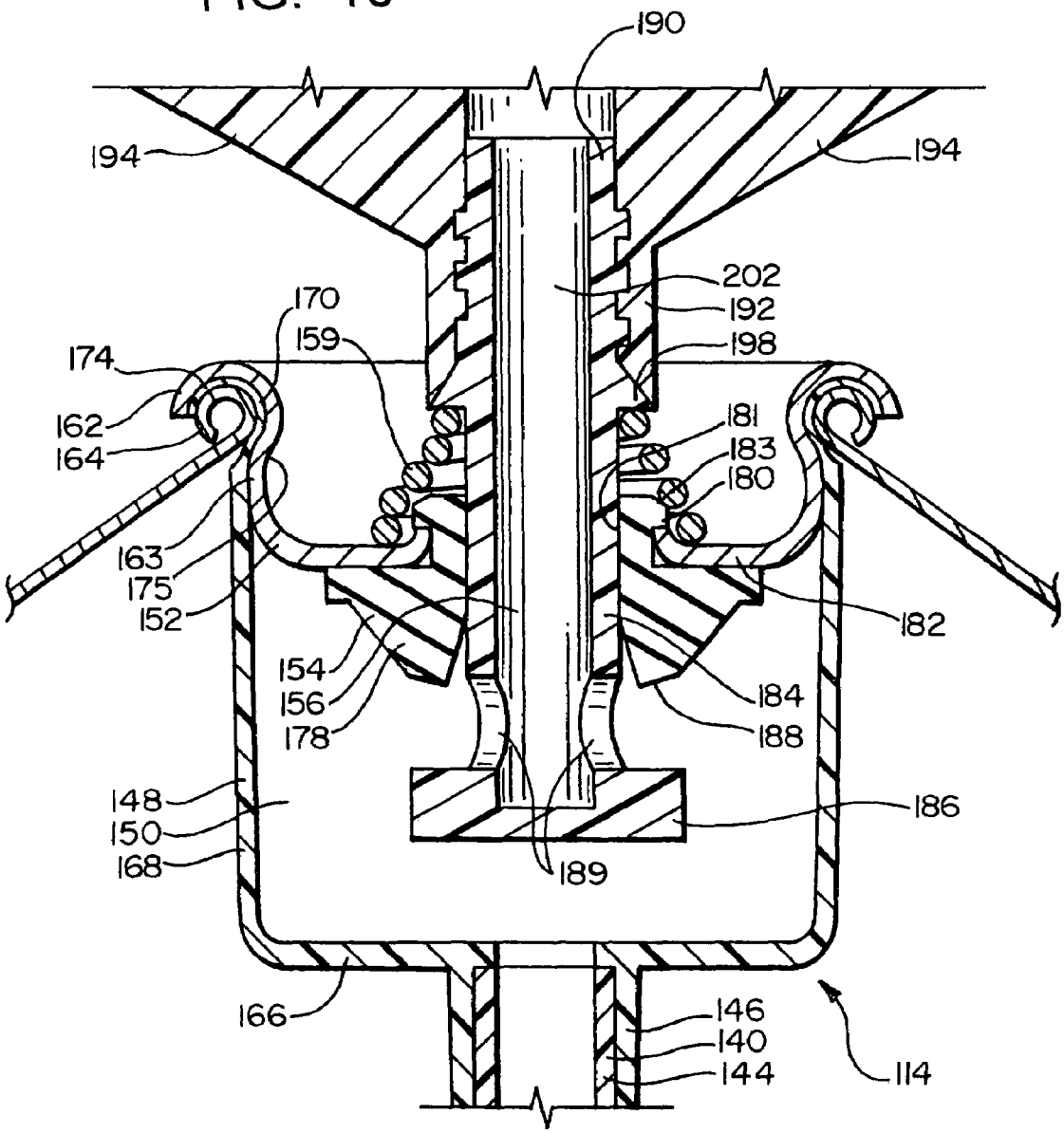
FIG. 10 is a view similar to FIG. 9, but showing the valve in the open position.

With reference to FIGS. 9 and 10, the valve mounting collar 152 has a perimeter portion 162 which extends upwardly from the collar side wall 163 to curve upwardly and outwardly and then downwardly in approximately a 180° curve. This perimeter portion 162 is positioned over a circumferential lip 164 that is formed from an inner circumferential edge of the upper wall 132 and extends in a circle around the inside edge of the frusto-conical upper wall 132. This lip 164 at its inner edge is curved (as seen in cross section) upwardly, outwardly and then downwardly in a curved configuration so as to fit within the curved perimeter portion 162 of the mounting collar 152.

A significant feature of the present invention is the manner in which this mounting collar 152 forms a seal with the upper container wall 132 and also forms a seal with the aforementioned entry chamber housing 148. More particularly, the entry chamber housing 148 comprises a bottom wall 166 and a cylindrical side wall 168. The walls 166 and 168 are made integrally of a semi-rigid plastic material which is able to yield moderately.

As can be seen in FIG. 9, the upper edge 170 of the side wall 168 has its thickness dimension reduced to a very small thickness so as to be reasonably flexible. Then the upper edge portion is formed in a curve 170 that extends upwardly and inwardly, and then outwardly in a somewhat downward curve, this curved portion being indicated at 174, so that this upper curved portion 174 of the chamber member side wall 168 fits snugly between the collar perimeter portion 162 of the collar 152 and the circular lip 164 of the upper container wall 132.

In addition, by initially forming the edge portion 174 of quite thin material (which then can be formed in a circular curve), stresses that might be created in thus attaching the upper edge portion 174 to the container lip 164 are not transmitted into the side wall 168 of the entry chamber housing 148.

This connection of the perimeter portion 162, circular lip 164 and the curved section 174 can conveniently be provided as follows. The inner edge of the container upper wall 132 is preformed to form the circular lip 164, and the collar 152 is also preformed with its semi-circular perimeter portion 162. The upper curved section of the entry housing 148 can either be preformed with its upper curved section 174, or this curve 174 can be made at the time of assembly.

Initially, the entry housing 148 with the tube 140 already mounted therein is positioned within the container 112 with the upper edge portion 174 of the housing sidewall 168 overlying the container lip 164. Then the mounting collar 152, with the seal and mounting member 154 and the valve stem 156 already mounted thereto is positioned in the opening at the upper end of the container 112, with the collar perimeter portion 162 overlying the curved portion 174. After this, an expanding tool is positioned within the collar 152 and is operated to push radially outwardly against the sidewall 163 of the collar 152 at approximately the location 175 to expand the collar sidewall at the location outwardly a short distance so that it forms a slanted wall section that engages part of the underside of the container lip 164. This secures the collar 152 in place. Also, this makes a tight fit between the collar perimeter portion 162, the container lip 164 and the curved portion 174 so that a proper seal is formed. This seal is formed not only with respect to the chamber 116, but also this forms a seal within the entry chamber 150.

The valve seal and mounting member 154 in terms of function has two portions, namely a lower seal portion 178, and second a mounting portion 180. The mounting portion 180 has a center opening 181 and fits within the inner circular edge of a lower wall 182 of the mounting collar 152. The mounting portion 180 has a lip or shoulder 183 that extends over the inner edge of the wall 182, and the seal portion 178 fits against the lower surface of the wall 182.

In this manner, the mounting portion 180 serves to support the valve stem 156 in the opening 181, with the valve stem supporting the valve handle portion 158 and the end nozzle section 160. The seal portion 178 forms a seal not only for the inlets of the valve stem 156, but also forms a seal with the lower collar wall 182.

The describe the valve stem 156, there is a vertical tubular portion 184 that has as its lower end a closure disk or plate 186 which in the closed position abuts against the lower circular edge 188 of the seal portion 178. The lower part of the tubular portion 184 of the stem 156 has two laterally extending openings 189. In the closed position of FIG. 6, the seal portion 178 closes these two openings 189. The upper end portion 190 of the tubular stem portion 184 has external threads so that it can be connected to the handle portion 158.

The valve handle portion 158 has a lower cylindrical mounting portion 192 which is internally threaded and fits in threaded engagement onto the upper end 190 of the valve stem tubular portion 184. This handle portion 158 has two outwardly extending actuating members or handle members 194 extending in opposite directions from one another, each of these members 194 having an upwardly concavely curved surface 196 to be engaged by the fingers of the person.

A circumferential shoulder 198 on the valve stem 156 engages the upper end of the positioning spring 159, and the lower end of the positioning spring 159 bears against the upper surface of the collar wall 182. Thus, when the handle portion 158 is depressed downwardly, the spring 59 is deformed downwardly so as to provide a restoring force to move the handle portion 158 upwardly when the handle portion 158 is released. The upper part of the handle portion 158 comprises a tubular extension 200 that is connected to the end nozzle section 160.

Figure 8:
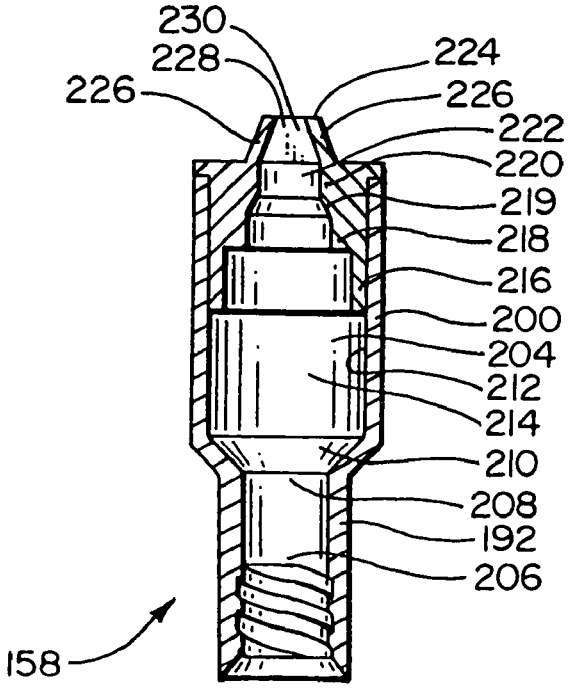
FIG. 8 is a longitudinal sectional view of that portion of the valve assembly illustrated in FIG. 7.

The tubular portion 184 of the valve stem 156 defines an upwardly extending through passageway 202 which lead into an expanded passageway section (generally designated 204) formed in the upper end portion 200 of the handle portion 158 in conjunction with the upper nozzle section 160. With reference to FIG. 8, the valve handle portion 158 is formed so that immediately above the threaded mounting portion 192, there is an initial lower passageway portion 206 which receives the very upper end of the valve stem 176, and defines an upper passage entry portion 208. This passageway portion 208 lead into an upwardly and outwardly expanding passageway portion 210 which in turn leads into an inside surface portion 212 of a greater diameter, the surface portion 212 in effect defining an expansion chamber 214 which is part of the expanded passageway portion 204. From the chamber 214, the passageway portion 204 diminishes in cross-sectional area in an upward direction, and this uppermost converging passageway section is formed by the nozzle section 160.

This nozzle section 160 is made of two molded parts which are half sections which fit within the valve handle upper portion 200 and are joined to one another along a vertical center plane as two side by side sections. There is a lowermost circular portion 216 having its diameter smaller than the diameter of the chamber surface portion 212. Immediately above the section 216 there is a further necked down section 218, and this connects to an upwardly and inwardly slanted portion 219 to a further upward portion 220 which defines a yet smaller cylindrical passageway section 222 that leads into an end nozzle portion 224.

This end nozzle section 224 comprises two plate sections or flanges 226 which define therebetween an elongate laterally extending slot 228. These two plate sections 226 converge toward one another to form the end slot 228. In addition, as can be seen in FIG. 6, at opposite ends of the two flanges 226 there are laterally and outwardly extending connecting portions 230 which have outwardly slanting upwardly facing surface portions 232. Thus, it can be seen that this passageway at 222 is transformed in an upward direction from a cylindrical passageway to a passageway which converges in one direction (caused by the plates 226 slanting toward one another), and expands in a direction 90° from the first direction (caused by the outward slant of the surfaces 232 of the connecting portions 230).

The texture material 122 within the container 112 is a mixture that comprises a carrier fluid component and a particulate material having particles which are mixed throughout the carrier fluid. The gaseous propellant 124 in the upper chamber portion 120 is at a predetermined pressure level which is above ambient pressure (e.g. 100 PSI).

The particulate material is made from an expanded polystyrene having a predetermined maximum particle size (e.g. the larger particles averaging about ⅛ of an inch across), with each particle being compressible to a smaller particle size dimension. (A compression test of a preferred form of the material indicates that under 100 PSI pressure, the volume is decreased from 100% down to 25% of the original volume). Commonly, the particles of the mixture has a variety of sizes to provide a texture surface having different particle sizes. While this polystyrene material is the preferred material, within the broader scope of the present invention other materials (desirably compressible materials) could be used.

To describe the operation of the present invention, the apparatus 110 is provided to the end user with the texture material mixture contained within the container, and with the particulate material distributed throughout the fluid component. The texture material 22 occupies at least approximately one half of the volume of the chamber 116 or possibly somewhat more than half the volume of the chamber 116. Since the apparatus 110 is commonly operated in a vertical position to apply the spray texture material upwardly to a ceiling, the texture material 122 is normally positioned in the bottom of the container 112. In use, the apparatus 110 is grasped in a person's hand, with two of the person's fingers engaging the upper surfaces 196 of the handle members 194 to depress the handle portion 158 and the valve stem 156 against the urging of the spring 159. This moves the closure disk or plate 186 downwardly to expose the openings 188. The pressurized gas 124 pushes the texture material 122 upwardly through the tube 140 into the entry chamber 150. It has been found that the particular arrangement as shown herein functions to reliably pass the particles in the mixture through the lateral valve openings 188 and into the passageway 202 defined by the valve stem 156.

The texture material 124 flows through the passageway 202 of the valve stem 156 into the expansion chamber 204, and thence upwardly through the converging passageway portion defined by the nozzle portion 160. As the texture material flows into the upper nozzle portion, the texture material expands laterally in the end nozzle portion 224 in one direction, while the passageway is diminished in the direction 90° to the first direction. The material exiting from this elongate nozzle opening 228 is disbursed upwardly and somewhat laterally to be applied to the surface (which, as indicated previously, would usually be a ceiling to which an acoustic texture material is applied.

As described above, the texture mixture may comprise one or more the following ingredients:

a. a thickener that controls the film integrity of the composition;
b. a surfactant;
c. a defoamer to facilitate the processing and minimize bubbles when spraying;
d. an anti-microbial component;
e. a pigment component (often a whitener);
f. a commercially available ceiling texture material with the particles distributed therein;
g. water.

When deposited on the surface, the texture material hardens to form the finished textured surface.

VI. Fourth Embodiment

Figure 11:
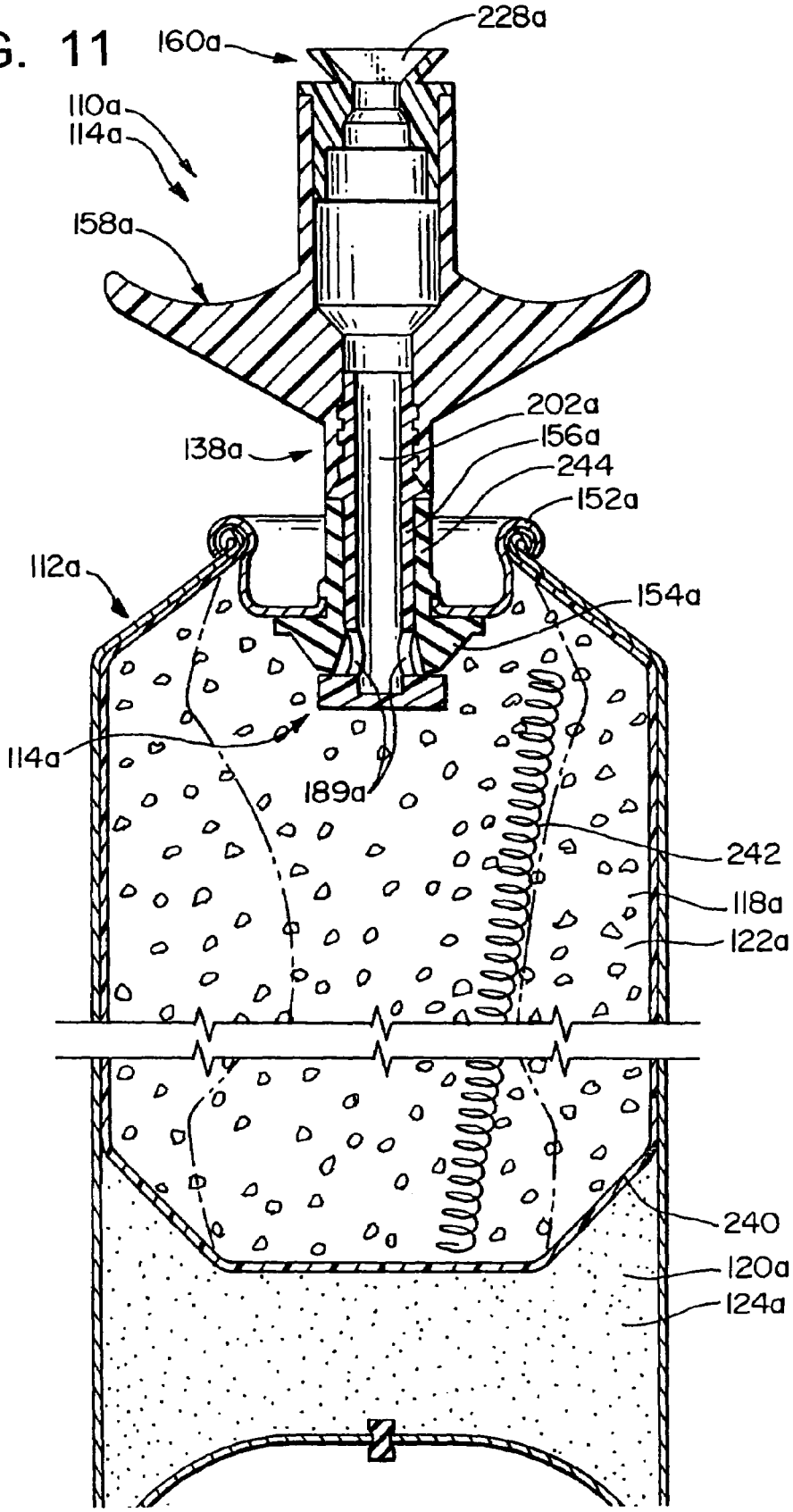
FIG. 11 is a longitudinal sectional view, similar to FIG. 6, of a fourth embodiment of the present invention.
Figure 12:
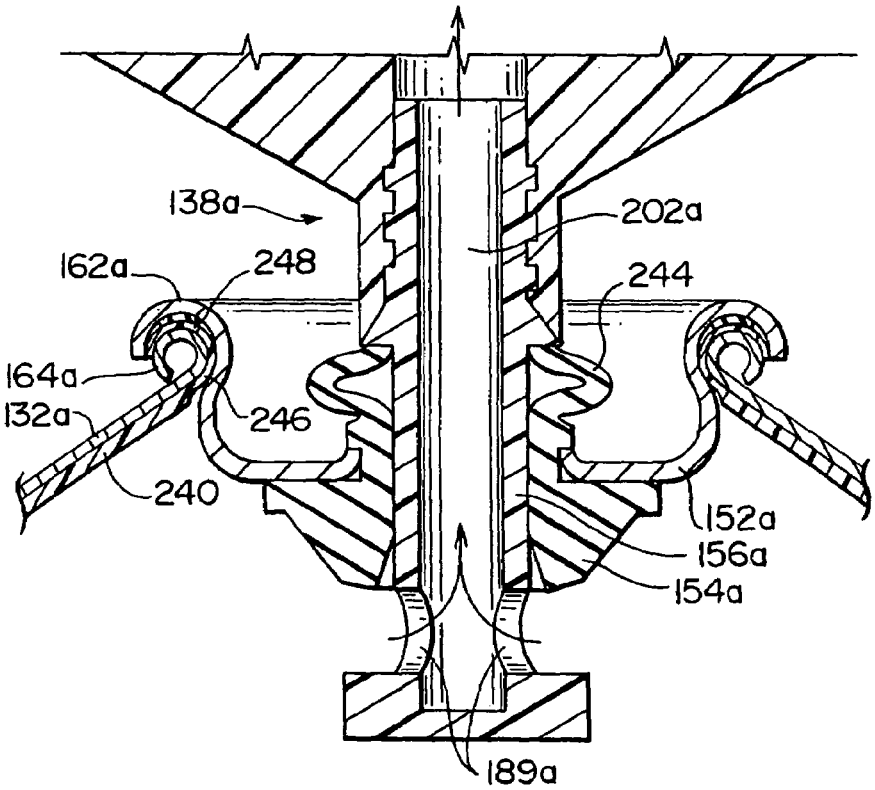
FIG. 12 is a longitudinal sectional view of the lower part of the valve assembly of the fourth embodiment of FIG. 11.

A fourth embodiment of the present invention is illustrated in FIGS. 11 and 12. Components of this fourth embodiment which are similar to components of the third embodiment will be given like numerical designations, with an "a" suffix distinguishing those of the second embodiment.

In this fourth embodiment, the apparatus 110*a* comprises a container 112*a* and a discharge assembly 114*a*. However, the discharge assembly 114*a* does not have the feed tube 140 and the entry chamber housing 148 that are present in the third embodiment 110, shown in FIGS. 6 through 10.

Another difference in this fourth embodiment is that the texture material 122*a*, instead of being positioned by gravity in the bottom of the container 112*a*, is contained in a flexible sack-like container 240 that forms the texture material chamber 118*a* immediately adjacent to the valve section 138. Further, the propellant 124*a* is separated from the texture material 122*a* by the flexible container 240, and this propellant 124*a* is a vaporizable liquid which when under pressure in the container remains liquid, but with a small pressure reduction vaporizes to form a gas which pushes against the texture material 122*a*.

In order to prevent the flexible sack-like container 240 from deforming in a manner to close off the intake openings to the valve, there is provided an elongate spring 242*a* which is positioned vertically in the texture material chamber 118*a*. The upper edge of the flexible container 240 is placed in a curve over the inner rounded edge 164*a* of the container upper wall 132*a*, and beneath the curved perimeter portion 162*a* of the collar 152*a*, in the same manner as the rounded portion 174 of the entry chamber housing of the third embodiment.

As in the third embodiment, there is the valve section 138*a* which comprises a mounting collar 152*a*, the seal and mounting member 154*a*, the valve stem 156*a*, the valve handle portion 158*a*, and the end nozzle section 160*a*. All of these components 152*a* through 160*a* are substantially the same as in the third embodiment, except that the positioning spring 159 of the third embodiment is omitted. In its place, the seal and mounting member 154 is provided with an upwardly extending resilient tube portion 244 that is made integral with the seal and mounting member 154. When the handle portion 158*a* is depressed, this deforms this resilient tubular portion 244 outwardly so as to be axially compressed.

In operation, when the valve section 138*a* is moved to the open position, the propellant 124*a* pushes the texture material 118*a* into the valve openings 188*a* and out and upwardly through the passageway 202*a*, to exit out the nozzle opening 228*a*. The manner in which this occurs is believed to be evident from the description in the third embodiment, so this will not be repeated in connection with this fourth embodiment.

As indicated above, as the volume of the texture material 122*a* decreases, the flexible container 240 collapses, with the propellant 124*a* expanding in the propellant chamber 120*a*.

VII. Fifth Embodiment

Figure 13:
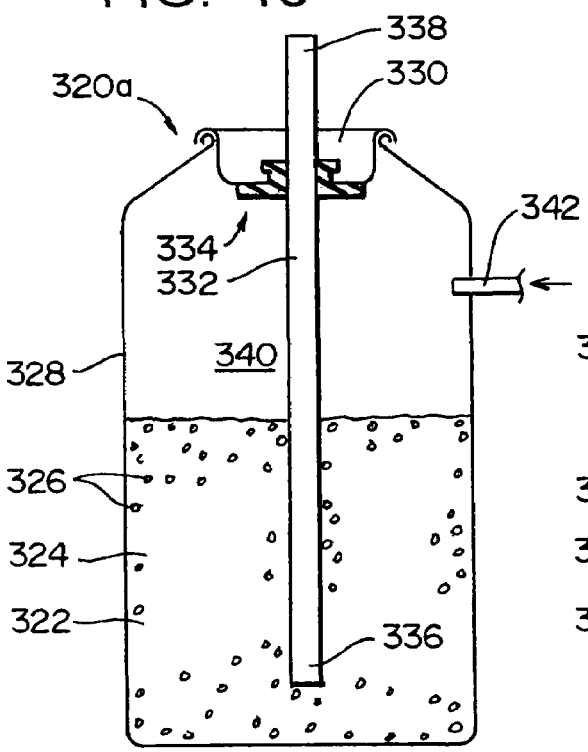
FIG. 13 is a longitudinal sectional view of a fifth embodiment of the present invention.

Referring now to FIG. 13 of the drawing, depicted therein at 320*a* is a spray texturing device constructed in accordance with of, and embodying, the principles of a fifth embodiment of the present invention. This device 320*a* is adapted to contain and dispense a hardenable material 322. The hardenable material 322 comprises a commercially available ceiling texture material 324 containing polystyrene particles 326.

The aerosol device 320*a* basically comprises a container 328, a cap 330, and a collection tube 332. The cap 330 mounts the collection tube 332 within an opening 334 in the container 328 such that a first end 336 of the collection tube 332 is within the container 328 and a second end 338 of the collection tube 332 extends out of the container 328. The hardenable material 322 is contained within a chamber 340 defined by the container 328. The collection tube first end 336 extends into the hardenable material 322.

A port 342 is formed in the container 328 to allow pressurized air to be introduced into the chamber 340. When the container 328 is in the upright position shown in FIG. 13, the introduction of pressurized air through the port 342 into the chamber 340 forces the hardenable material 322 into the collection tube first end 336, through the collection tube 332, and out of the collection tube second end 338. Accordingly, the aerosol device 320*a* in its most basic form employs a compressed inert gas such as air to force a hardenable material containing particulates upwardly out of the container 328.

VIII. Sixth Embodiment

Figure 14:
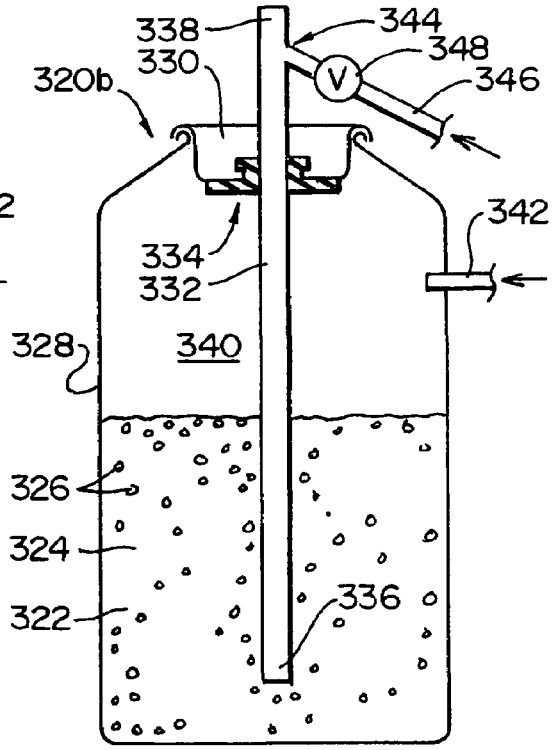
FIG. 14 is a longitudinal sectional view of a sixth embodiment of the present invention.

Referring now to FIG. 14, depicted therein at 320*b* is sixth embodiment of an aerosol device constructed in accordance with, and embodying, the present invention. The aerosol device 320*b* is constructed and operates in the same basic manner as the device 320*a* above. However, the device 320*b* further comprises a manifold 344 at which a vapor tap tube 346 is connected to the dispensing tube 332. Compressed air injected into the tube 346 will mix with the hardenable material 322 exiting the dispensing tube 322 near the dispensing tube second end 338 to atomize the hardenable material 322 as it leaves the tube 332. By vaporizing the hardenable material 322 as it leaves the dispensing tube 332, the hardenable material 322 sprays as it leaves the device 320*b* as is the tendency with the material 322 as it leaves the aerosol device 320*a* described above. While a stream of hardenable material 322 can be used to patch a ceiling, the spray developed by the aerosol device 320*b* more evenly and effectively distributes the hardenable material onto the ceiling. A valve 348 was employed to vary the amount of air used to atomize the hardenable liquid 322.

IX. Seventh Embodiment

Figure 15:
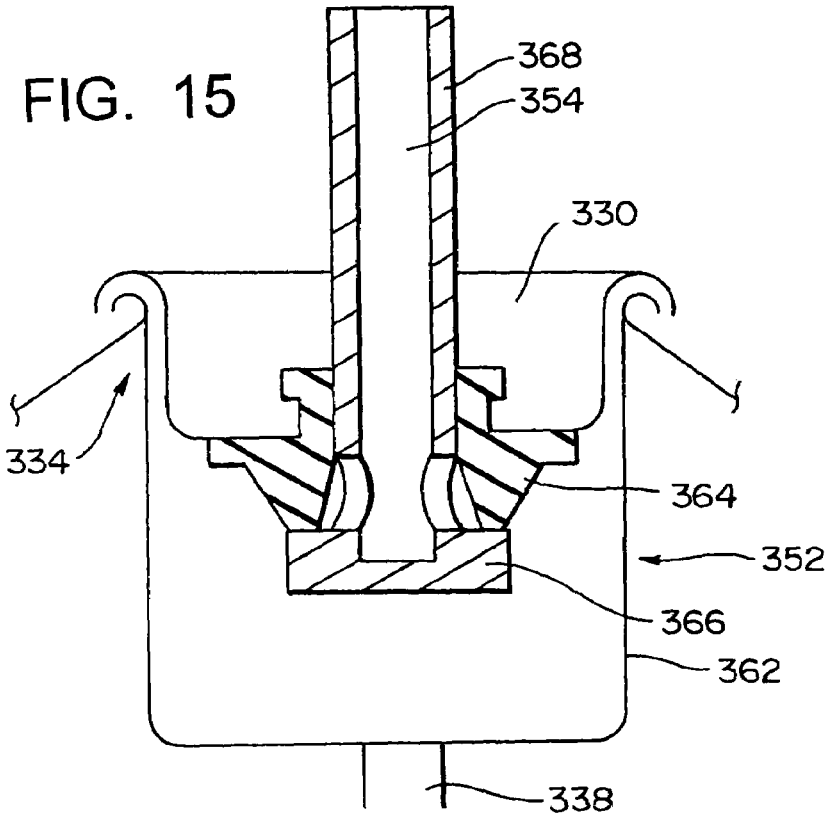
FIG. 15 is an enlarged longitudinal section view of a portion of the seventh embodiment of FIG. 16, with a broken line circle showing that portion of FIG. 16 enlarged as FIG. 15.
Figure 16:
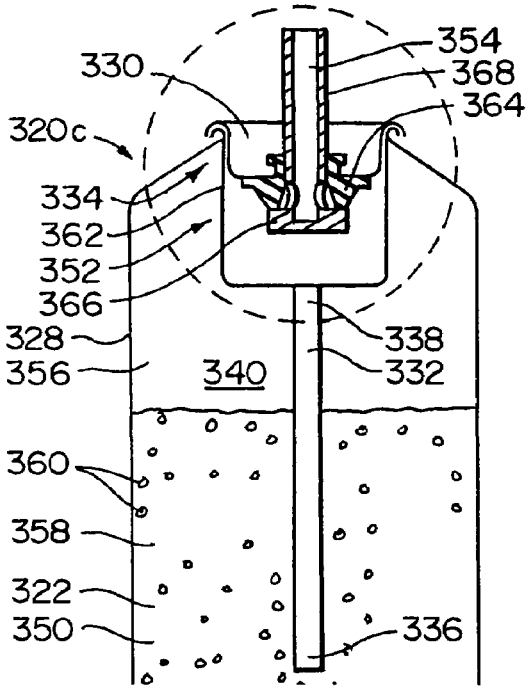
FIG. 16 is a longitudinal sectional view of a seventh embodiment of the present invention.

Referring now to FIGS. 15 and 16, depicted therein is yet another exemplary aerosol device 320*c* constructed in accordance with, and embodying, the principles of a seventh embodiment of the present invention. Elements of the aerosol device 320*c* that are the same as those of the device 320*a* are assigned the same reference character and will be described herein only to the extent that they differ from the corresponding element of the device 320*a*.

The aerosol device 320*c* fundamentally differs from the devices 320*a* and 320*b* described above in that the device 320*c* employs a vaporizable liquid 350 to propel the hardenable material 322 from the container 328. The vaporizable liquid 350 can be a hydrocarbon material as is well known in the art.

The device 320*c* further comprises a valve assembly 352 for allowing the operator to open or close a dispensing passageway 354 through which the hardenable material 322 is discharged.

When the valve assembly 352 is operated to establish the discharge passageway 35, the vaporizable material 350 vaporizes and becomes a gas which collects in an upper portion 356 of the chamber 340. This gas acts on the hardenable material 322 to force this material through the discharge passageway 354 and out of the container 328.

In this case, with a liquid hydrocarbon used as a propellant, a texture material 354 comprising particles 356 of material other than polystyrene should be used. The liquid hydrocarbon will dissolve polystyrene particles. Accordingly, the particles 356 should be formed of cork or other materials that will not be dissolved by the liquid hydrocarbons. In this case, the aerosol device 320*c* is not optimized for use as a ceiling texture material dispenser because the particles 356 will either bounce off of the ceiling or will not adequately match the texture of the surrounding ceiling.

The valve assembly 352 is constructed and operates in the same basic manner as the valve section 138 described above with reference to FIG. 6 and will be described herein only briefly. The valve assembly 352 basically comprises a housing 362, a valve seat 364, and a valve member 366 having a valve stem 368.

The discharge tube 332 is connected to the valve housing 362. The valve assembly 352 is opened by downwardly pressing the valve stem 368. When the valve is so opened, the discharge passageway 354 is defined by the discharge tube 332, valve housing 362, and valve member 366.

X. Eighth Embodiment

Figure 17:
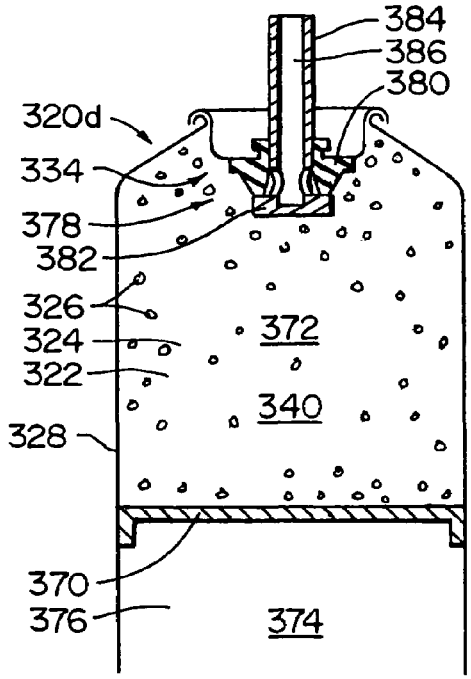
FIG. 17 is a longitudinal sectional view of an eighth embodiment of the present invention.

Referring now to FIG. 17, depicted at 320*d* therein an eighth embodiment of an aerosol device constructed in accordance with, and embodying, the principles of the present invention. The aerosol device 320*d* is constructed in a manner basically similar to that of the device 320*a* described above. Components of the device 320*d* that are the same as those of the device 320*a* described above will be assigned the same reference character and described below only to the extent necessary for a complete understanding of the operation of the device 320*d*.

The aerosol device 320*d* comprises a piston member 370 arranged within the container 328 such that the chamber 340 is divided into a first portion 372 and a second portion 374. The hardenable material 322 including the ceiling texture material 324 comprising polystyrene particles 326 is arranged in the first portion 372 of the chamber 340. The chamber second portion 374 contains a propellant material such as a vaporizable hydrocarbon liquid or a compressed inert gas such as air or nitrogen.

A valve assembly 378 is mounted to the cap 330 within the opening 334 in the cannister 328. This valve assembly 378 comprises a valve seat 380 and a valve member 382 having a valve stem 384. Depressing the valve stem 384 downwardly allows the hardenable material 324 within the chamber first portion 372 to flow through an exit passageway 386 to the exterior of the container 328. The discharge passageway 386 is defined by the valve member 382. When the valve assembly 378 is opened, the propellant material 376 in the chamber second portion 374 is allowed to expand. As it expands, the propellant material 376 acts on the piston member 370 to force the hardenable material 324 out of the cannister 328.

The piston member 370 thus separates the hardenable material 324 from the propellant material 376, allowing the use of liquid hydrocarbons as a propellant material. However, it should be recognized that a perfectly fluid-tight seal around the perimeter of the piston member 370 cannot be maintained; thus, over time, the propellant material 376 may seep into the chamber first portion 372 and, if the propellant material 376 is a liquid hydrocarbon and the particles 326 are polystyrene, dissolve these particles 326.

XI. Dispersion Means

With conventional texture material without polystyrene particles, the liquid propellants used gassify as the exit the aerosol device with the texture material; the gassifying liquid propellant causes the texture material to exit the aerosol device in the form of a conical spray rather than a stream.

Because the acoustic texture material dispensed by any of the various dispensing assemblies described herein uses compressed inert gas as a propellant rather than a conventional liquid propellant, the texture material is not broken up into a spray and thus tends to exit the aerosol device in a stream rather than a spray.

Accordingly, dispersion means are preferably employed to disperse the texture material as it exits the aerosol device such that the texture material exits in a fan-shaped or conical spray. Dispersion means such as are depicted in FIGS. 18-31 and as described below may be used with any of the dispensing assemblies or aerosol devices described herein to prevent the acoustic texture material from being deposited in the form of a narrow stream.

Figure 18:
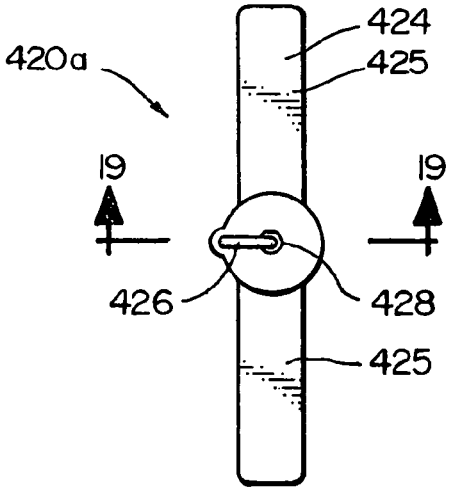
FIG. 18 is a top plan view of an actuator assembly that may be used with the present invention.
Figure 19:
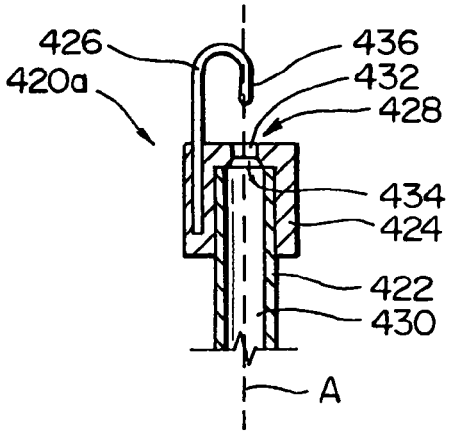
FIG. 19 is a longitudinal section view taken along lines 19-19 of FIG. 18.

Referring to FIGS. 18 and 19, depicted therein at 420*a* is an exemplary dispersion assembly constructed in accordance with, and embodying, the principles of the present invention. Referring initially to FIG. 19, depicted at 422 is a hollow tube corresponding either to a second end of a discharge tube such as the discharge tube 322 shown and described in relation to FIGS. 13 and 14, or a stem portion of a valve assembly such as the valve assembly 352 and 378 described and shown in FIGS. 16 and 17. This hollow tube 422 defines a discharge axis A shown by broken lines in FIG. 19.

The dispersion assembly 420*a* is mounted on this tube 422. The dispersion assembly 420*a* comprises a mounting member 424 and a deflecting member 426. A discharge opening 428 is formed in the mounting member 424.

The mounting member 424 is attached to the tube 422 such that the discharge opening 428 is aligned with a discharge passageway 430 defined by the tube 422. The discharge opening 428 comprises a cylindrical upper portion 432 and a frustoconical lower portion 434. The lower portion 434 reduces the diameter of the discharge passageway 430 from the inner diameter of the tubular member 422 to the diameter of the opening upper portion 432. The discharge opening 428 thus forms a nozzle that accelerates the hardenable material flowing along the discharge passageway.

The deflection member 426 is generally hook-shaped and connected to the attachment member such that a portion 436 thereof coincides with the discharge axis A.

Accordingly, as the hardenable material passes through the discharge opening 428, it contacts the deflection member 426 such that at least a portion of the hardenable material has a vector component that radially extends outward from the discharge axis A.

The dispersion assembly 420*a* thus causes the hardenable material to form a spray rather than a stream. This makes it easier for the user to apply hardenable material to a surface in an even pattern.

Handles 425 are formed on the attachment member 424 to allow the user to displace the tubular member 422 downwardly along the discharge access A.

Figure 20:
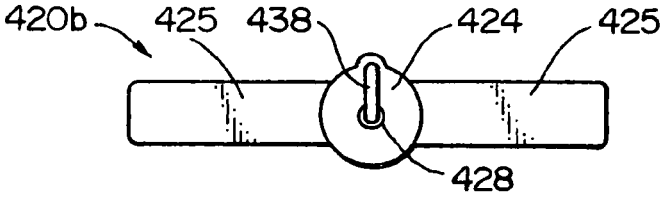
FIG. 20 is a top plan view of another actuator assembly that may be used with the present invention.
Figure 21:
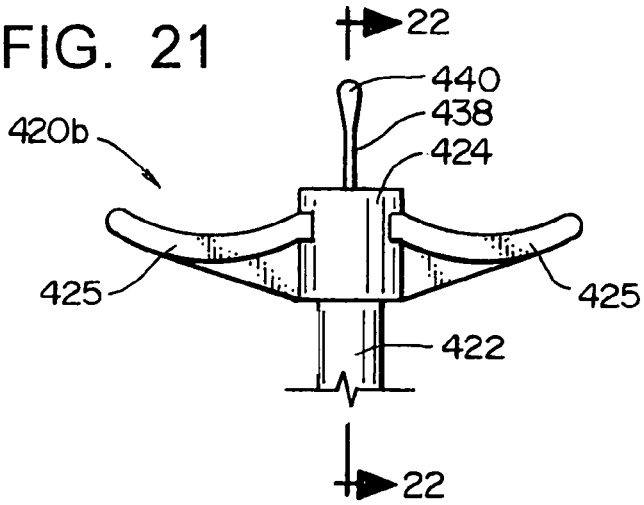
FIG. 21 is a front elevational view of the actuator assembly of FIG. 20.
Figure 22:
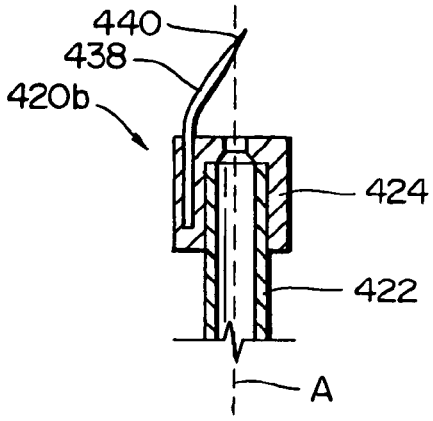
FIG. 22 is a longitudinal section view taken along lines 22-22 in FIG. 21.

Referring now to FIGS. 20-22, depicted at 420*b* therein is yet another exemplary dispersion assembly constructed in accordance with, and embodying, the principles of the present invention. The dispersion assembly 420*b* is constructed and operates in the same basic manner as the dispersion assembly 420*a* described above; accordingly, the dispersion assembly 420*b* will be described herein only to the extent that it differs from the dispersion assembly 420*a*.

The dispersion assembly 420*b* comprises a deflection member 438 extending from the attachment member 424 above the discharge opening 428. The deflecting member 438 has a deflecting surface 440 formed thereon. The deflecting surface 440 is arranged such that it intersects the discharge axis A. Accordingly, as hardenable material flows along this axis A, the material will contact this deflecting surface 440. After it has been so deflected, at least a portion of the hardenable material will have a vector component in a direction radially extending from the discharge axis A. As with the dispersion assembly 420*a* described above, the dispersion assembly 420*b* will thus generate a spray of hardenable material that facilitates the application of this material on the surface to be textures.

Figure 23:
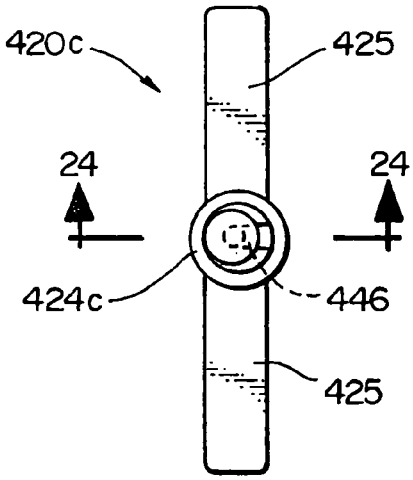
FIG. 23 is a top plan view of yet another actuator assembly that may be used with the present invention.
Figure 24:
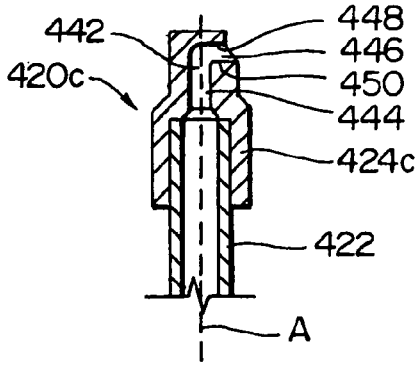
FIG. 24 is a longitudinal section view taken along lines 24-24 of FIG. 23.

FIGS. 23 and 24 depict an exemplary dispersion unit 420*c* that is constructed in accordance with, and embodies, the principles of the present invention. This dispersion unit 420*c* operates in the same basic manner as the dispersion assembly 420*a* and will be described herein only to the extent that it differs therefrom.

The dispersion unit 420*c* comprises a dispersion member 424. The dispersion member 424 has formed therein a nozzle passageway 442 comprising a vertical portion 444 aligned with the discharge access A and a radial portion 446 arranged at an angle to the discharge access A. A dispersion surface 448 is arranged at the end of the vertical portion 444 and forms a part of the radial portion 446. As the hardenable material flows along the discharge access A, it will be redirected such that it has a vector component radially extending from the discharge access A.

The radial passageway 446 is further defined by a lower surface 450. As shown in FIG. 24, the deflecting surface 448 terminates approximately midway along the bottom surface 450.

Figure 25:
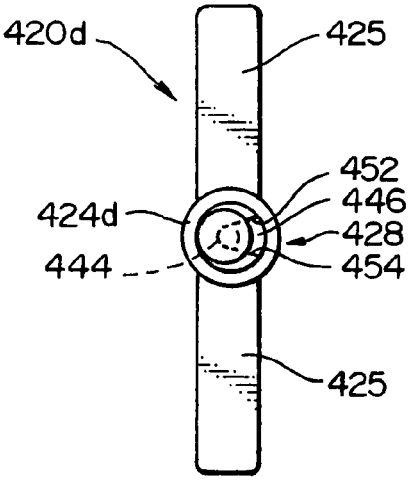
FIG. 25 is a top plan view of still another actuator assembly that may be used with the present invention.

In FIG. 25, there is depicted yet another exemplary dispersion member 420*d* constructed in the same basic manner as the dispersion member 420*c* described above. In the dispersion member 420*d*, the radial passageway 446 is defined by divergent sidewalls 452 and 454. These diverging sidewalls 452 and 454 allow the hardenable material to fan out as it exits the discharge opening 428.

Figure 26:
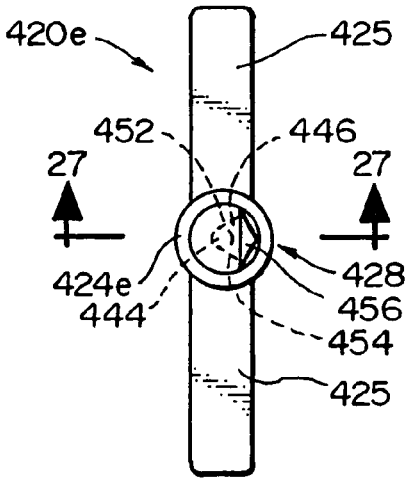
FIG. 26 is a top plan view of another actuator assembly that may be used with the present invention.
Figure 27:
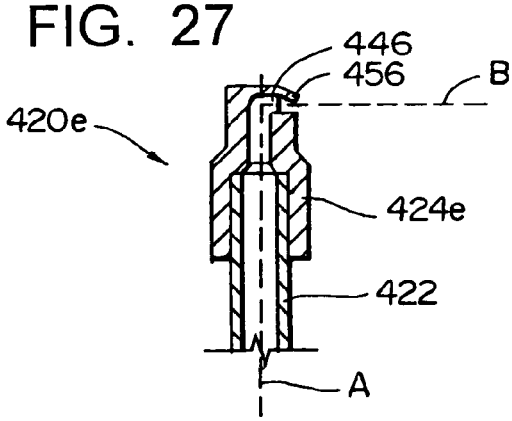
FIG. 27 is a longitudinal section view taken along lines 27-27 in FIG. 26.

In FIGS. 26 and 27, there is depicted yet another exemplary dispersion member 420*e* constructed in the same basic manner as the dispersion member 420*d* described above. The dispersion member 420*e* further comprises a deflecting member 456 arranged to partially cover the discharge opening 428. The deflecting member 456 is generally triangular in shape, with a point being formed substantially equidistant between the diverging sidewalls 452 and 454 defining the radial passageway 446. Configured as just described, the deflecting member 456 deflects at least a portion of the hardenable material coming out of the discharge opening 428 such that at least a portion of the hardenable material has a vector component that radially extends from an access B of the radial passageway 446. This results in a wider dispersal of hardenable material throughout the spray pattern formed by the dispersion member 424.

Figure 28:
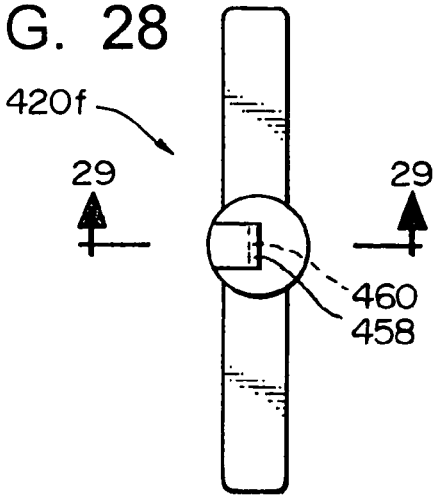
FIG. 28 is a top plan view of yet another actuator assembly that may be used with the present invention.
Figure 29:
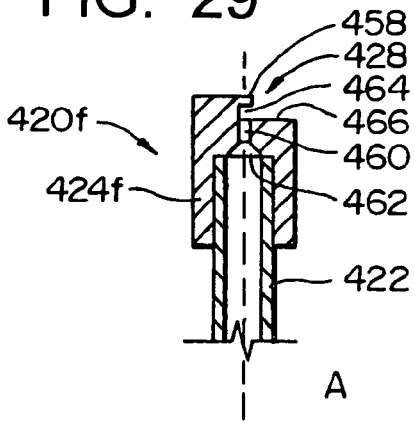
FIG. 29 is a longitudinal section view taken along lines 29-29 in FIG. 28.

Referring now to FIGS. 28 and 29, depicted at 420*f* therein is yet another exemplary dispersion member constructed in accordance with, and embodying, the principles of the present invention. The dispersion member 420*f* operates in a manner similar to the dispersion assembly 420*b* described above.

In particular, a dispersion member 458 is arranged adjacent to the upper portion 432 of the discharge opening 428. In the discharge member 420*f*, the exit opening 428 is rectangular in shape and the deflecting member 458 is arranged with a deflecting surface 464 formed thereon arranged to deflect all of the hardenable material exiting through the discharge opening 428. However, the deflecting surface 464 does not overhang an upper surface 466 of the dispersion member 424*f*; accordingly, the hardenable material is not channeled in a direction radial to the discharge access A and is allowed to develop into a spray that facilitates application of the hardenable material to the surface to be covered.

Figure 30:
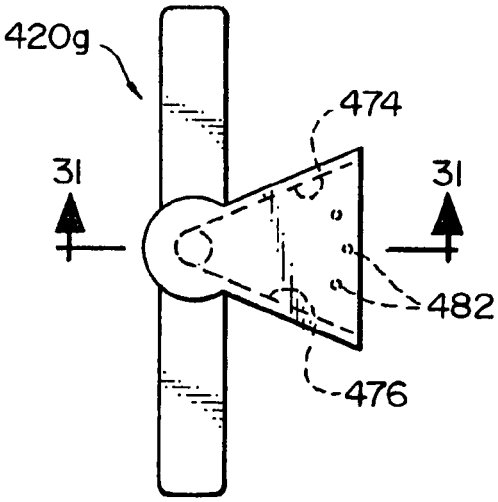
FIG. 30 is a top plan view of another actuator assembly that may be used with the present invention.
Figure 31:
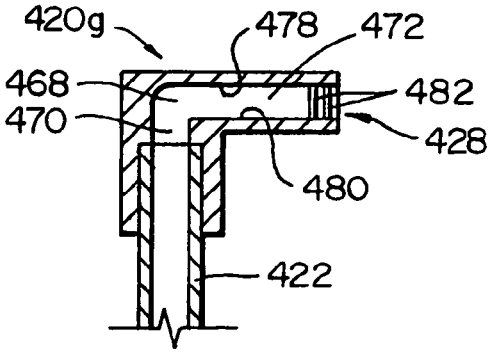
FIG. 31 is a longitudinal section view taken along lines 31-31 in FIG. 30.

Referring now to FIGS. 30 and 31, depicted therein at 420*g* is yet another exemplary dispersion member constructed in accordance with, and embodying, the principles of the present invention. This dispersion member 420*g* defines a passageway 468 comprising a short vertical portion 470 and a fan-shaped radial portion 472. The radial portion 472 has diverging sidewalls 474 and 476 and parallel upper and lower walls 478 and 480. Extending between the upper and lower walls 478 and 480 are a plurality of deflecting member 482 designed to deflect and slow down at least a portion of the hardenable material exiting through the discharge opening 428. The fan-shaped arrangement of the radial passageway 472 along with the deflecting member 482 results in a spray of hardenable material that facilitates the application of this material onto a surface.

XII. Ninth Embodiment

Figure 32A:
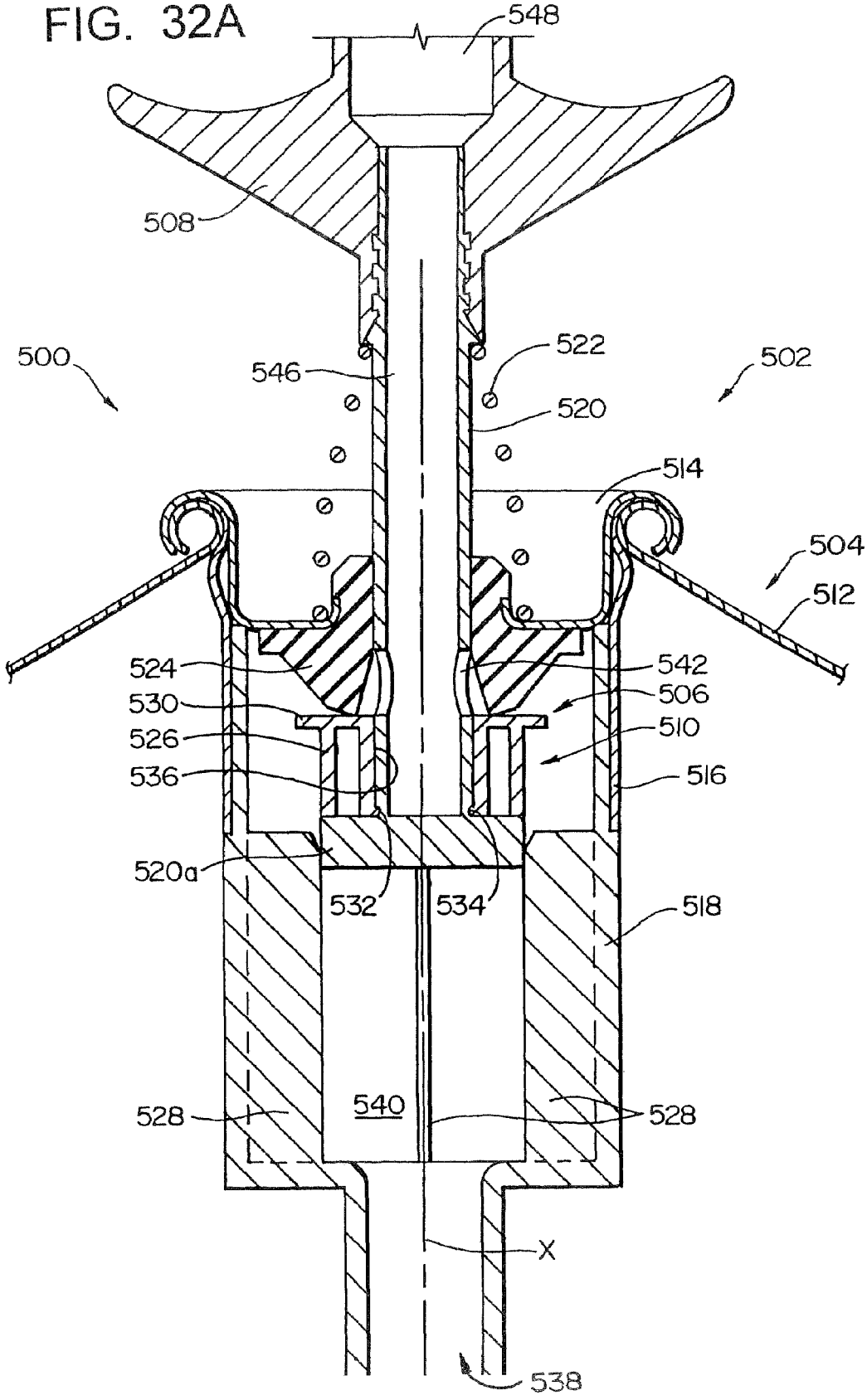
FIGS. 32A-D depict a ninth embodiment of a dispensing system of the present invention having a metering assembly to facilitate application of a predetermined quantity of acoustic texture material.

Referring now to FIG. 32*a*, depicted at 500 therein is a ninth embodiment of a dispensing system constructed in accordance with, and embodying, the principles of the present invention. In addition to a fluid portion as generally described above, the dispensing system 500 includes a mechanical portion 502 that allows the acoustic texture material of the fluid portion to be dispensed in predetermined metered amounts.

The mechanical portion 502 comprises a container assembly 504, a valve assembly 506, an actuator member 508, and a metering assembly 510.

A container assembly 504 comprises a container 512, a cap 514, and a mounting flange 516.

The valve assembly 506 comprises a valve housing 518, a valve stem 520, a valve spring 522, and a valve seal 524.

The metering assembly 510 comprises a metering member 526 and a plurality of guide flanges 528 extending from the valve housing 518.

The actuator member 508 is attached to the valve stem 520 by threads, adhesives, or the like. The actuator member is configured such that the user can depress downwardly on the actuator member 508 and cause the valve stem 520 to move downwardly along a longitudinal axis x of the mechanical portion 502.

The cap 514 and mounting flange 516 are attached to the container 512 in a conventional manner. The valve housing 518 is attached to the mounting flange 516 such that the valve housing 518 resides within the container 512. The valve housing 518 is connected to a pick-up tube such as the tube 46 described above, which creates a fluid path from the bottom of the container 512 to the valve housing 518 as will be described in further detail below.

The valve seal 524 is mounted to the cap 514, and the valve stem 520 is mounted to the valve seal 524 such that the valve stem 520 moves along the axis x as generally described above. The valve spring 522 is arranged to oppose motion of the valve stem 520 downward along the axis x.

The metering member 526 is an annular or ring shaped member that is arranged about a lower portion of the valve stem 520 between a stem portion 520*a* of the valve stem 520 and the valve seal 524. A release flange 530 extends from an upper portion of the metering member 526.

A release projection 532 is formed on a lower inner portion of the metering member 526. A similarly shaped release groove 534 is formed about the valve stem 520 adjacent to the stem portion 520*a*. The release projection 532 is designed to engage the release groove 534, but can be disengaged therefrom by deliberate application of manual force that tends to move the metering member 526 away from the stem portion 520*a*.

The metering member 526 further defines a metering surface 536 that has substantially the same cross-sectional area as an outer surface of the stem member 520.

Referring again to FIG. 32A, the mechanical portion 502 is shown in what will be referred to as a storage state. In the storage state, the metering member 526 engages the valve seal 524 to prevent fluid from exiting the container 512 through the valve assembly 506.

The propellant within the container 512 acts on the texture material there within to force the texture material through a housing inlet 538 in the valve housing 518 and into a housing chamber 540.

To dispense texture material from the mechanical portion 502, the actuator member 508 is displaced downwardly along the axis x such that the metering member 526 disengages from the valve seal 524. When this occurs, pressurized fluid within a housing chamber 540 defined within the valve housing 518 may flow through a stem inlet 542 in the valve stem 520, into a stem passageway 546 in the valve stem 520, and out of the mechanical portion 502 through an outlet chamber 548.

Figure 32B:
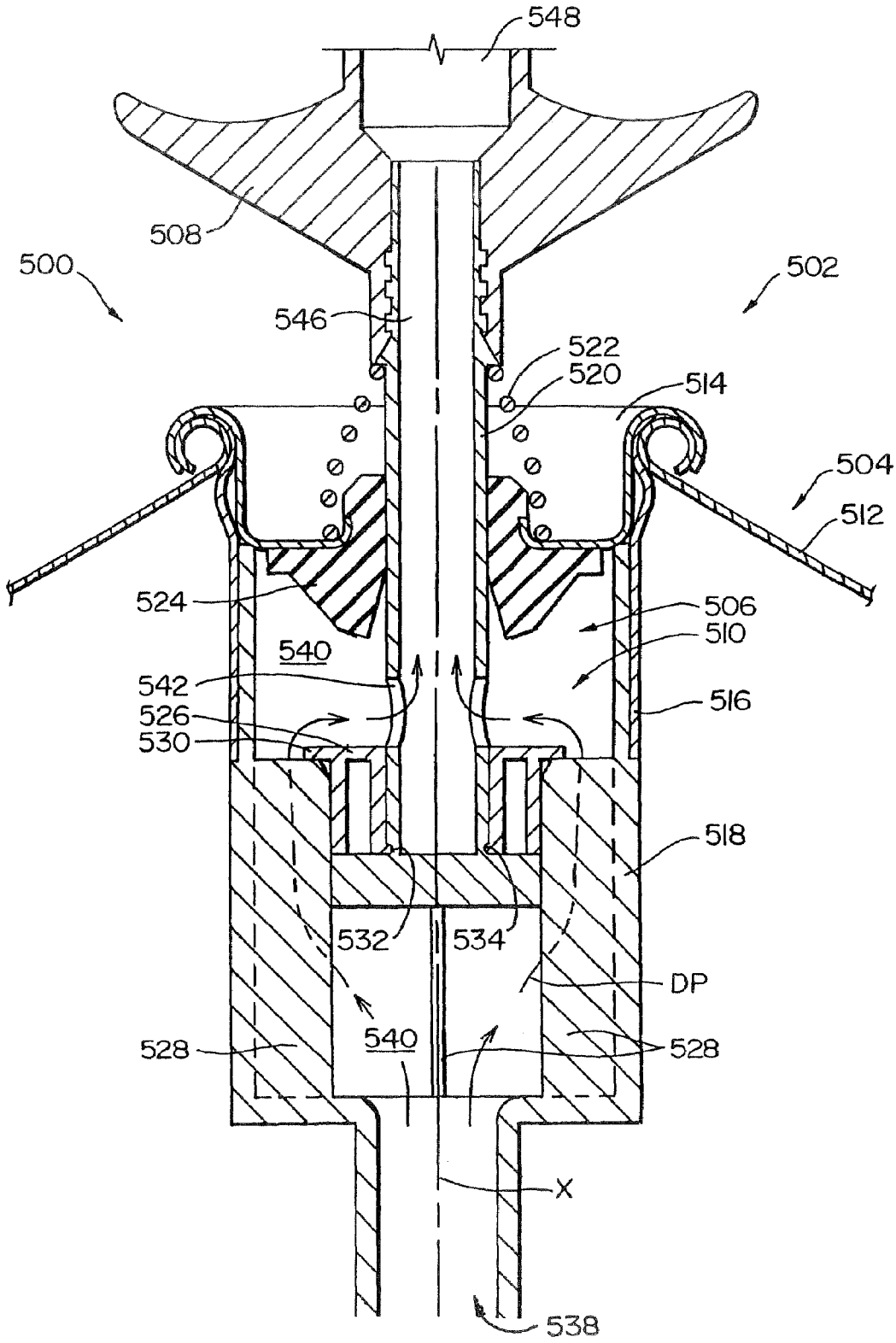

Because the release projection 532 is engaged with the release groove 534 to begin with, the metering member 526 moves downward with the valve stem 520 creating the dispensing path DP along which the texture material passes as it exits the container 512. At the point depicted in FIG. 32B, the release flange 530 engages an upper portion of the guide flanges 528 such that the metering member 526 can no longer move downward along the axis x.

Figure 32C:
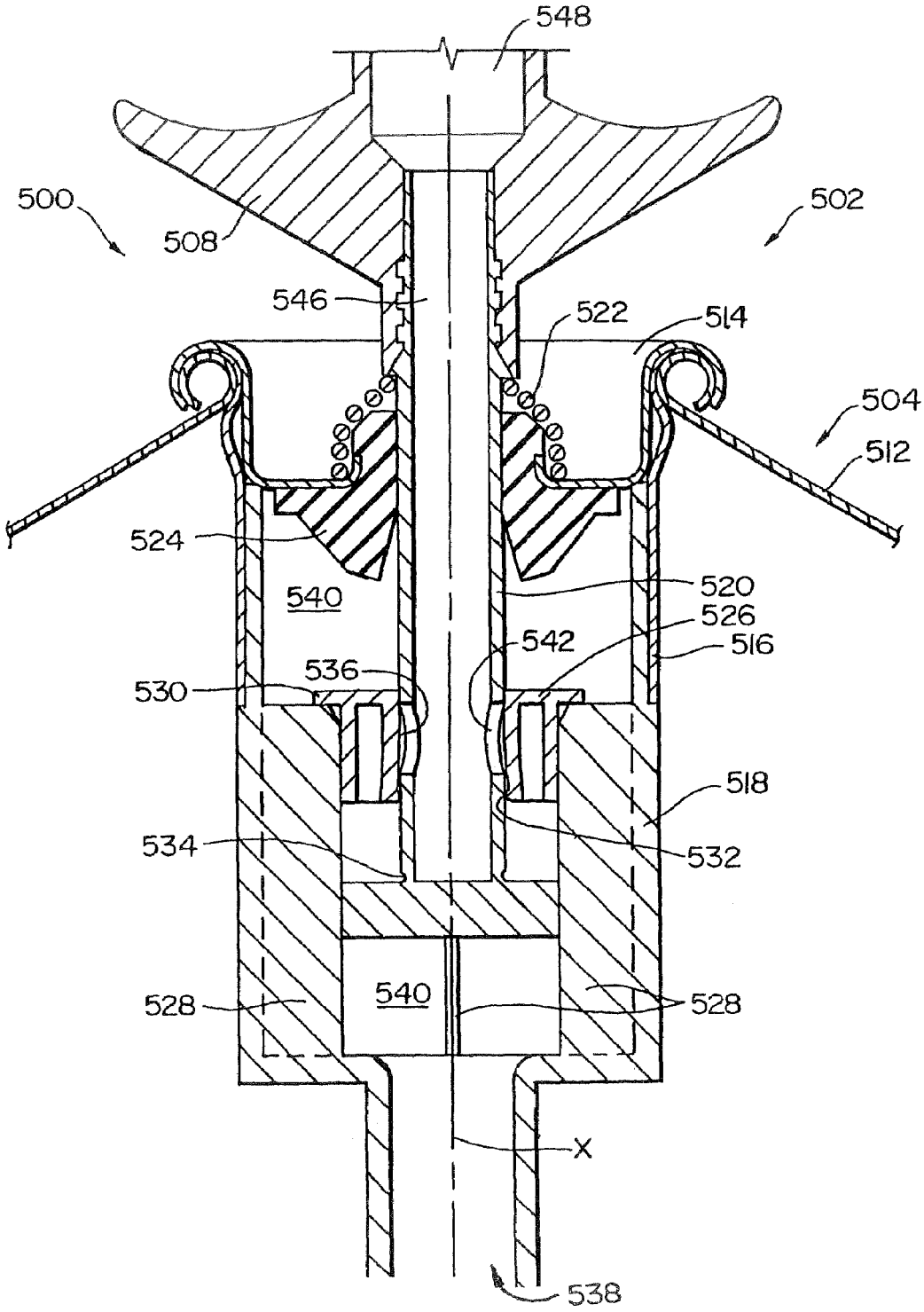

Referring now to FIG. 32C, continued displacement of the actuator member 508 such that the valve stem 520 moves further downward along the axis x results in the release projection 532 leaving the release groove 534 such that the metering member 526 no longer moves in tandem with the valve stem 520. The valve stem 520 thus moves relative to the metering member 526 to a point shown in FIG. 32C in which the stem inlet 542 is completely covered by the metering surface 536. At this point, texture material is prevented from flowing from the housing chamber 540 through the stem inlet 542. This effectively stops texture material from flowing out of the container 512.

Figure 32D:
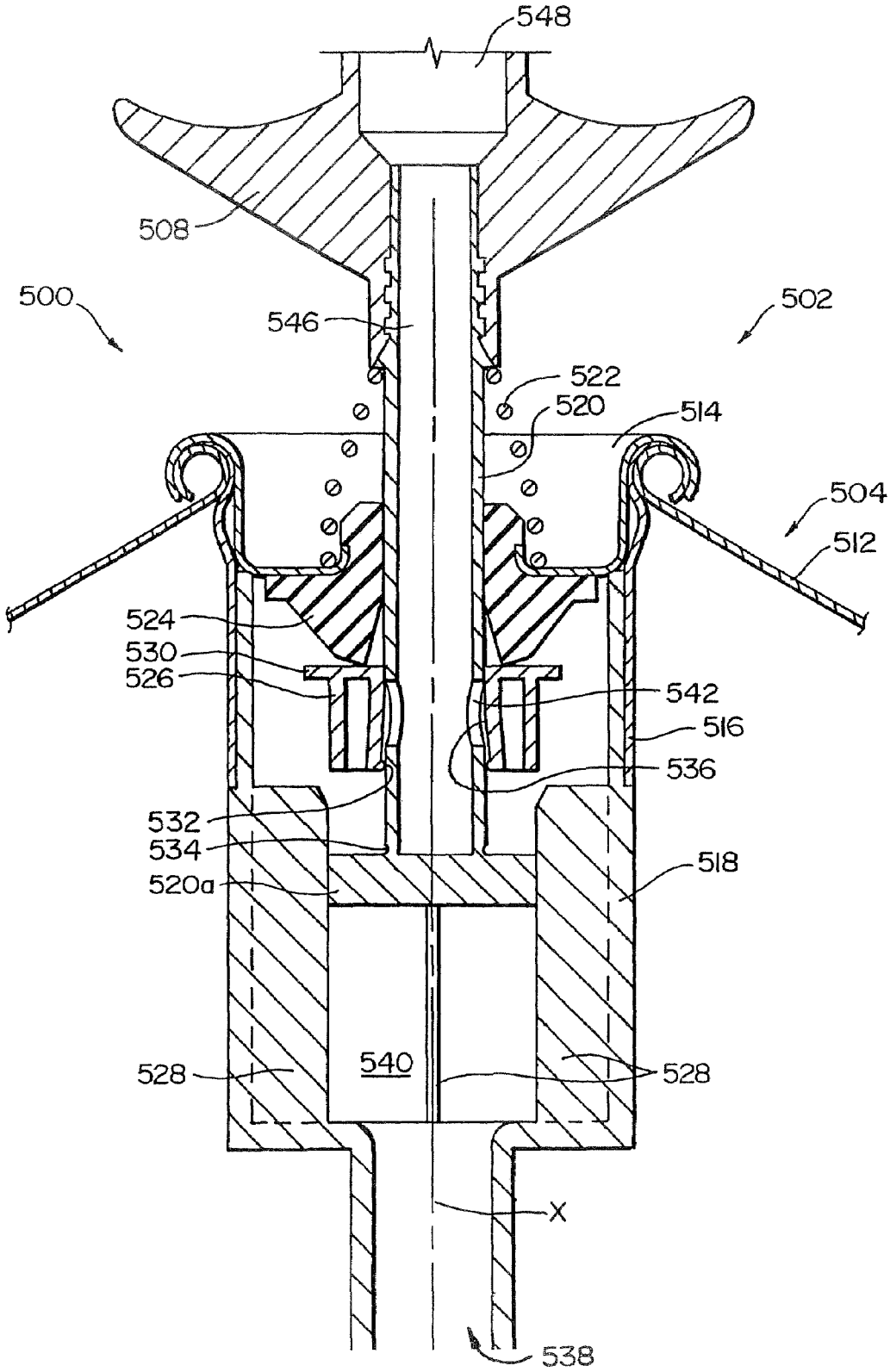

During the downward movement of the stem member 520, the valve spring 522 is compressed. Accordingly, releasing the actuator member 508 allows the valve spring 522 to urge the valve stem 520 upward. Friction between the valve stem 520 and the metering surface 536 causes the metering member 526 to move upward with the valve stem 520 until the metering member 526 again comes in contact with the valve seal 524. This configuration is shown in FIG. 32D.

At this point, the metering member 526 can no longer move upward with the valve stem 520. The valve spring 522 continues to move the valve stem 520 upward until the stem portion 520*a* thereof engages the metering member 526 as shown in FIG. 32A. At this point, the release projections 532 engage the release groove 534 such that, if the valve stem 520 again is moved downward, the metering member 526 will be carried therewith. Accordingly, the mechanical portion 502 is returned to its predispensing state shown in FIG. 32A and is ready to be used again.

The mechanical assembly 502 described above requires no special skill by the user for dispensing the texture material within the container 512. The user must simply press downwardly on the actuator member 508 until the valve stem 520 bottoms out as shown in FIG. 32C, then releases the actuator member 508. If these minimal directions are followed, the mechanical portion 502 will dispense a quantity of texture material that is a function of the pressure and volume of the inert gas used as a propellant, the speed at which the stem member 520 is moved downward, the size of the stem inlet 542, and the amount the stem member 520 is allowed to travel before its stem inlets 542 are covered by the metering surface 536. These parameters can be adjusted so that a reasonably consistent amount of texture material is dispensed by even an inexperienced user.

XIII. Tenth Embodiment

Referring now to FIGS. 33A-D, depicted therein at 550 is a tenth embodiment of a dispensing system constructed in accordance with, and embodying, the principles of the present invention. This dispensing system 550 comprises a fluid portion as described above, and a mechanical portion 552. The mechanical portion 552 is designed to dispense a controlled, metered amount of texture material.

In particular, the mechanical portion 552 comprises a container assembly 554, a valve assembly 556, an outlet assembly 558, and a metering assembly 560. A container assembly 554 is adapted to contain the fluid portion as described above. The valve assembly 556 is mounted on the container assembly 554 and operates in a closed configuration in which fluid may not exit the container assembly 554 and an open configuration in which fluid is allowed to exit the container assembly 554. The outlet assembly 558 disperses the texture material exiting the container assembly 554 through the valve assembly 556. The metering assembly 560 engages the valve assembly 556 to control the opening and closing of the valve assembly such that only a limited amount of texture material is released when the valve assembly is used as intended.

The container assembly 554 comprises a container 562 and a cap 564 mounted on the container 562 along a longitudinal axis x thereof.

The valve assembly 556 comprises a valve housing 566, a valve stem 568, a valve spring 570, and a valve seal 572. The valve housing 566 is mounted to the container 562 and cap 564 such that the interior of the container 562 is divided into two separate chambers. As with the ninth embodiment discussed above, a pick-up tube is connected to the valve housing 566 to allow fluid at the bottom of the container assembly 554 to enter the valve housing 566.

The valve seal 572 is mounted on the cap 564, and the valve stem 568 extends through the valve seal 572. The valve seal prevents fluid from flowing out of the valve housing 566 between the valve stem 568 and the cap 564.

The valve spring 570 is mounted between the cap 564 and the valve stem 568 such that the spring 570 urges the valve stem upward. When no force is applied to the valve stem 568, the valve spring 570 urges the valve stem 568 upward such that the valve stem 568 engages the valve seal 572, in which case the valve assembly 556 is in its closed position.

The outlet assembly 558 comprises an actuator member 574, and outlet member 576, an outlet cap 578, and an actuator return spring 580. The outlet member 576 is rigidly attached to the valve stem 568 by threading and/or adhesives, such that movement of the outlet member 576 is transferred to the valve stem 568.

The outlet member extends through the actuator member 574 such that relative movement between the outlet member 576 and the actuator member 574 is possible.

The outlet cap 578 is attached to the outlet member 576 to form a dispersing means as texture material exits the mechanical portion 552.

The actuator return spring 580 is arranged between the cap 564 and the actuator member 574 to oppose downward movement of the actuator member 574.

The metering assembly 560 comprises a metering member 582 and a release member 584. The metering member 582 is attached to the outlet member 576. Accordingly, movement of the metering member 582 will be transmitted through the outlet member 576 to the stem member 568. It should be noted that, in the exemplary dispensing system 550 described herein, the valve stem 568, outlet member 576, outlet cap 578, and metering member 582 all form a rigid assembly and can be made as one piece. For manufacturing reasons, however, this assembly comprises four separate molded plastic parts in the exemplary dispensing system 550.

The release member 584 is fixed relative to the cap 564. In the exemplary assembly 550, the actuator return spring 580 physically engages the release member 584 at its lower end and thus holds the release member 584 against the cap 564. Again, this is convenient for manufacturing purposes, but the cap 564 and release member 584 could conceivably be formed by one integrally formed part.

Formed on the actuator member 574 is an actuator surface 586. Extending from the metering member 582 are metering projections 588. These projections 588 are canted outwardly from the longitudinal axis x, but are sized, dimensioned, and made of a material that allows these projections 588 to deflect inwardly towards the axis x.

Formed on the release member 584 is a release surface 590. The release surface 590 is spaced directly below the actuator surface 586.

Figure 33A:
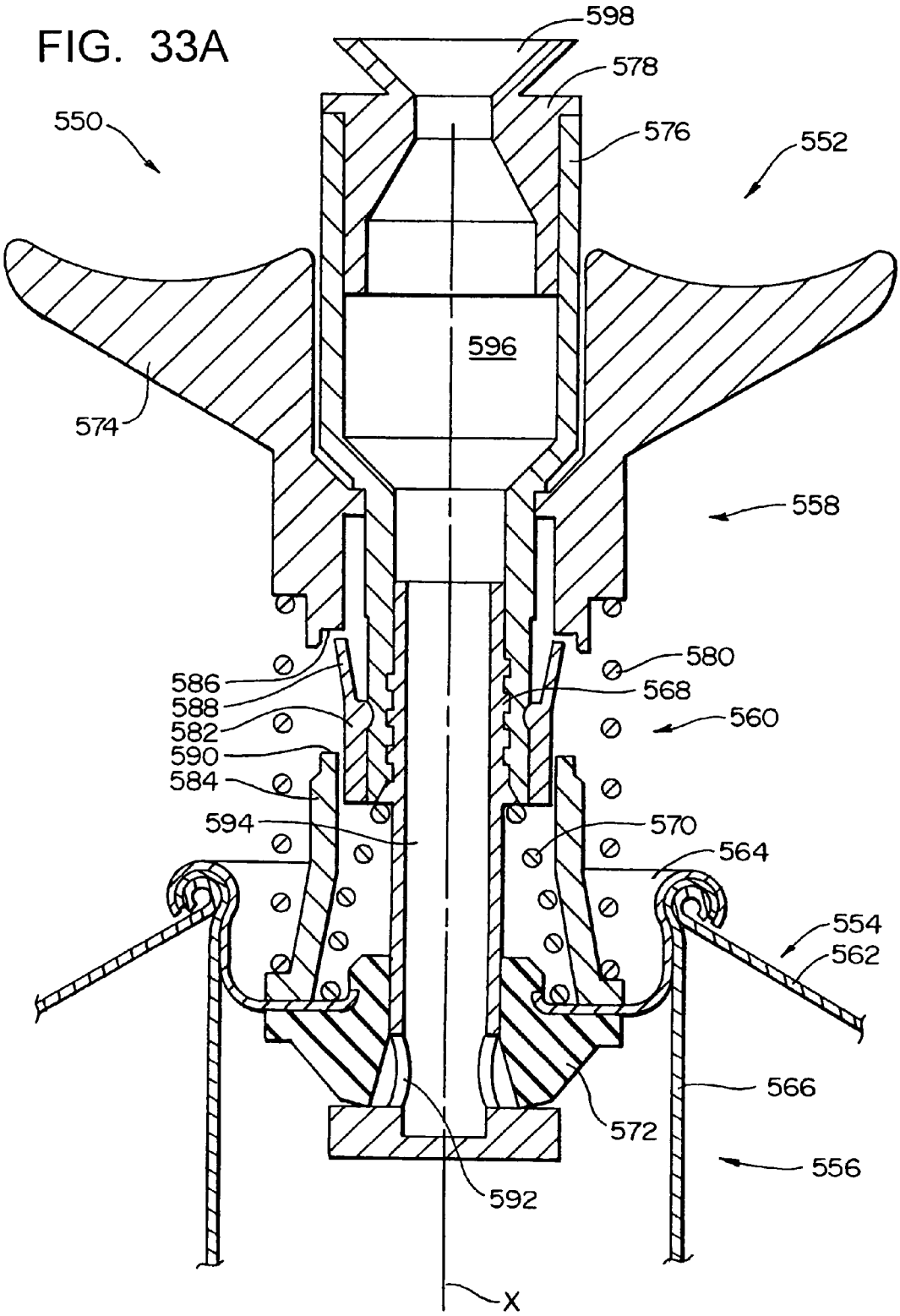
FIGS. 33A-D are section views depicting a tenth embodiment of a dispensing system of the present invention.

FIG. 33A shows the mechanical portion 552 in a predispensing state in which the valve assembly 556 is closed. Applying a downward force on the actuator member 574 causes the actuator surface 586 to engage the metering projections 588 and force the valve stem 568 downward as perhaps best shown in FIG. 33B. When the valve stem 568 moves downward, it disengages from the valve seal 572 and forms a dispensing path DP. This dispensing path DP allows pressurized texture material within the valve housing 566 to enter a stem inlet 592 formed in the valve stem 568, flow through a stem passageway formed in the valve stem 568, and enter an outlet chamber 596 defined by the outlet member 576 and outlet cap 578. The outlet chamber 596 is in communication with the exterior of the container 562 through an outlet opening 598 defined by the outlet cap 578. The outlet opening 598 is sized and dimensioned to disperse the texture material as it leaves the mechanical portion 552.

Figure 33B:
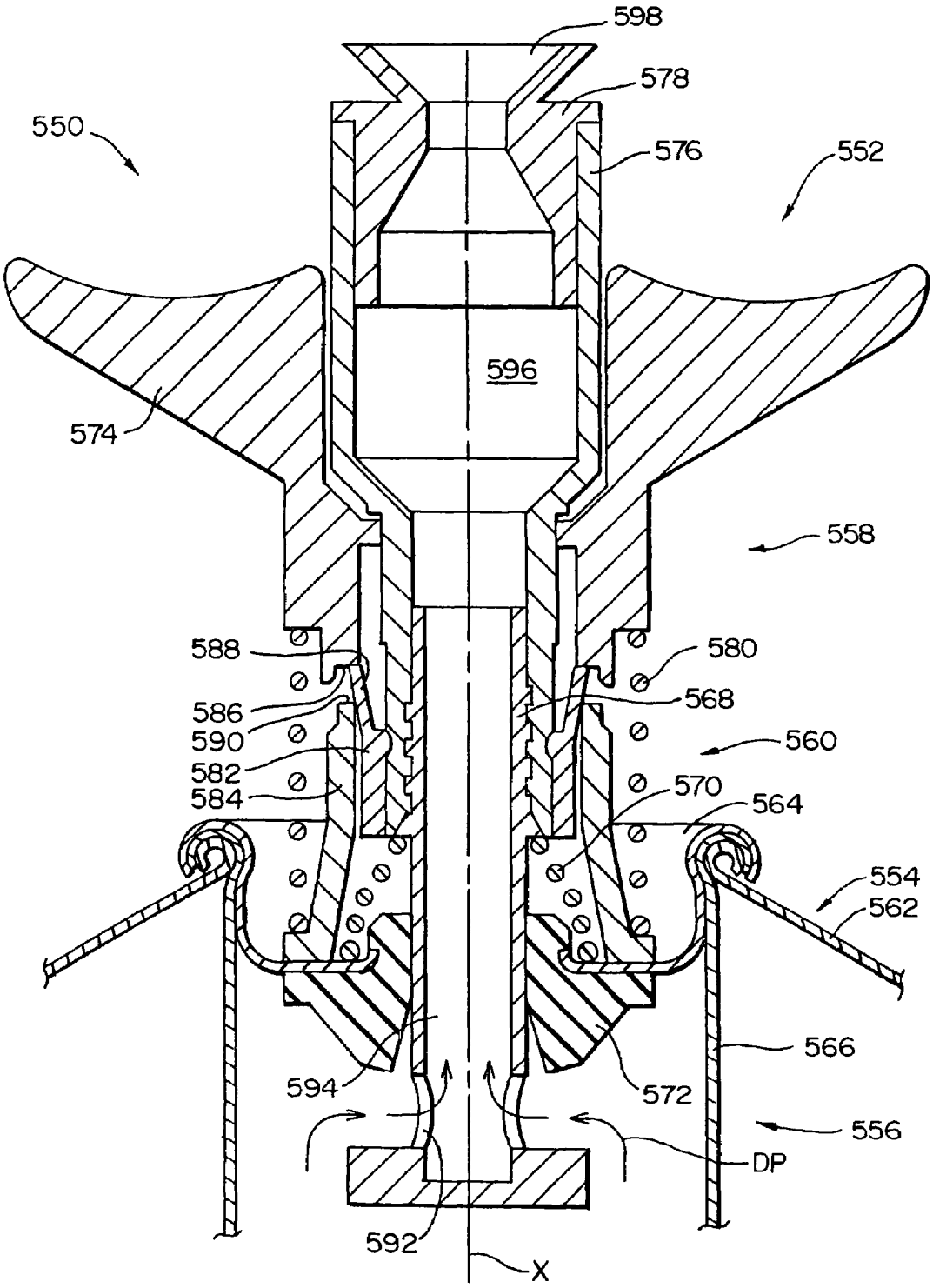

As shown in FIG. 33B, as the valve stem 568 moves downward, it carries the metering projections 588 with it such that these projections 588 come in contact with the release surface 590 on the release member 584.

Figure 33C:
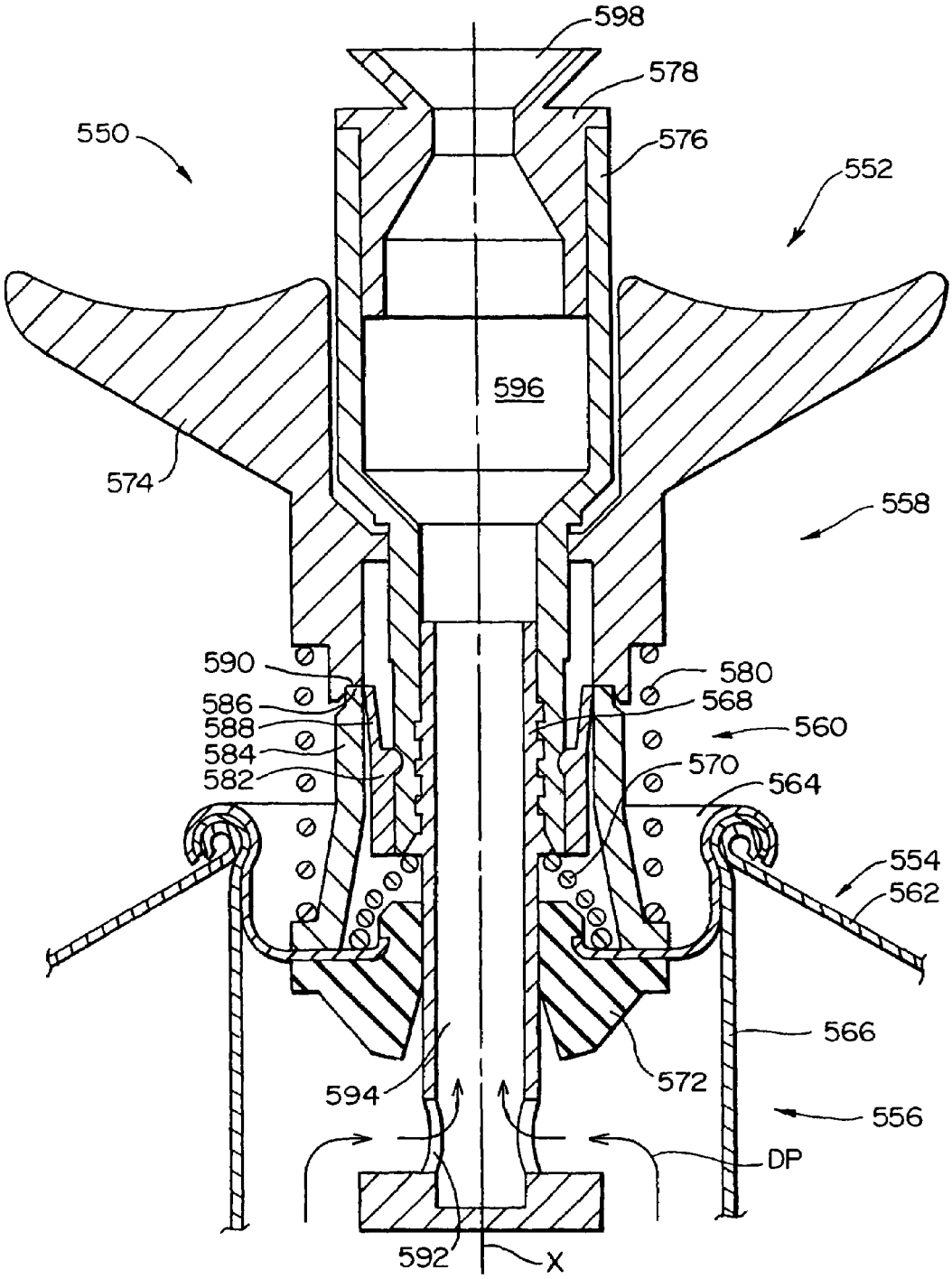

Referring now to FIG. 33C, it can be seen that continued downward movement of the valve stem 568 causes the release surface 590 to displace the metering fingers 588 towards the longitudinal axis x such that these fingers 588 are disengaged from the actuator surface 586. At this point, the actuator surface 586 comes into contact with the release surface 590.

Figure 33D:
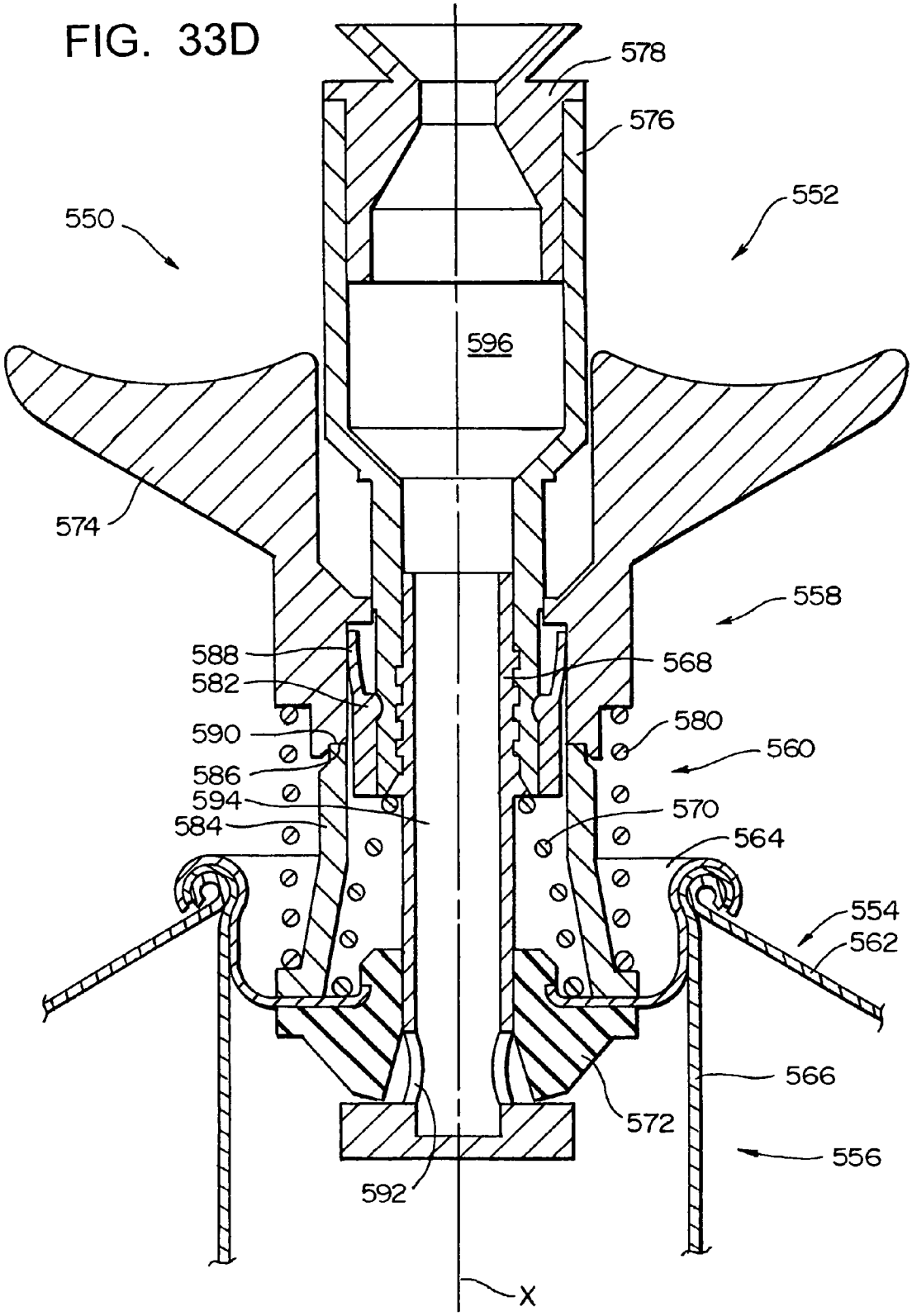

As the valve stem 568 moves downward, it compresses the valve spring 570. Accordingly, when the metering fingers 588 become disengaged with the actuator surface 586, the valve spring 570 urges the valve stem 568 upward. The metering projections 588 slide along the actuator member 574 as shown in FIG. 33D and allow the valve spring 570 to force the valve stem 568 back into its original, uppermost position in which it engages the valve seal 572 to prevent fluid from flowing out of the container 562.

During this process, the actuator member 574 has compressed the actuator member return spring 580. Accordingly, the user need only release the actuator member 574, and the actuator return spring 580 will force the actuator member 574 up relative to the valve stem 568 and metering member 582. The actuator member 574 thus returns to its initial position in which the actuator surface 586 is located above the metering projections 588. The metering projections 588 are thus allowed to return to their original position in which they are more severely canted outwardly relative to the longitudinal axis x. The mechanical portion 552 is thus ready to dispense another metered portion of texture material.

As with the ninth embodiment discussed above, the dispensing system 550 of the tenth embodiment allows the user to press firmly and continuously down to dispense a limited, controlled, and metered amount of texture material.

The amount of texture material released is determined by the same factors discussed above with reference to the ninth embodiment.

XIV. Eleventh Embodiment

Referring now to FIGS. 34-37, depicted therein at 600 is a eleventh embodiment of the dispensing system constructed in accordance with, and embodying, the principles of the present invention. The dispensing system 600 comprises a fluid portion as described above and a mechanical portion 602, a portion of which is depicted in the drawing.

The mechanical portion 602 comprises a container assembly 604, a valve assembly 606, an outlet assembly 608, and a metering assembly 610.

The valve assembly 606 is mounted on the container assembly and operable in open and close configurations. When the valve assembly 606 is in its closed configuration, fluid is prevented from leaving the container assembly 604. The outlet assembly 608 is mounted onto the valve assembly 606 such that, when the valve assembly 606 is in its open configuration fluid, and in particular acoustic texture material, is allowed to flow out of the container assembly 604 through the outlet assembly 608.

The metering assembly 610 controls the valve assembly 606 such that a predetermined, metered amount of texture material is dispensed.

The container assembly 604 comprises a container 612 and a cap 614. The valve assembly 606 comprises a valve housing 616, a valve stem 618, a valve spring 620, and a valve seal 622. The cap 614 is mounted on the container 612 and the valve seal 622 is mounted on the cap 614. The valve stem 618 extends through the valve seal 622. The valve seal 622 is made of a resilient material that engages the cap 614 and the valve stem 618 such that fluid is not able to flow out of the container 612 between the cap 614 and the valve stem 618.

The valve housing 616 is mounted to the container assembly 604 such that it is within the container 612 below the cap 614. As with the valve housings of the ninth and tenth embodiments described above, the valve housing 616 is connected to a pick-up tube that extends to the bottom of the container 612. As generally discussed above, the pressurized propellant material is located at the top of the container 612 and the texture material at the bottom of the container 612. Accordingly, the pressurized propellant material forces the texture material through the pick-up tube such that pressurized texture material is present in the valve housing 616.

Figure 34A:
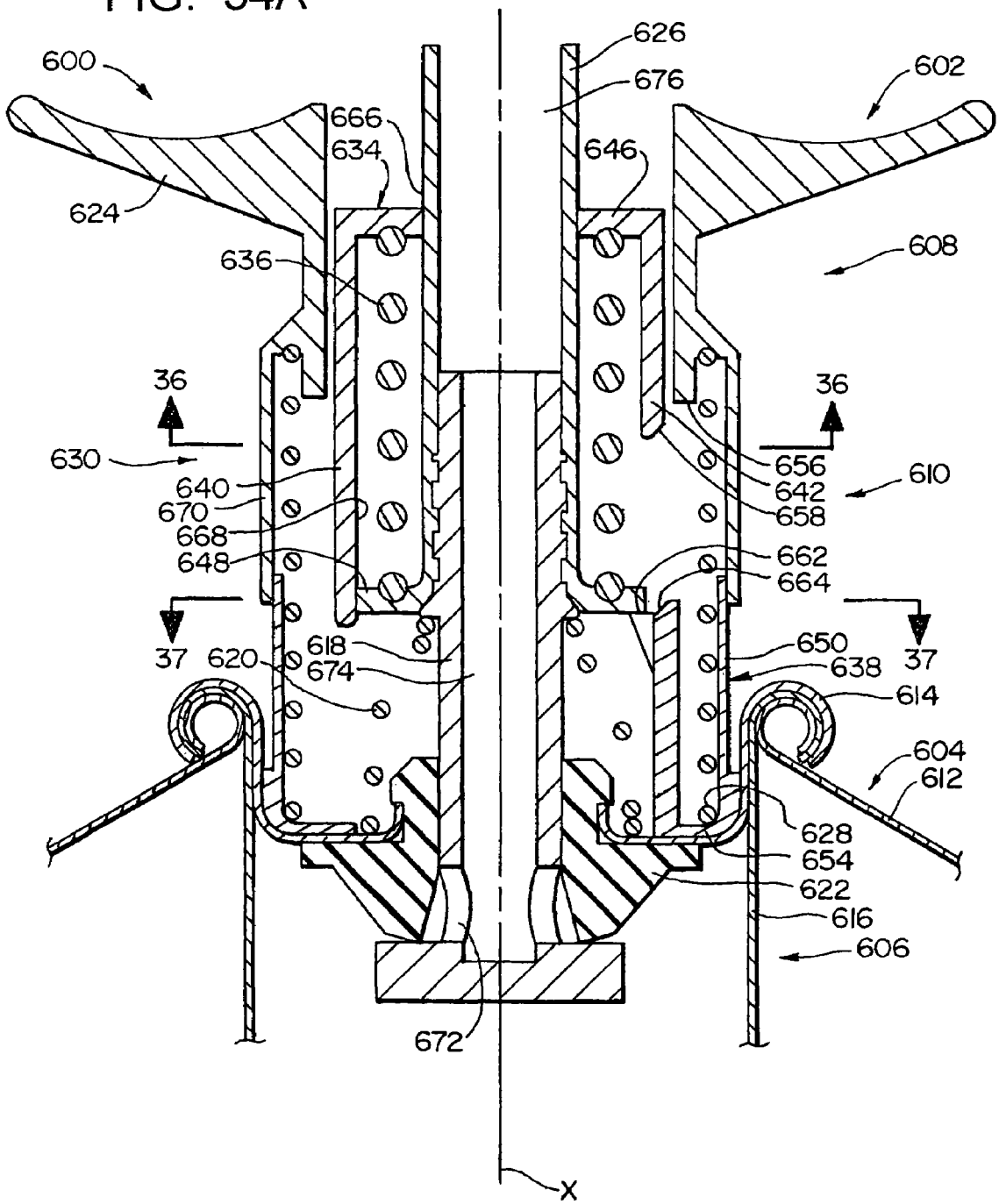
FIGS. 34A-G are section views of an eleventh embodiment of a dispensing system of the present invention.
Figure 34B:
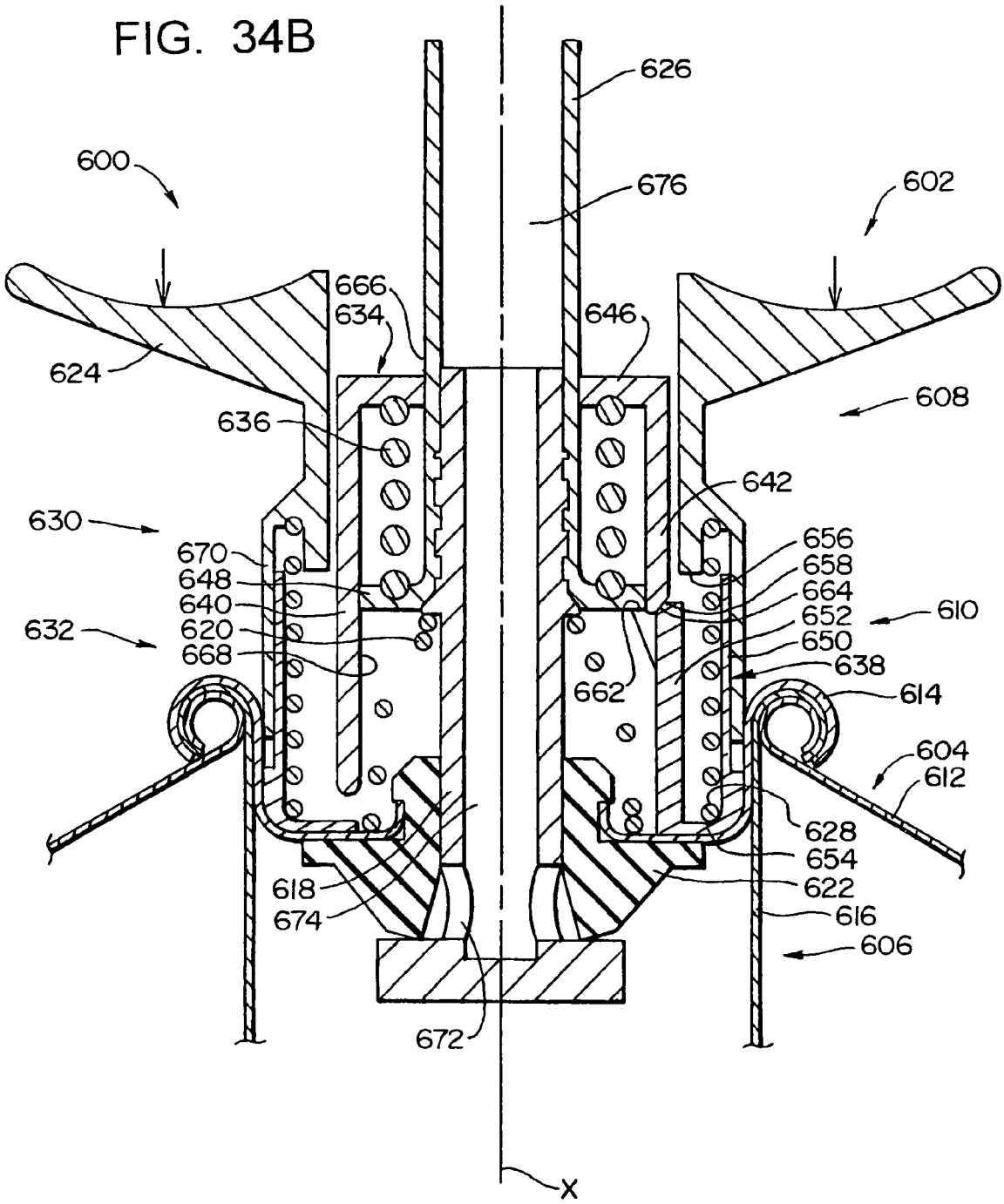

The valve spring 620 is arranged between the cap 614 and the valve stem 618 such that the valve spring 620 urges the valve stem 618 upward such that the valve assembly 606 is normally biased into its closed position. When the valve assembly 606 is in its closed position, the valve stem 618 engages the valve seal 622 as shown in FIG. 34A.

The outlet assembly 608 comprises an actuator member 624, and outlet member 626, and an actuator return spring 628. The outlet member 626 is rigidly attached to the valve stem 618 by threads, adhesive, or the like such that movement of the outlet member 626 causes movement of the valve stem 618. The actuator member 624 is free to move relative to the valve stem 618 and outlet member 626, with the outlet member 626 extending through the actuator member 624. The actuator return spring 628 is arranged to urge the actuator member 624 upward; when the actuator member 624 is moved downward, the actuator return spring 628 is compressed.

The metering assembly 610 comprises a trigger assembly 630 and a release assembly 632. The trigger assembly 630 comprises a trigger member 634 and a trigger spring 636. The release assembly 632 comprises a release member 638 configured as will be described below.

The trigger member 634 comprises a plurality of guide fingers 640, a plurality of trigger fingers 642, and a plurality of release fingers 644 that extend downwardly from a trigger plate 646. The guide finger 640 and trigger finger 642 are shown in FIG. 34 and in the horizontal section view of FIG. 36. The release fingers 644 are shown in FIG. 35 as well as in the horizontal section view of FIG. 36. The exemplary mechanical portion 602 comprises three each of these guide fingers 640, trigger finger 642, and release finger 644. More or fewer of these fingers 640-644 may be used, but the use of three each represents a desirable blend of balance during operation and manufacturability.

Figure 37:
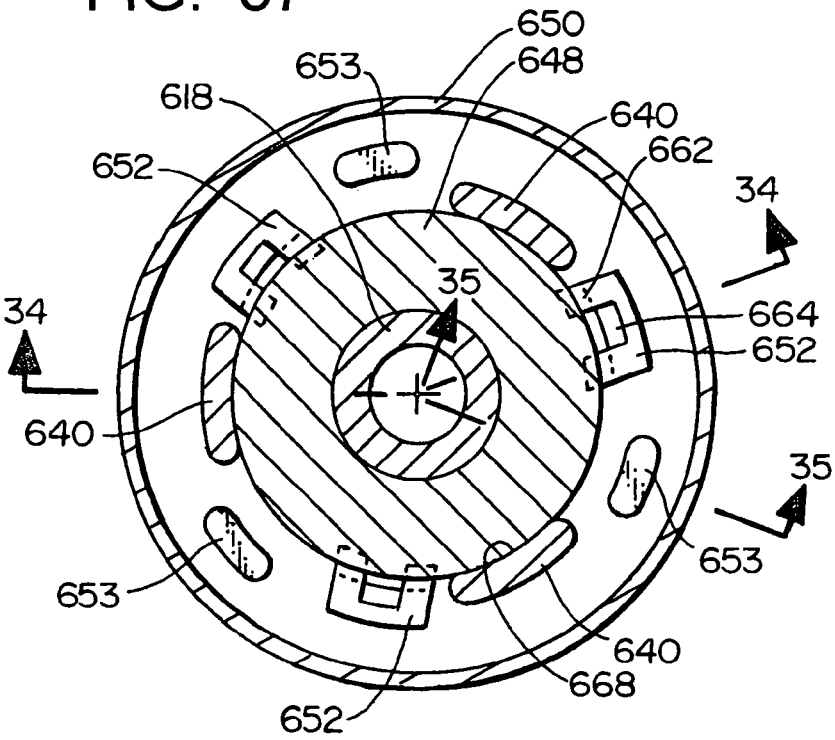
FIG. 37 is a section view taken along lines 37-37 in FIG. 34A.
Figure 38:
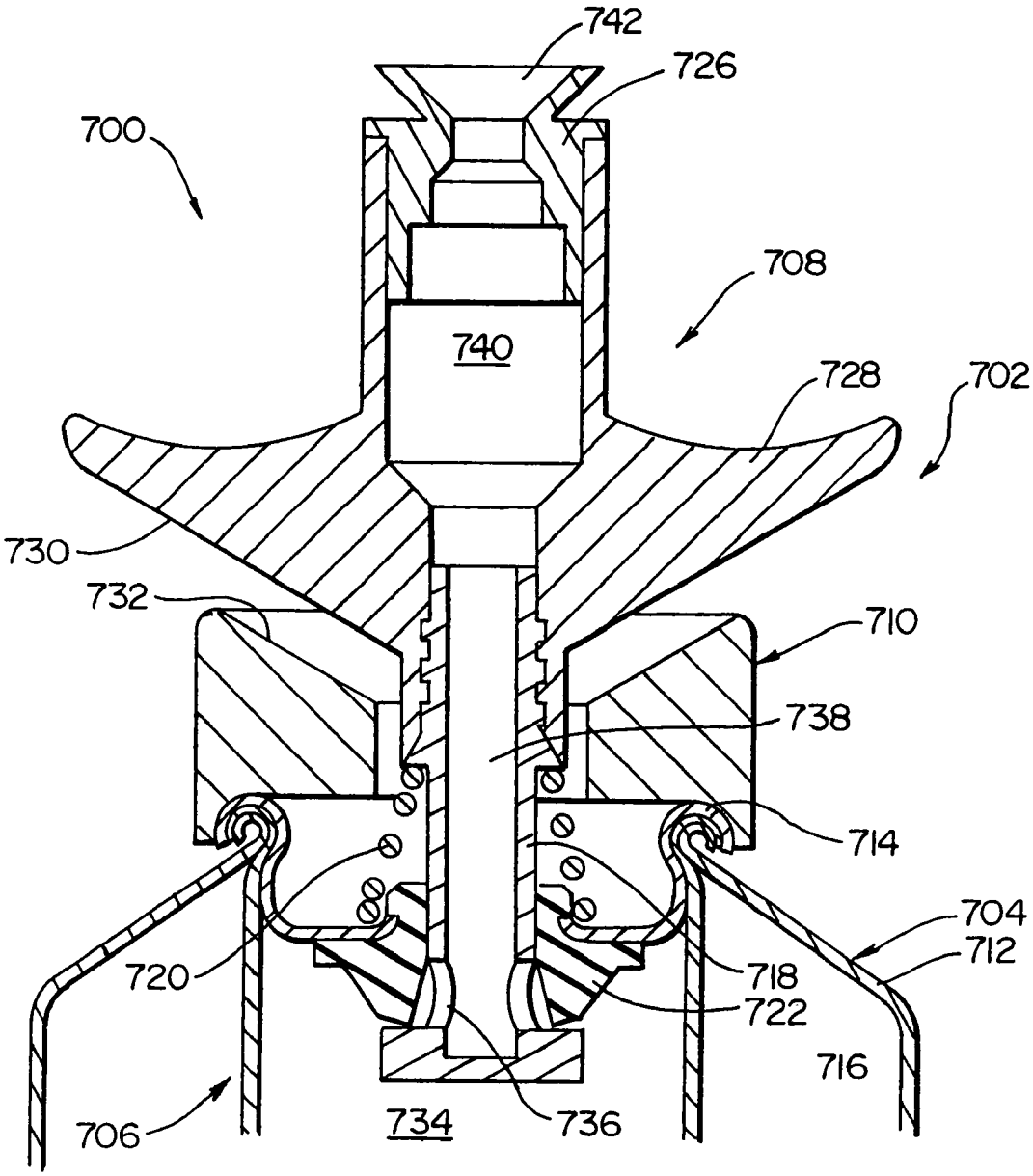
FIG. 38 is a section view of a twelfth embodiment of the present invention.

As shown in FIGS. 34, 35, and 37, an intermediate flange 648 is formed on the outlet member 626.

The release member 638 comprises a guide cylinder 650, a plurality of support posts 652, and a plurality of release posts 653 that extend upwardly from a base plate 654. The base plate 654 is configured to snugly be received within the cap 614. The guide cylinder 650 extends upwardly a distance slightly greater than the height of the support posts 652 and release posts 653.

An actuator surface 656 is formed on the actuator member 624. As shown in FIG. 34, a trigger surface 658 is formed on each of the trigger fingers 642. FIG. 35 shows that a cam surface 660 is formed on each of the release fingers 644. And in FIG. 34, it can be seen that a support surface 662 and release surface 664 are formed on each of the support posts 652.

The actuator member 624 comprises first and second bearing surfaces 666 and 668 and an actuator cylinder 670.

The metering assembly 610 is assembled together with the container assembly 604, valve assembly 606, and outlet assembly 608 as follows. After the valve assembly 606 has been mounted onto the container assembly 604 and the outlet member 626 attached to the stem member 618 as described above, the release member 638 is displaced such that the base plate 654 thereof is snugly received by the cap 614 such that the guide cylinder 650 is aligned with the axis x. At this point, the intermediate flange 648 will rest on the support surfaces 662 on the support posts 652. The trigger spring 636 is then placed over the outlet member 626 such that spring 636 is supported at its lower end by the intermediate plate 648. The trigger member 634 is then placed over the outlet member 626 such that the trigger spring 636 is arranged between the trigger plate 646 and the intermediate plate 648. Importantly, the trigger fingers 642 must be aligned with the support posts 652 and the release finger 644 must be aligned with the release posts 653.

The first bearing surface 666 defines a hole in the trigger plate 646 through which the outlet member 626 passes. In addition, the first bearing surface 666 engages the guide member 626 and the second bearing surfaces 668 on the guide fingers 640 engage the intermediate flange 648 such that the trigger member 634 also can move only along the longitudinal axis x.

The actuator return spring 628 is then placed around the trigger member 634 until it rests on the base plate 654 of the release member 638. The outlet member 624 is then placed over the trigger member 634 such that the actuator cylinder 670 engages the guide cylinder 650 such that the actuator member 624 moves only along the system axis x. In this configuration, the actuator return spring 628 opposes downward motion of the actuator member 624 as generally discussed above.

The purpose of the metering assembly 610 is generally to allow the user to pull down on the actuator member 624 and initiate a sequence of events that open and close the valve assembly 606 substantially independent from the actions of the user. In particular, in the ninth and tenth embodiments it would be possible for the user to pull down on the actuator member halfway and place the valve assembly in a state in which texture material may freely flow out of the container assembly. In those ninth and tenth embodiments, the valve assembly will automatically be closed only if the user pulls the actuator member down past a predetermined point.

In this eleventh embodiment described in FIGS. 34-37, the trigger assembly 630 controls the opening of the valve assembly 606 while the release assembly 632 controls the closing of the valve assembly 606. The user merely energizes the metering assembly 610 by compressing various springs and then triggers the automatic sequence of events that opens and closes the valve assembly 606. The user is thus prevent from placing the valve assembly 606 in an intermediate configuration in which texture material is allowed to freely flow from inside the container assembly 604.

The sequence of events initiated by the user's pulling of the actuator member 624 will now be described with reference to FIGS. 34A-G and 35A-G.

Figure 34C:
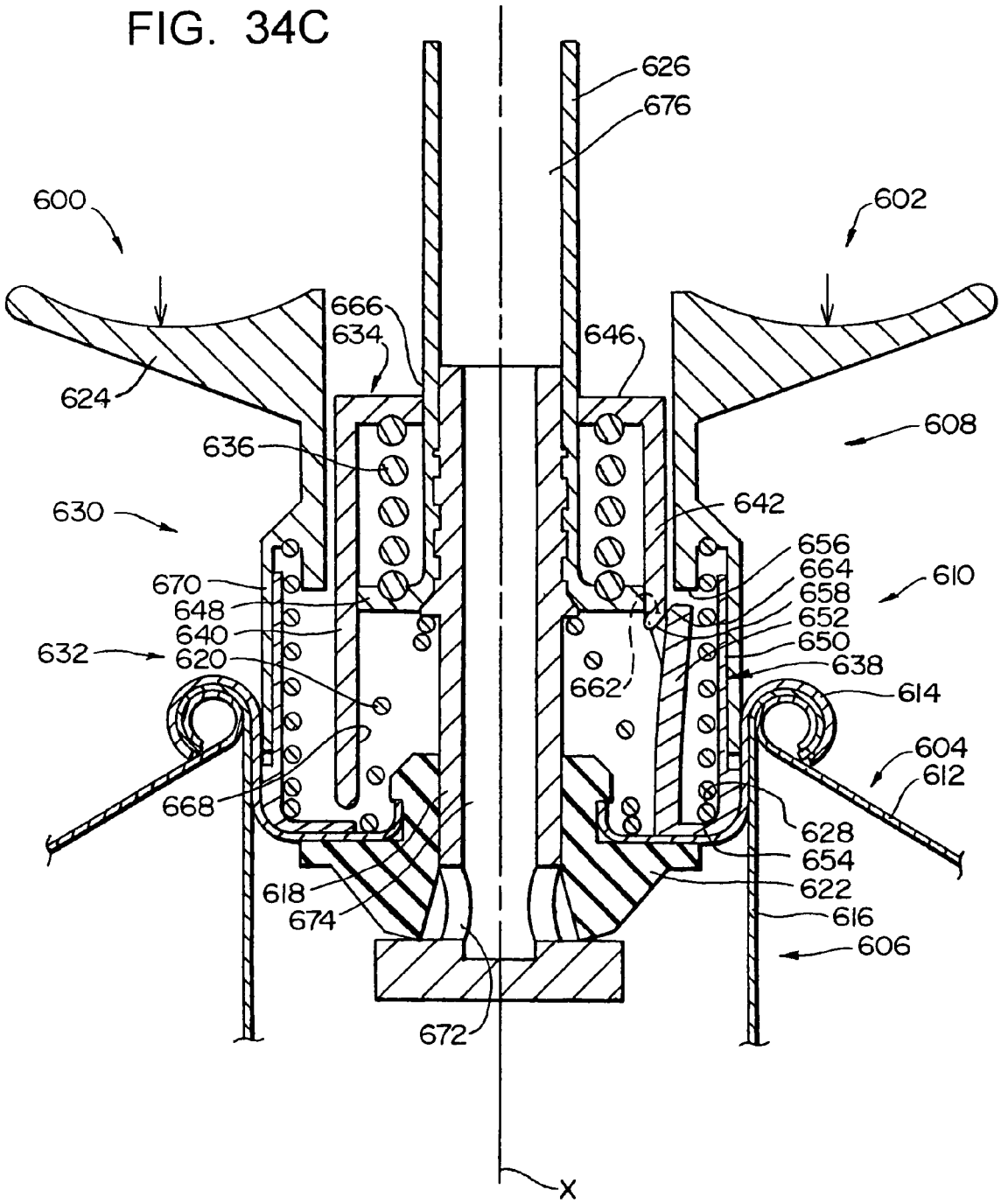
Figure 35A:
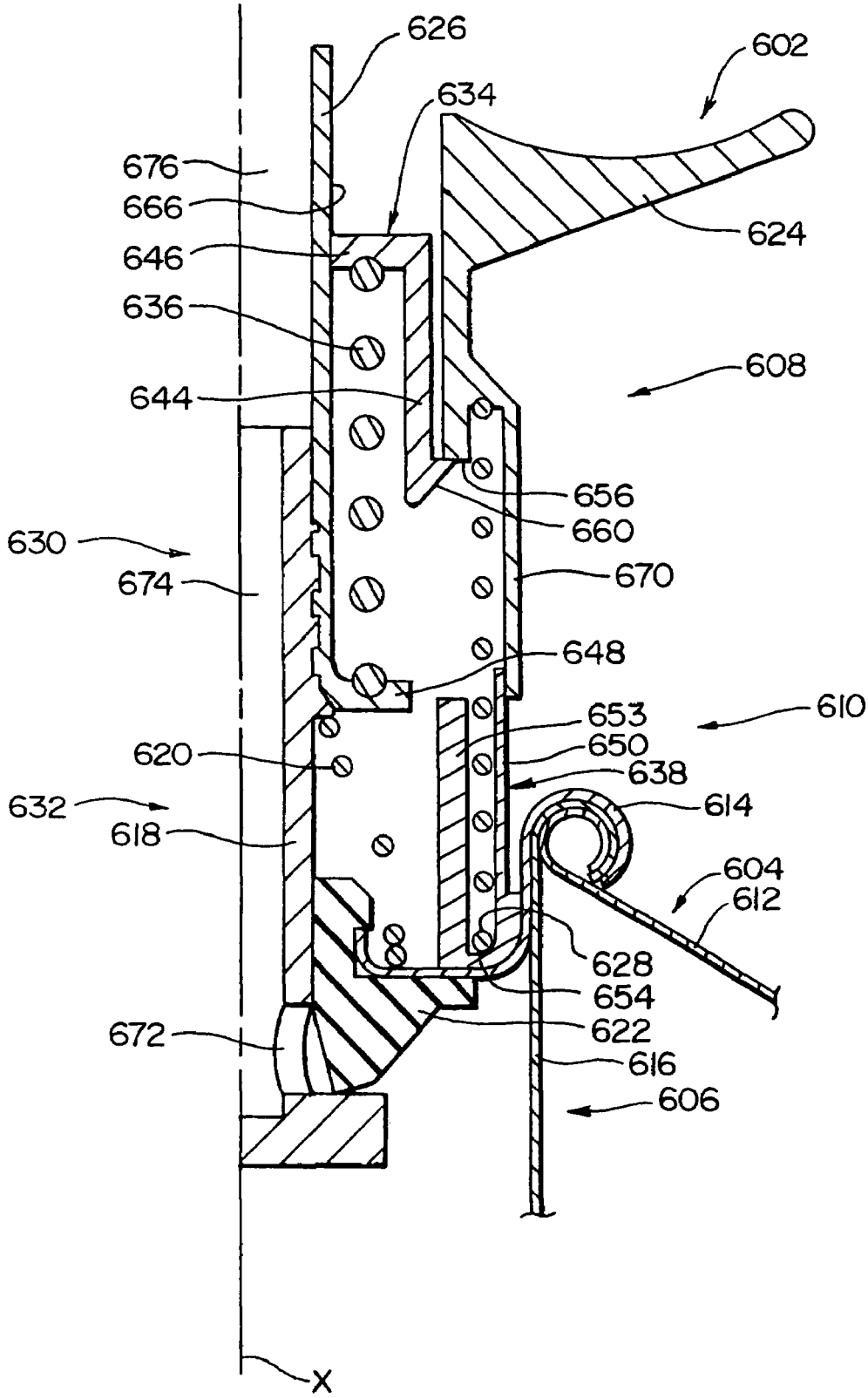
FIGS. 35A-G are section views taken along a different plane and corresponding to FIGS. 34A-G.
Figure 35B:
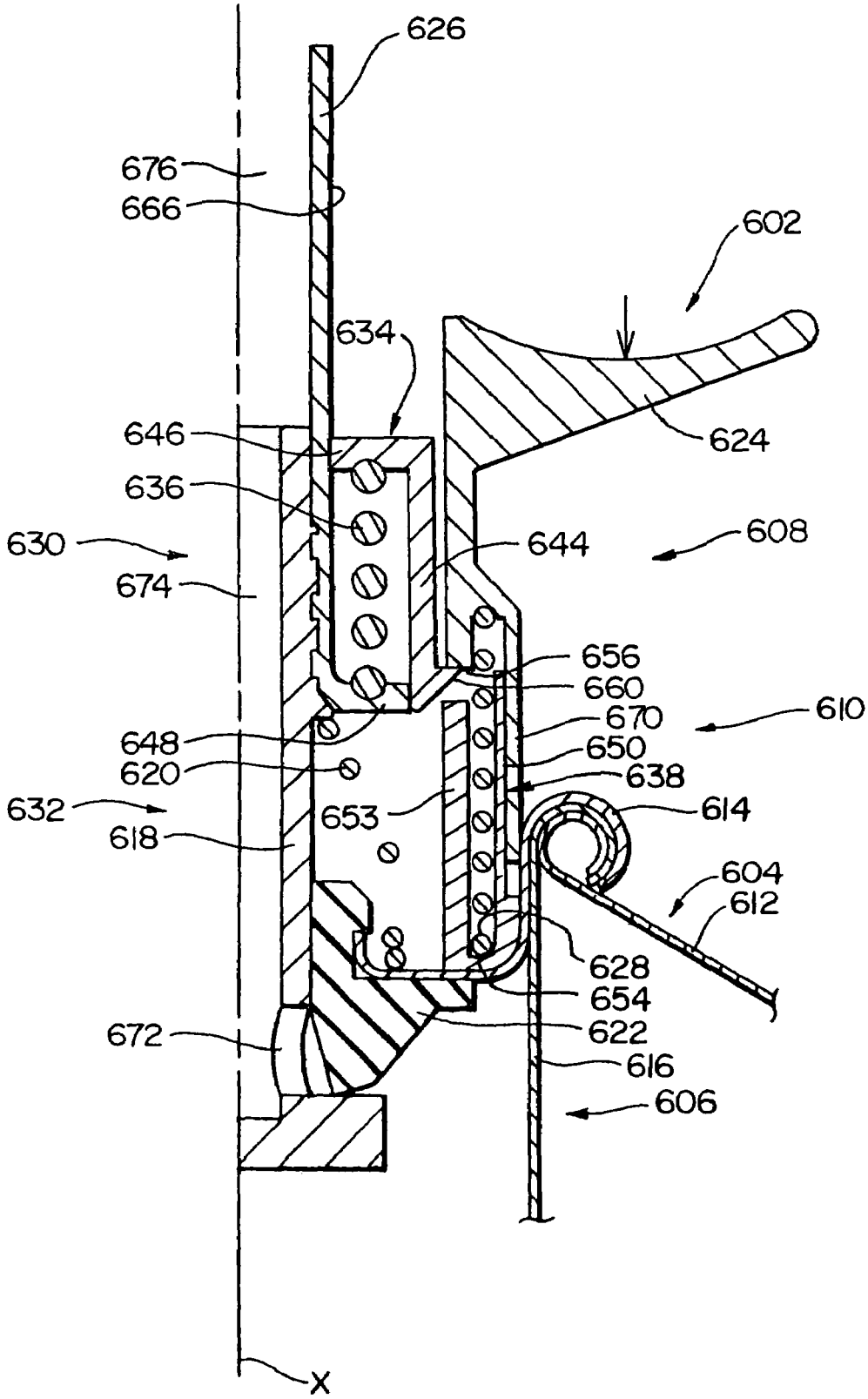
Figure 35C:
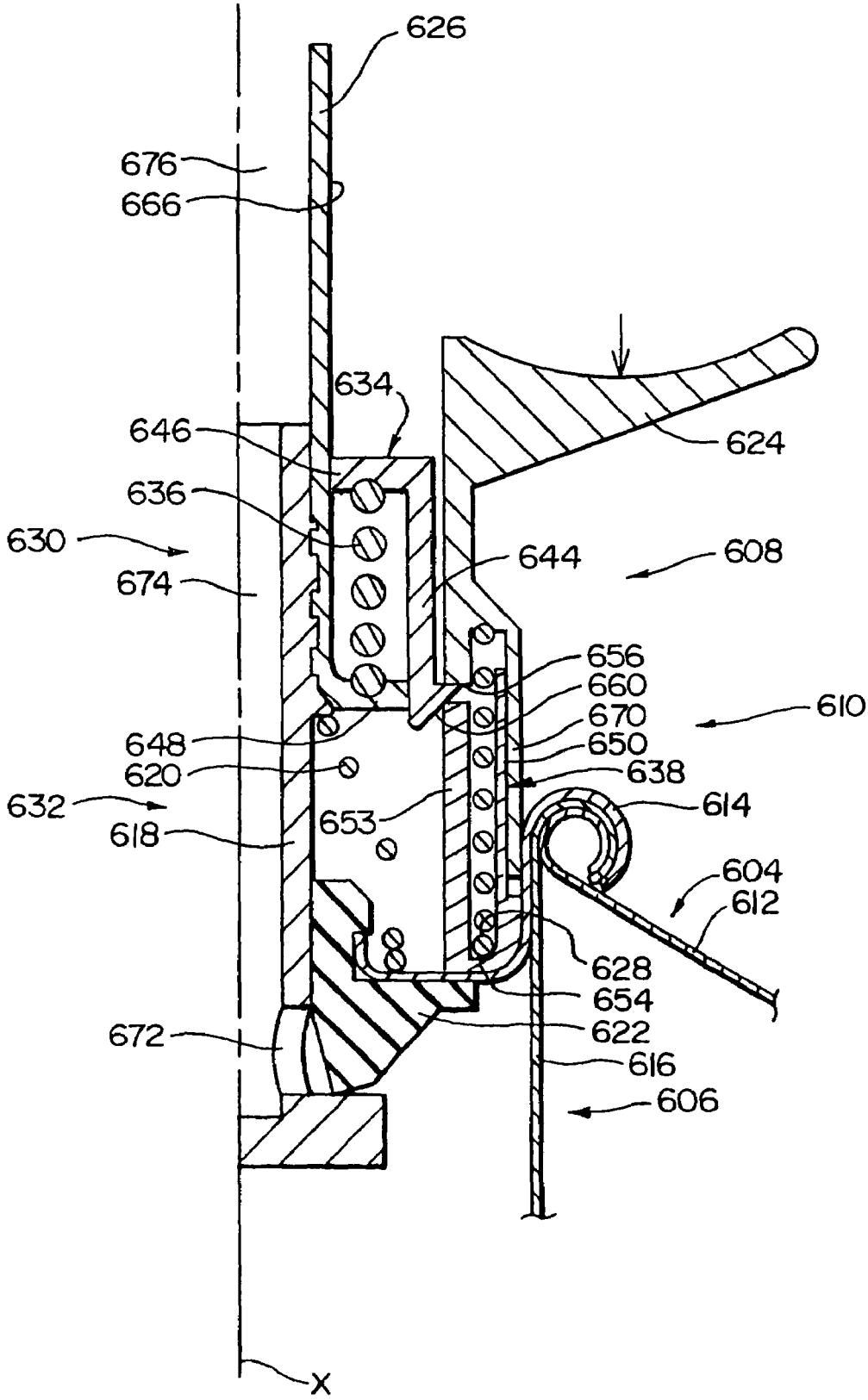

In FIGS. 34A and 35A, the mechanical portion 602 is shown in its predispensing state in which the actuator member 624 is in its uppermost position and the valve assembly 606 is closed. The user then applies a downward force on the actuator member 624 as shown by arrows in FIGS. 34B and 35B. As shown best in FIG. 35B, the actuator surface 656 engages the trigger member 634 such that the trigger member 634 moves down with the actuator member 624. The mechanical portion 602 is in a pretriggering state in FIGS. 34B and 35B in which the actuator return spring 628 and trigger spring 636 are both compressed. At this point, the valve spring 620 is not compressed and the valve assembly 606 is still in its closed configuration. Then, as shown in FIGS. 34C and 35C, the trigger surfaces 658 on the trigger fingers 642 engage the release surfaces 664 on the support posts 652. The trigger fingers 642 are supported by the intermediate plate 648 at this point, so the interaction of the trigger surfaces 658 with the release surfaces 664 causes the support posts 652 to deflect slightly away from the system axis x. The situation depicted in FIGS. 34C and 35C will be referred to as the triggering state.

Figure 34D:
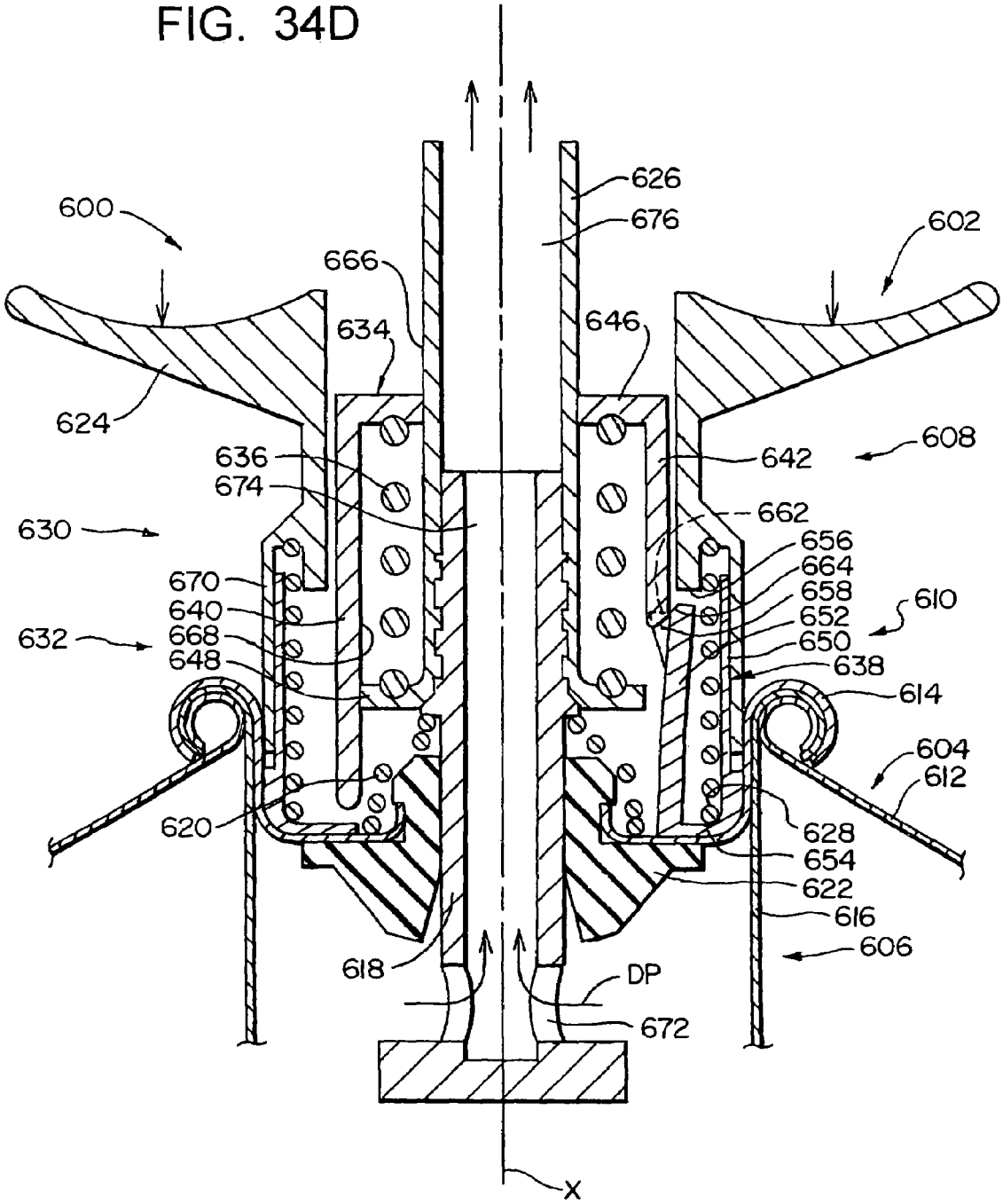
Figure 34E:
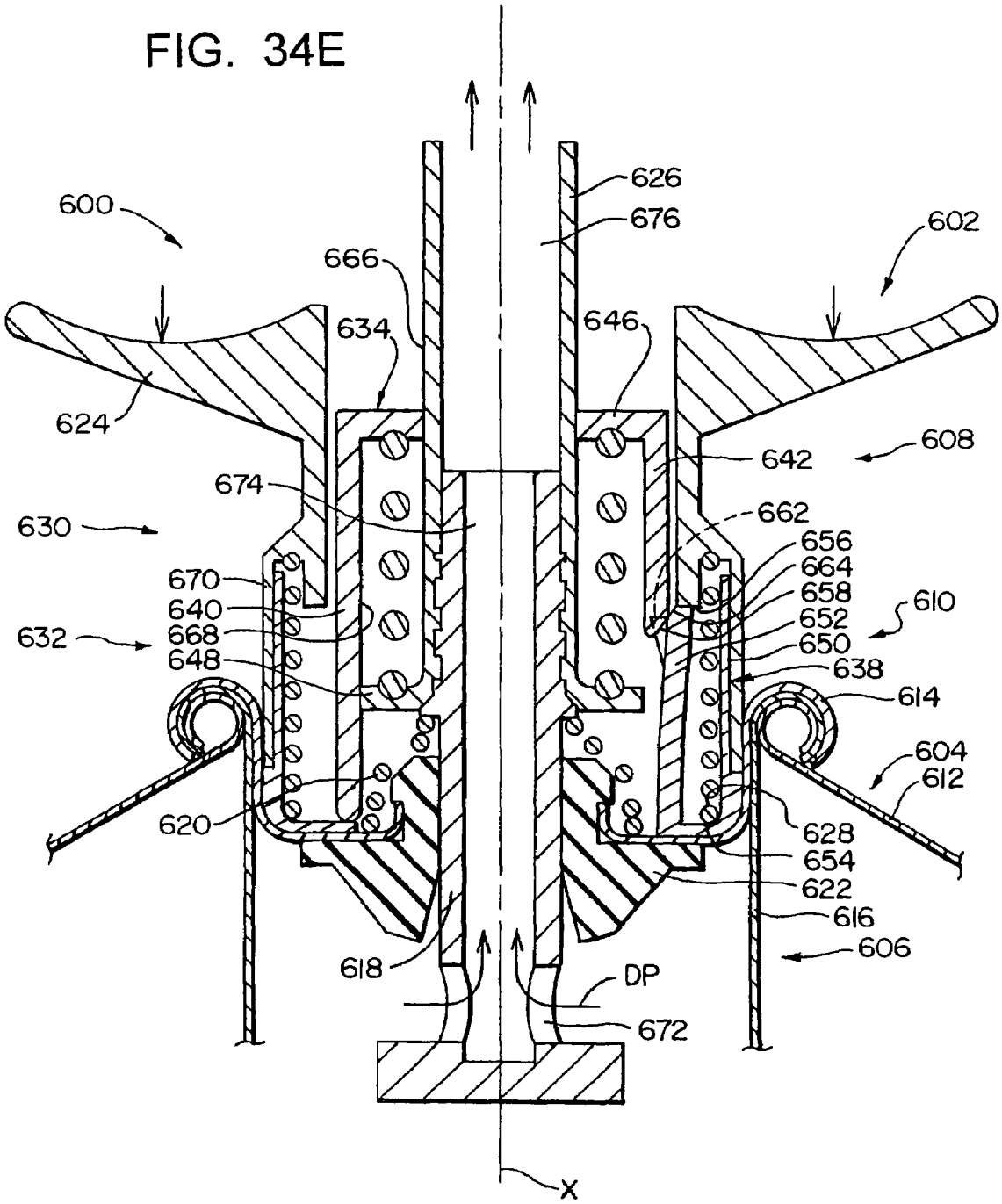
Figure 35D:
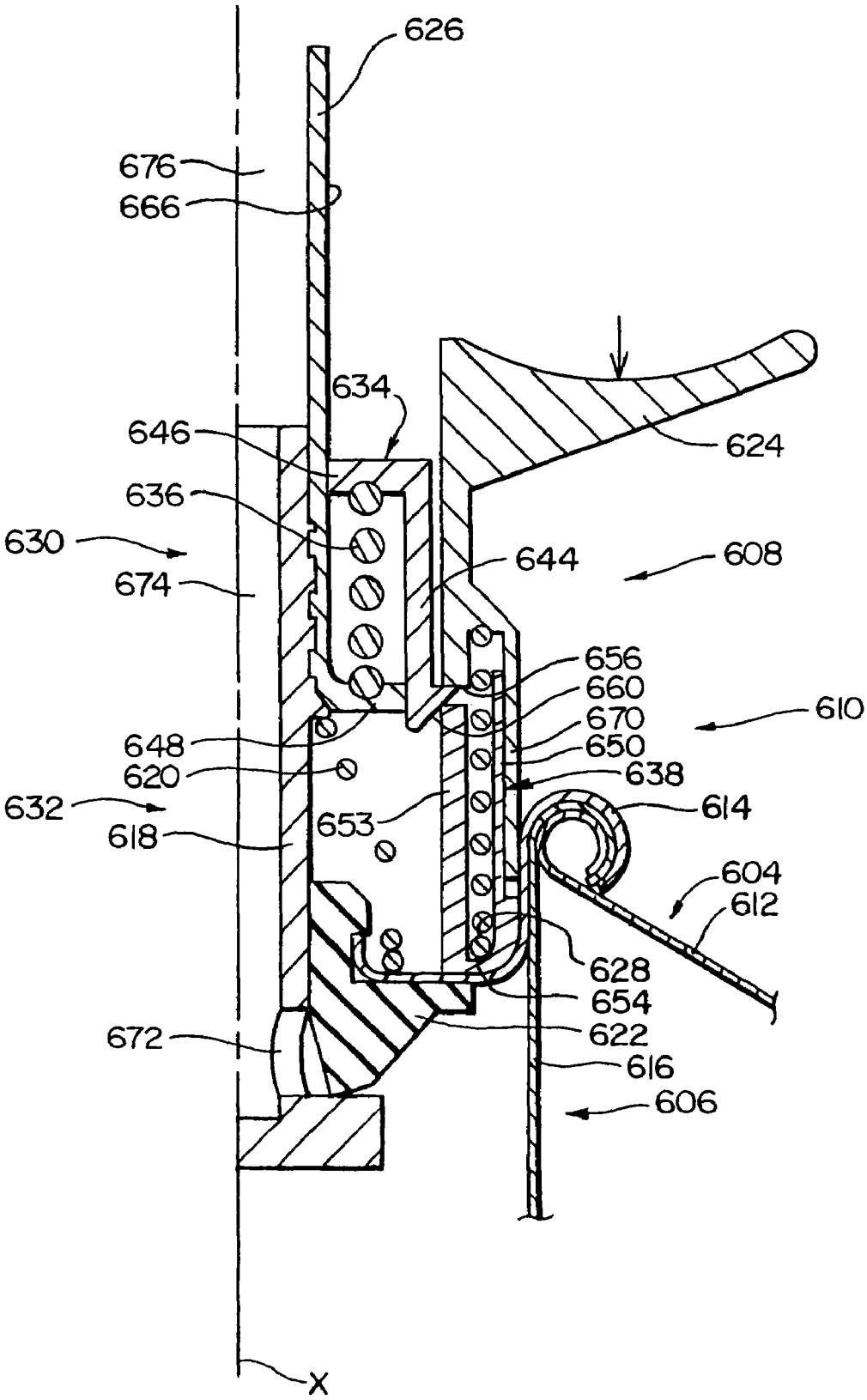
Figure 35E:
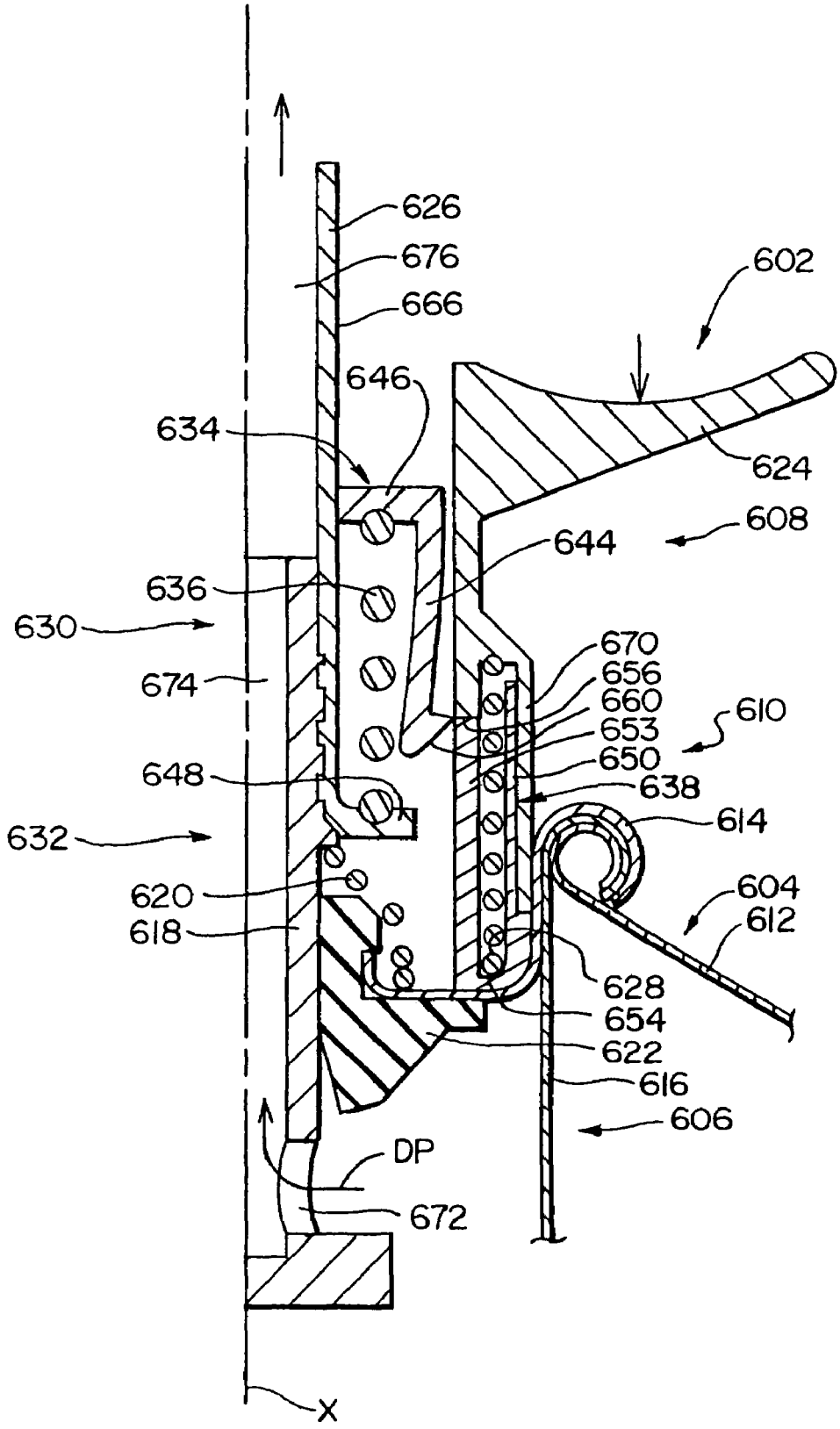

Referring now to FIGS. 34D and 35D, when the support posts 652 deflect far enough outward, the support surface 662 is removed from underneath the intermediate flange 648. At this point, the trigger spring 636, which is fully compressed in the pretriggering state, and which also is stronger than the valve spring 620, expands, forcing the intermediate plate 648 downward and compressing the valve spring 620. This state is shown in FIGS. 34D and 35D and will be referred to as the open state.

In this open state, the valve assembly has been placed in its open configuration, and fluid is free to flow into a stem inlet 672 and through a stem passageway 674 formed in the valve stem 618. Fluid then flows into an outlet chamber 676 formed in the outlet member 626 and subsequently out of the mechanical portion 602. A dispensing path DP is thus formed.

Referring now to FIG. 35D, it can be seen that the release posts 653 begin to engage the cam surfaces 660 when the mechanical portion 602 is in this open state.

Figure 34F:
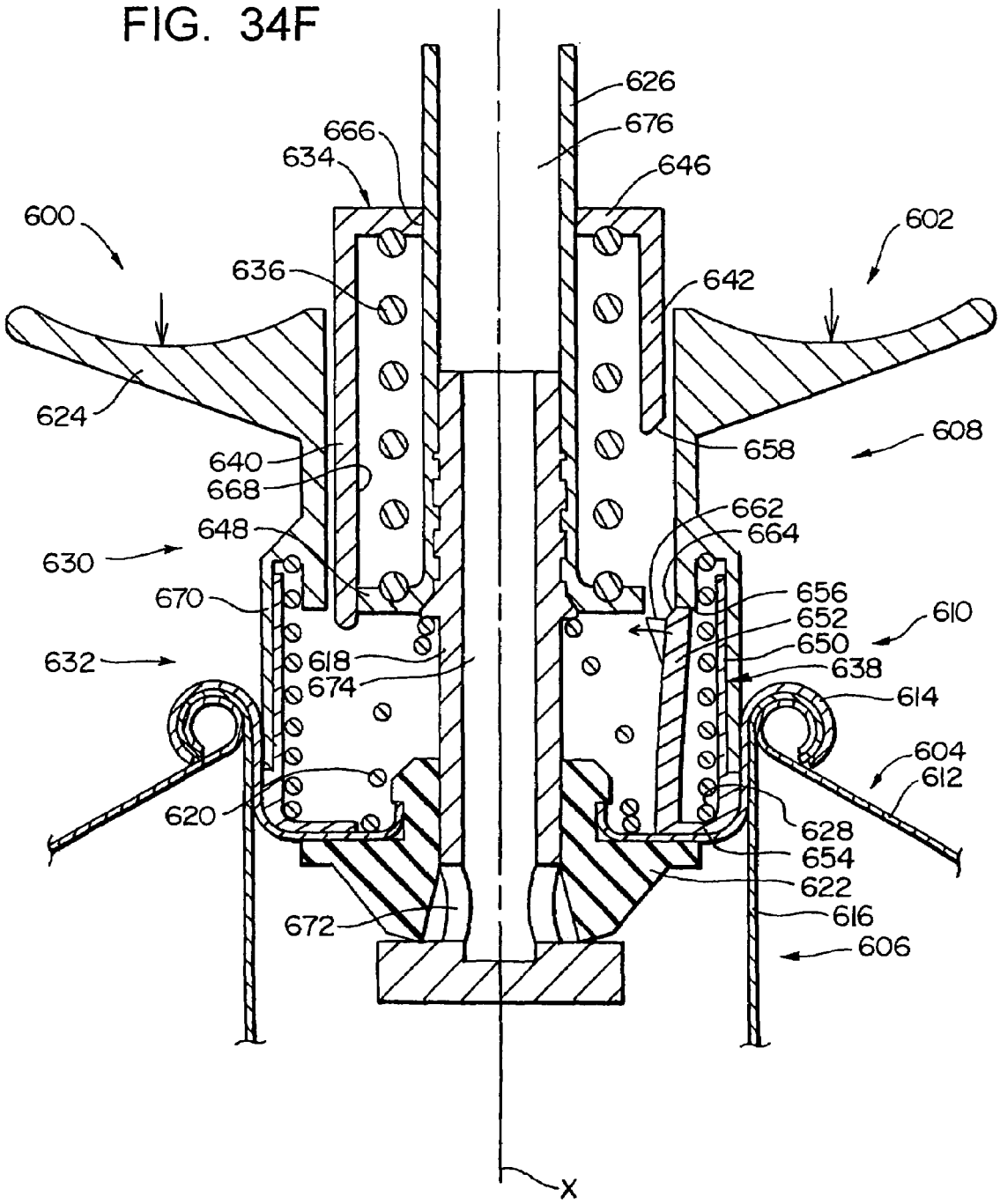
Figure 35F:
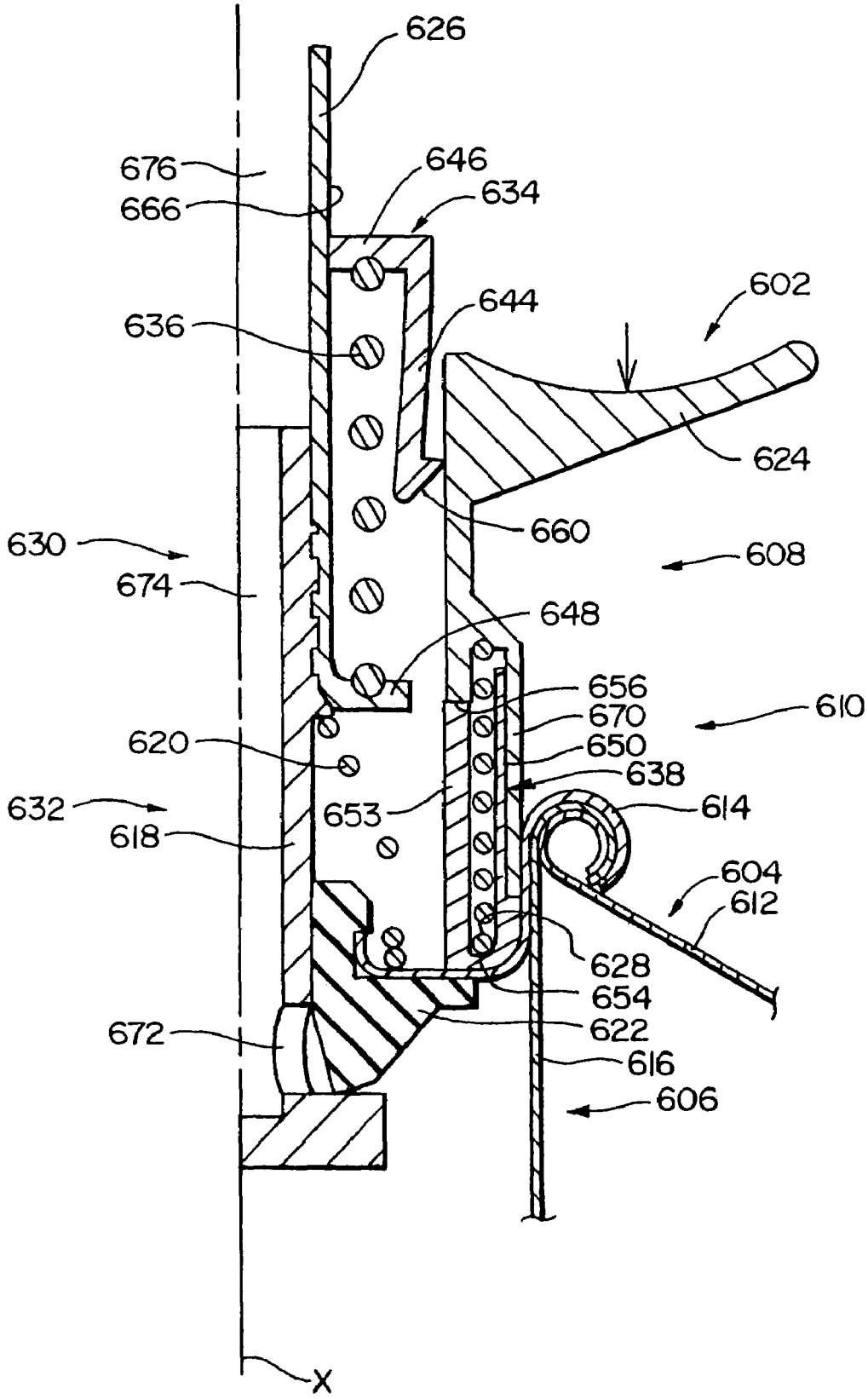

When the trigger spring 636 forces the intermediate flange 648 downward to open the valve assembly 606, resistance to downward movement of the actuator member 624 is substantially decreased. Accordingly, the user who is applying a downward force on the actuator member will quickly move the actuator member into the position shown in FIGS. 34E and 35E. The state shown in FIGS. 34E and 35E will be referred to as the release state. In this release state, the release posts 653 have acted on the cam surfaces 660 to deflect the release fingers 644 inwardly towards the system axis x. The actuator surface 656 no longer engages the trigger member 634. At this point, the valve spring 620 is fully compressed and will exert a fairly strong upward force on the valve stem 618. Because the trigger member 634 has been released from the actuator surface 656, nothing opposes upward motion of the valve stem 618. Accordingly, the valve spring 620 forces the valve stem 618, and thus the intermediate flange 648 upward until the valve stem again engages the valve seal 622 to place the valve assembly 606 in its closed configuration. This is shown in FIGS. 34F and 35F and will be referred to as the released state.

As the intermediate flange 648 moves up with the valve stem 618, it will force the trigger member 634 up through the trigger spring 620.

Figure 34G:
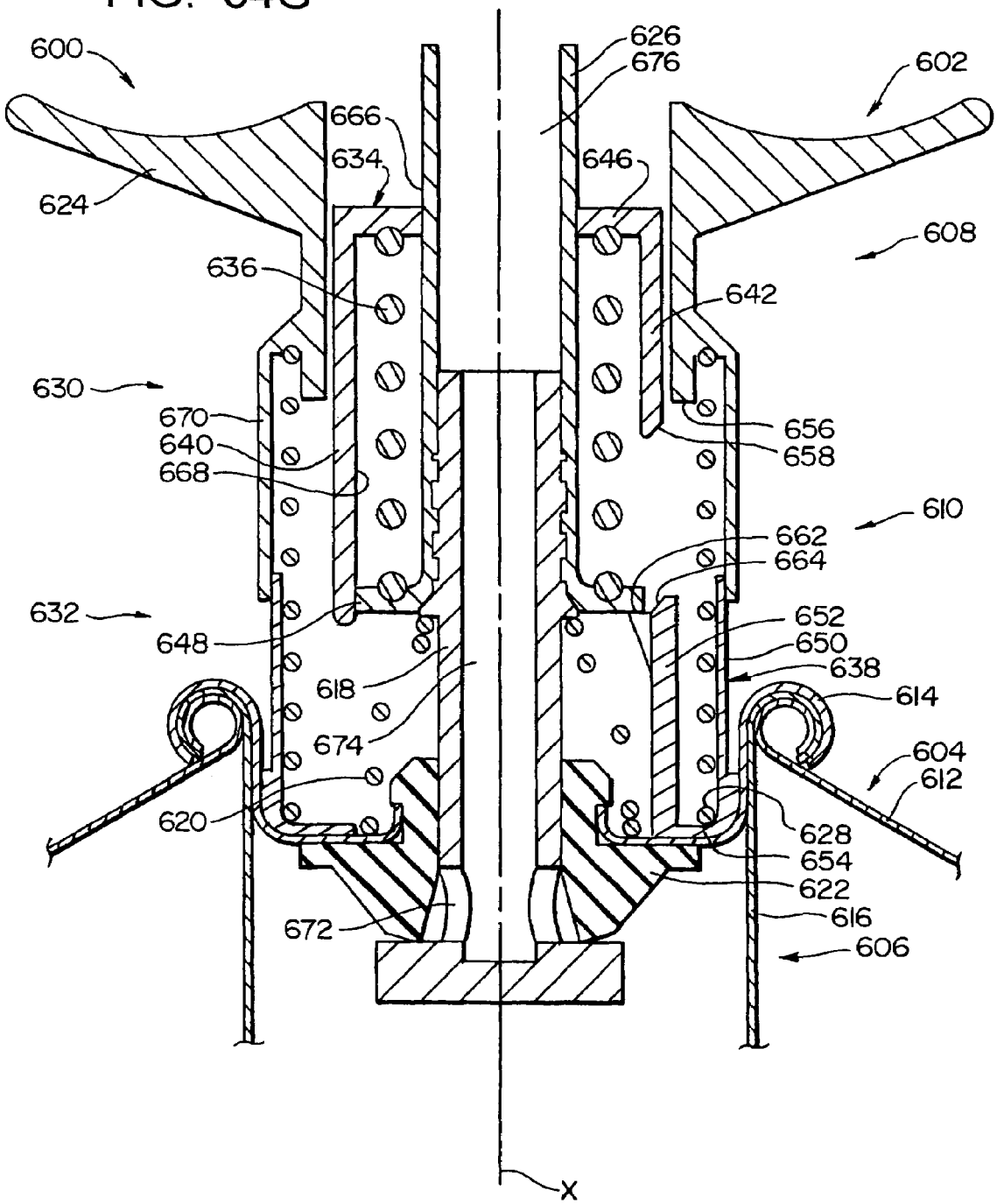
Figure 35G:
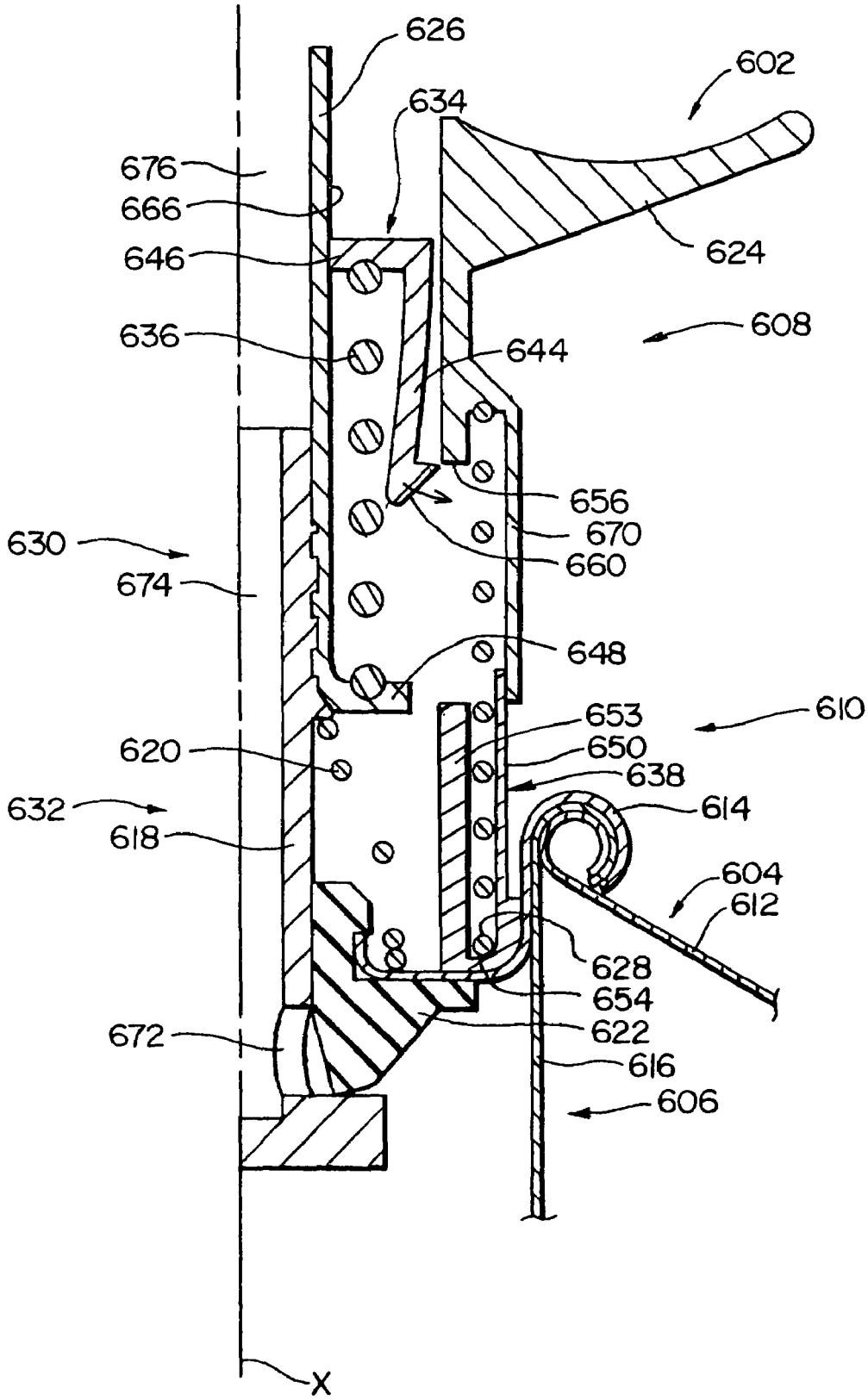
Figure 36:
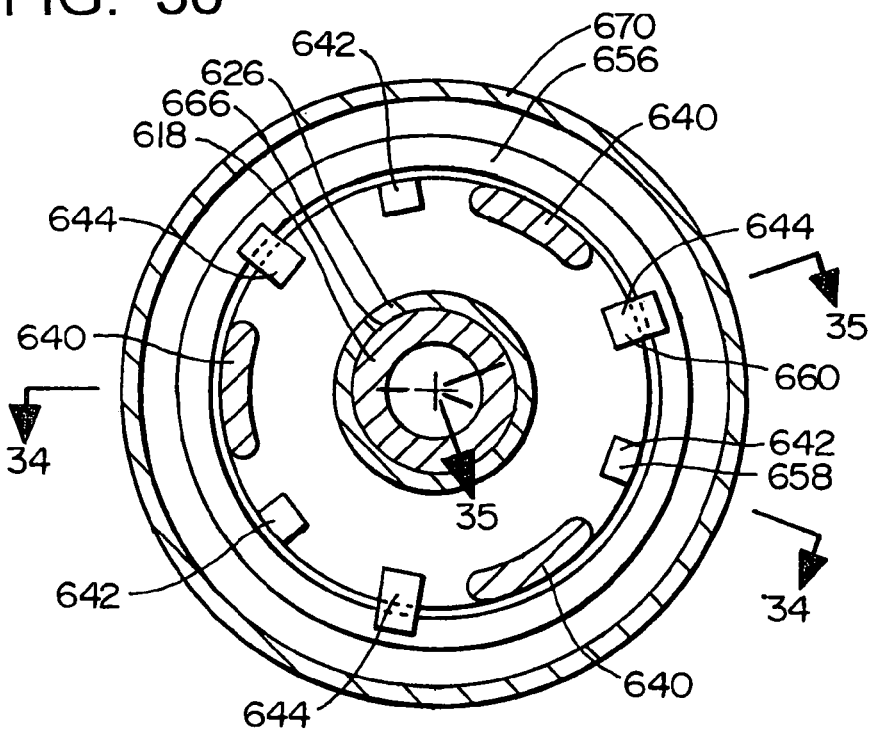
FIG. 36 is a section view taken along lines 36-36 in FIG. 34A.

The operator then releases the actuator member 624. As described above, the downward motion of the actuator member 624 has compressed the actuator return spring 628, so, when the actuator member 624 is released, the actuator return spring 628 forces the actuator member back up to its uppermost position as shown in FIGS. 34G and 35G. At this point, the release fingers 644 are free to spring back into their nondeformed state as perhaps best shown in FIG. 35G. And as shown in FIG. 34G, the support posts 652 spring back to their original configuration with the support surfaces 62 again supporting the intermediate flange 648. The mechanical assembly 602 thus returns to its predispensing state as shown in FIGS. 34A and 35A. As described above, the user need only energize this system by compressing various springs and trigger the system by moving the actuator member 624 passed a predetermined point. Once these actions have taken place, the metering assembly 610 automatically opens and closes the valve assembly 606 such that only a predetermined amount of texture material is allowed to flow out along the dispensing path DP. Again, the amount of texture material released during the short period of time that the valve assembly is opened is determined by various factors such as the initial pressure of the propellant material, and volume of the propellant material, the amount that the valve stem moves when it is placed into its open position, the sizes of the various orifices and restrictions involved in forming the dispensing path DP, the relative sizes of the trigger spring 636 and the valve spring 620, and the exact physical locations of the actuator surface 656, trigger 658, cam surface 660, support surface 662, release surface 664, and release post 653.

XV. Twelfth Embodiment

Referring now to FIG. 8, depicted at 700 therein is a twelfth embodiment of a dispensing system constructed in accordance with, and embodying, the principles of the present invention. This twelfth embodiment includes a fluid portion as described above and a mechanical portion 702 for dispensing acoustic texture material forming part of the fluid portion.

The mechanical portion 702 comprises a container assembly 704, a valve assembly 706, an actuator assembly 708, and a metering member 710.

The container assembly 704 comprises a container 712 and a cap 714. The valve assembly 706 comprises a valve housing 716, a valve stem 718, a valve spring 720, and a valve seal 722.

The cap 714 and valve housing 716 are attached to the container 712. The valve seal 722 is mounted to the cap 714, and the valve stem 718 passes through the valve seal 722. The valve spring 720 is arranged between the cap 714 and the valve stem 718 to bias the valve stem 718 upward such that the valve assembly 706 is normally in a closed configuration.

The actuator assembly 708 comprises an outlet cap 726 and an actuator member 728. The actuator member 728 is rigidly connected to the valve stem 718, and the outlet cap 726 is rigidly connected to the actuator member 728.

The metering member 710 is rigidly connected to the cap 714 around the valve stem 718 immediately below the actuator member 728.

A stop surface 730 is formed on a bottom portion of the actuator member 728. A limiting surface 732 is formed on an upper portion of the metering member 710. The stop surface 730 and limiting surface 732 both have a generally frustoconical shape. In the exemplary mechanical portion 702, the surfaces 730 and 732 match each other.

The valve housing 716 defines a valve chamber 734 within the container 704. As with the embodiments discussed above, a pick-up tube is used to allow fluid communication between a bottom portion of the container 704 and the valve chamber 734. The pressurized propellant material accumulates at the top of the container 704 and forces acoustic texture material at the bottom of the container 704 through the pick-up tube and into the valve chamber 734. Accordingly, pressurized acoustic texture material is present in the valve chamber 734.

In use, the actuator member 728 is depressed downward against the force of the valve spring 720 such that the valve stem 734 disengages from the valve seal 722 and creates a dispensing path through which texture material may exit the mechanical portion 702. In particular, when the valve stem 718 disengages from the valve seal 722, texture material within the valve chamber 734 flows into a stem inlet 736 and a stem passageway 738 in the valve stem 718. The texture material then flows through an outlet chamber 740 defined by the actuator member 728 and outlet cap 726. Finally, the acoustic texture material exits through an outlet opening 742 formed in the outlet cap 726.

The metering member 710 performs two basic functions. First, the stop surface 730 on the actuator member 728 engages the limiting surface 732 on the metering member 710 to limit the distance the valve stem 718 travels relative to the valve seal 722. This effectively restricts the size of the opening through which the texture material must pass as it exits the mechanical portion 702 and thus assists the user in controlling the amount of texture material released.

The interaction of the stop surface 730 with the limiting surface 732 also prevents cocking of the valve stem 718 relative to the longitudinal axis of the container 712. This aids the user in aiming the device while dispensing the texture material.

The metering member 710 thus assists the user in operating the valve assembly 706 in a manner that allows the texture material to be applied properly.

XVI. Thirteenth Embodiment

Figure 39:
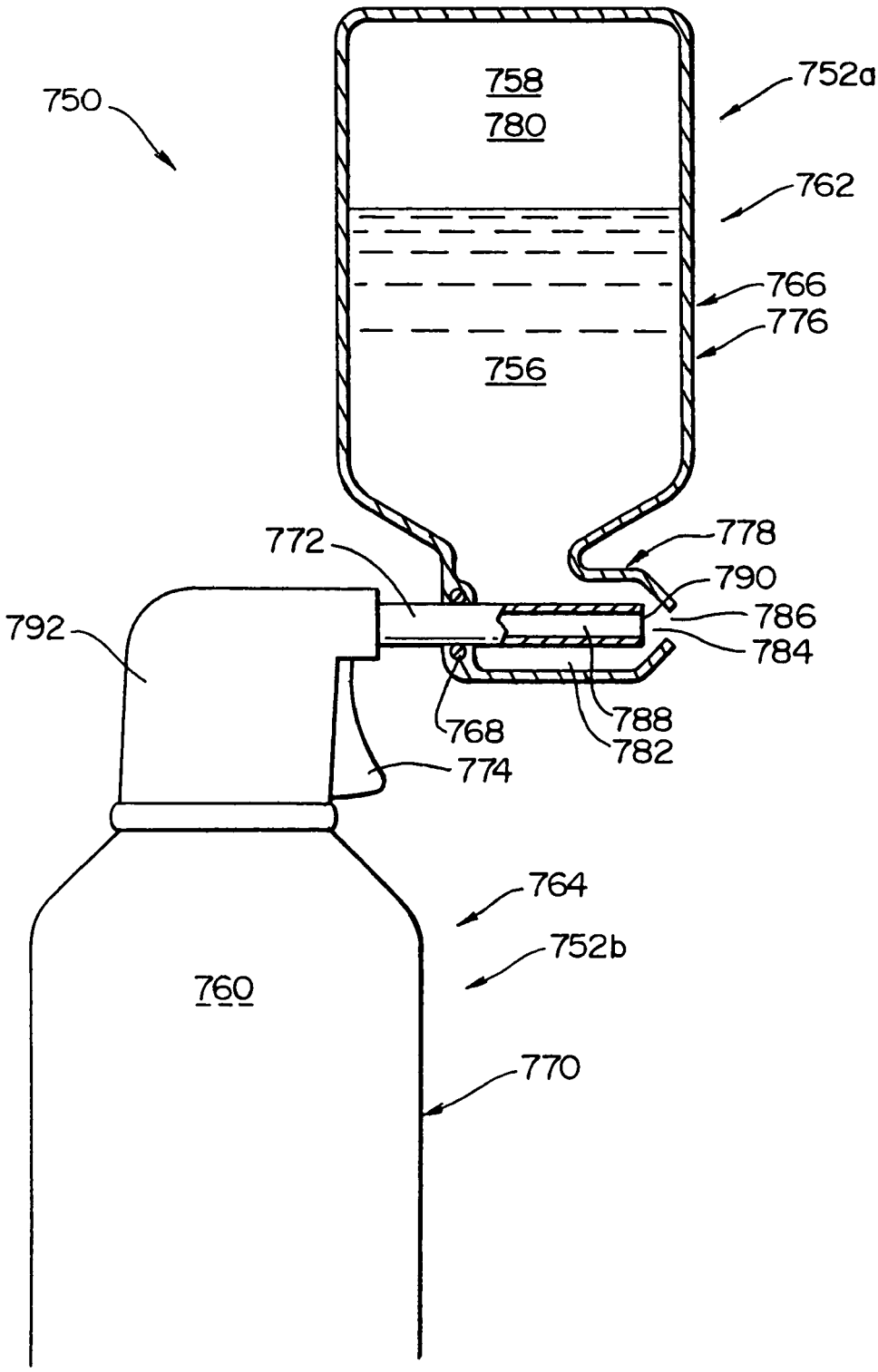
FIG. 39 is a partial section view of a dispensing system of a thirteenth embodiment of the present invention.

Referring now to FIG. 39, depicted at 750 therein is a thirteenth embodiment of the dispensing system constructed in accordance with, and embodying, the principles of the present invention. The dispensing system 750 comprises a fluid portion 752 and a mechanical portion 754.

In the dispensing system 750, the fluid portion 752 is initially stored at two locations as indicated by the suffix a and b. The texture material to be dispensed is shown at 756 along with air at ambient pressures as indicated at 758. Pressurized propellant material is stored as shown by the reference character 760.

The mechanical portion 754 comprises a hopper assembly 762 and a propellant assembly 764.

The hopper assembly 762 comprises a hopper container 766 and a hopper seal 768. The propellant assembly 764 comprises a propellant container 770, a propellant nozzle 772, and an actuator button 774.

The propellant assembly 764 is conventional and is adapted to contain a pressurized, gaseous fluid such as air or nitrogen. Similar assemblies are used to dispense inert gases such as air and nitrogen for the purpose of cleaning. For example, a number of products on the market allow computer and electronics equipment to be cleaned using a stream of inert gas contained in assemblies such as the propellant assembly 764. The propellant assembly 764 is operated by depressing the actuator button 774, which opens an internal valve (not shown) and allows the pressurized inert fluid to flow from the propellant container 770 to the propellant nozzle 772.

The hopper container 766 comprises a hopper portion 776 and an outlet portion 778. The hopper portion defines a hopper chamber 780. The outlet portion 778 defines an outlet chamber 782, a portion of which is identified by reference characters 784 as a mixing area. The mixing area is immediately adjacent to an outlet opening 786 formed in the outlet portion 778.

In use, the propellant nozzle 772 extends from the propellant container 770. The outlet portion 778 of the propellant container 770 contains a substantial portion of the propellant nozzle 772. The propellant nozzle 772 defines a nozzle passageway 788 that terminates in a nozzle opening 790. When assembled, the nozzle opening 790 is located adjacent to the outlet opening 786, with the mixing area 784 arranged between the nozzle opening 790 and the outlet opening 786. The hopper seal 768 seals the hopper portion 778 of the hopper container 776 against the outer surface of the propellant nozzle 772.

The hopper container 776 contains the acoustic texture material 756 and the ambient air 758. The propellant assembly 764 contains the propellant material 760.

In use, the hopper assembly 762 is arranged such that the hopper portion 760 is above the outlet portion 778. This allows gravity to feed the texture material 756 into the outlet chamber 782. Texture material in the outlet chamber 782 flows into the mixing area. When the actuator button 774 is depressed, a stream of pressurized propellant material flows through the nozzle passageway 788 and out of the nozzle openings 790 where it mixes with the texture material in the mixing area 784 and subsequently carries a portion of the texture material out of the outlet opening 786.

The propellant assembly 764 further comprises an outlet cap 792 from which the propellant nozzle 772 extends. It would be possible to incorporate the functions of the propellant nozzle 772 and the outlet portion 778 of the hopper container 766 into the outlet cap 792.

XVII. Fourteenth Embodiment

Figure 40:
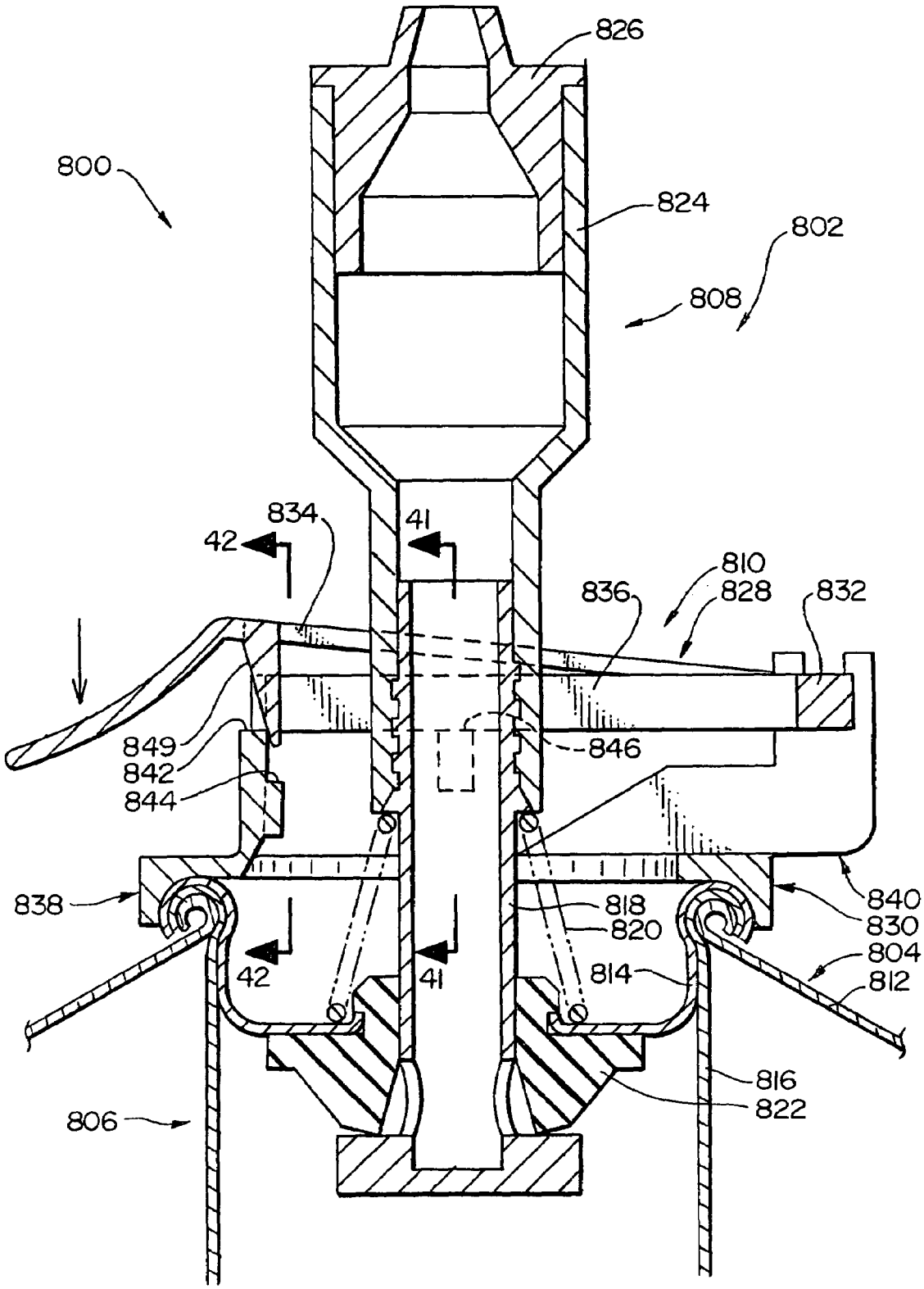
FIG. 40 is a section view of a dispensing system of a fourteenth embodiment of the present invention.
Figure 41:
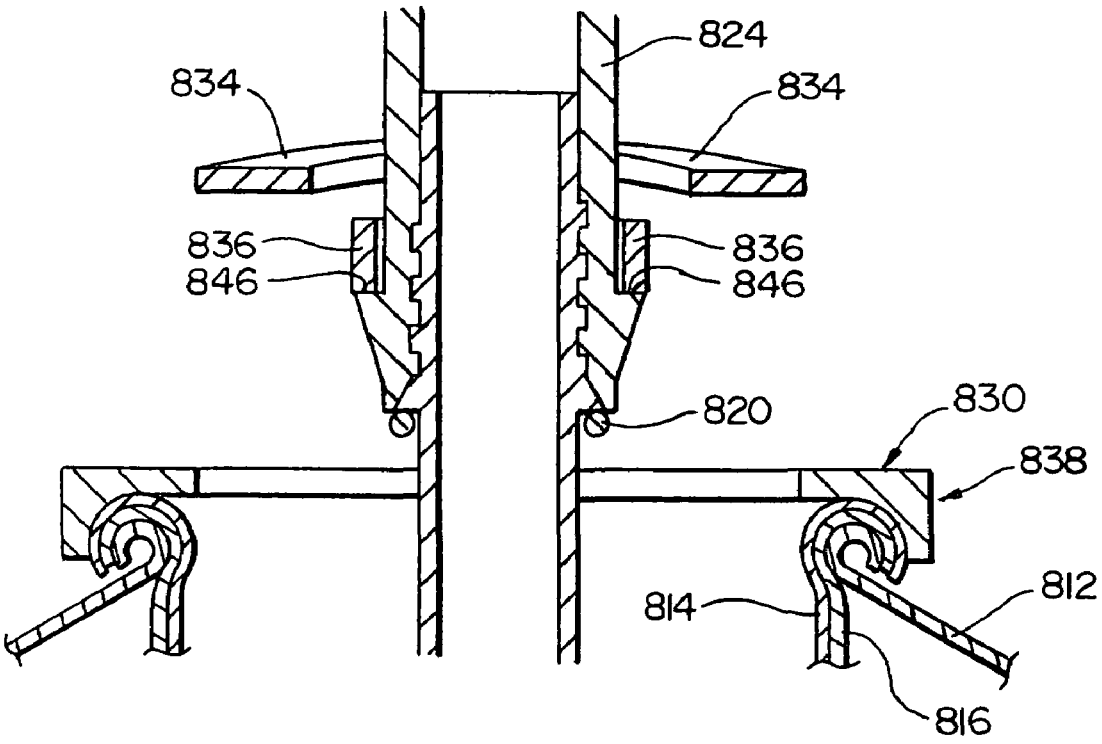
FIG. 41 is a section view taken along lines 41-41 in FIG. 40.
Figure 42:
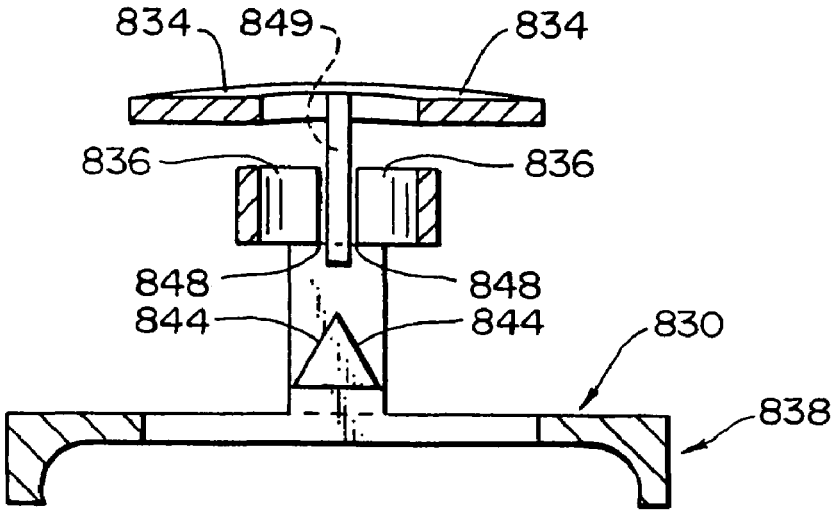
FIG. 42 is a section view taken along lines 42-42 in FIG. 40.

Referring now to FIGS. 40-42, depicted therein at 800 is a fourteenth embodiment of the dispensing system constructed in accordance with, and embodying, the principles of the present invention. The dispensing system 800 comprises a mechanical portion 802 and a fluid portion as discussed above.

The mechanical portion 802 comprises a container assembly 804, a valve assembly 806, an outlet assembly 808, and a metering assembly 810.

The container assembly 804 comprises a container 812 on which is sealingly mounted a cap 814.

The valve assembly 806 comprises a valve housing 816, a valve stem 818, a valve spring 820, and a valve seal 822. As in the ninth through twelfth embodiments discussed above, the valve housing 816 is mounted within the container 812 and pressurized acoustic texture material is located within the valve housing 816. The valve seal 822 is mounted onto the cap 814 and in turn mounts the valve stem 818 to the cap 814 in a manner that allows the stem 818 to move up and down relative to the container 812. The valve spring 820 resists downward movement of the valve stem 818.

The valve assembly 806 is shown in its closed configuration in FIG. 40, and pressurized texture material is not allowed to flow out of the mechanical portion 802.

The outlet assembly 808 comprises an outlet member fixedly attached to the valve stem 818, and a valve cap 826.

The metering assembly 808 comprises a torsion member 828 and a base member 830. The torsion member comprises a torsion bar portion 832, actuator fingers 834, and trigger projections 836. The base member 830 comprises a mounting flange 838 and bar supports 840.

The base member 830 is assembled on to the cap 814 using the mounting flange 838. The base member 830 is thus secured relative to the container 812. The bar supports 840 extend upwardly and support both ends of the torsion bar portion 832 of the torsion member 828.

The base member 830 further defines a trigger surface 842 and first and second release surfaces 844 (FIG. 42). In addition, trigger ledges 846 are formed on either side of the outlet member 824 as perhaps best shown in FIG. 41. In addition, release edges 848 are formed on the trigger projections 836. A trigger surface 849 (FIG. 40) is formed on the actuator fingers 834.

When the mechanical portion 802 is in its predispensing state as shown in FIG. 40, the actuator fingers 834 are canted upwardly and the trigger projections 836 rest on the release ledges 846 and trigger surface 842. Pushing downward on the actuator fingers 834 as shown by the arrow in FIG. 40 displaces the actuator fingers 834 downward. Because the trigger projections 836 are supported by the trigger surface 842, the trigger projections 836 initially cannot move. This creates torsion in the torsion bar portion 832 of the torsion member 828. As the actuator fingers 834 move down further, the trigger surfaces 849 act on the base member 830 and displace the trigger surface away from the torsion bar portion 832 until at some point the trigger surface 842 no longer supports the trigger projections 836. At this point, the torsion built up in the torsion bar portion 832 causes the trigger projections 836 to snap downwardly. Because these trigger projections 836 rest on the trigger ledges 846, the downward movement of the trigger projections 836 is transferred to the outlet member 824 and thus the valve stem 818. As the valve stem 818 moves downward, it disengages from the valve seal 822 and allows texture material to flow out of the mechanical portion 802.

As the trigger projections descend, the release edges 848 thereon engage the release surfaces 844 formed on the base member 830. These release surfaces 844 are slanted in a manner that causes the trigger projections to separate from each other as they move down after contacting the release surfaces 844.

As the trigger projections separate from each other, they disengage from the trigger ledges 846 formed on the outlet member 824 such that the trigger projections no longer hold the valve stem 818 down against the valve spring 820. The valve spring 820 is thus free to return the valve stem 818 back to its original position in which the valve assembly 806 is closed. The user then simply releases the actuator fingers 834, and the torsion bar portion 832 of the torsion member 824 snaps the actuator fingers 834 and trigger projections 836 back up to the original position as shown in FIG. 40.

The dispensing system 800 thus allows the user to determine when a portion of acoustic texture material is released from the mechanical portion 802, but the metering assembly 810 opens and closes the valve assembly 806 in a predetermined sequence that determines the amount of texture material that is released. Again, the exact amount of texture material that is released depends on a number of factors that may be adjusted given the circumstances.

XVIII. Fifteenth Embodiment

Figure 43:
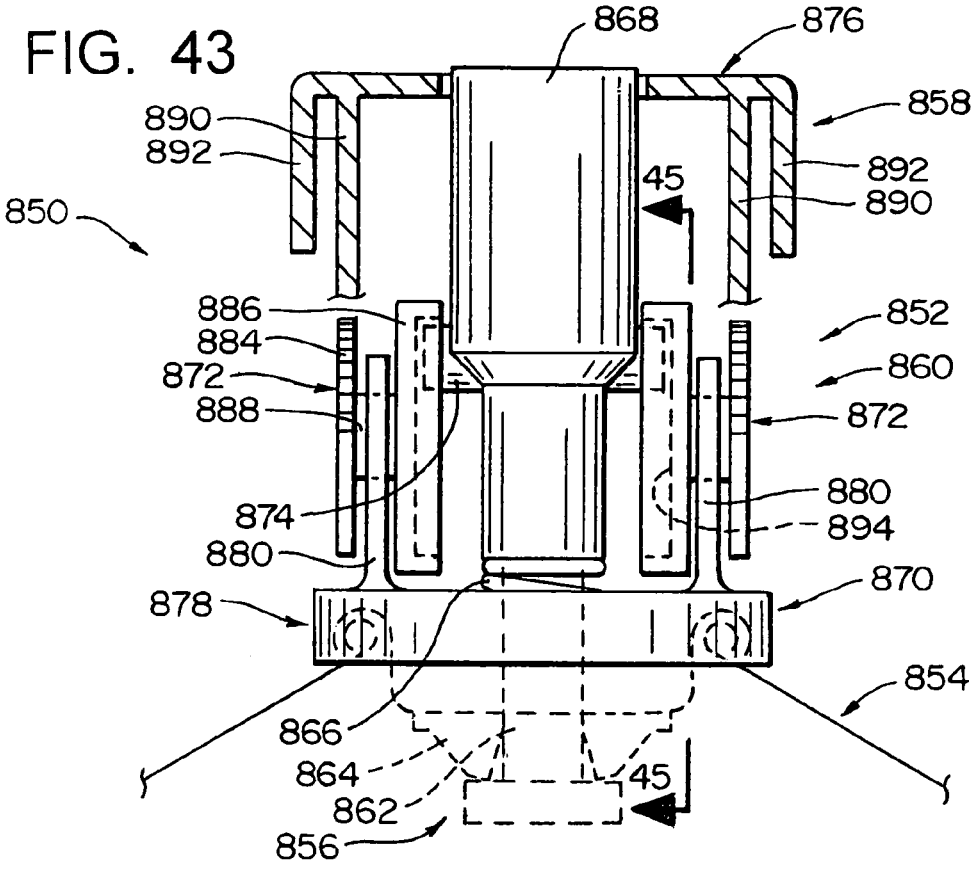
FIG. 43 is a section view of a fifteenth embodiment of a dispensing system of the present invention.
Figure 44:
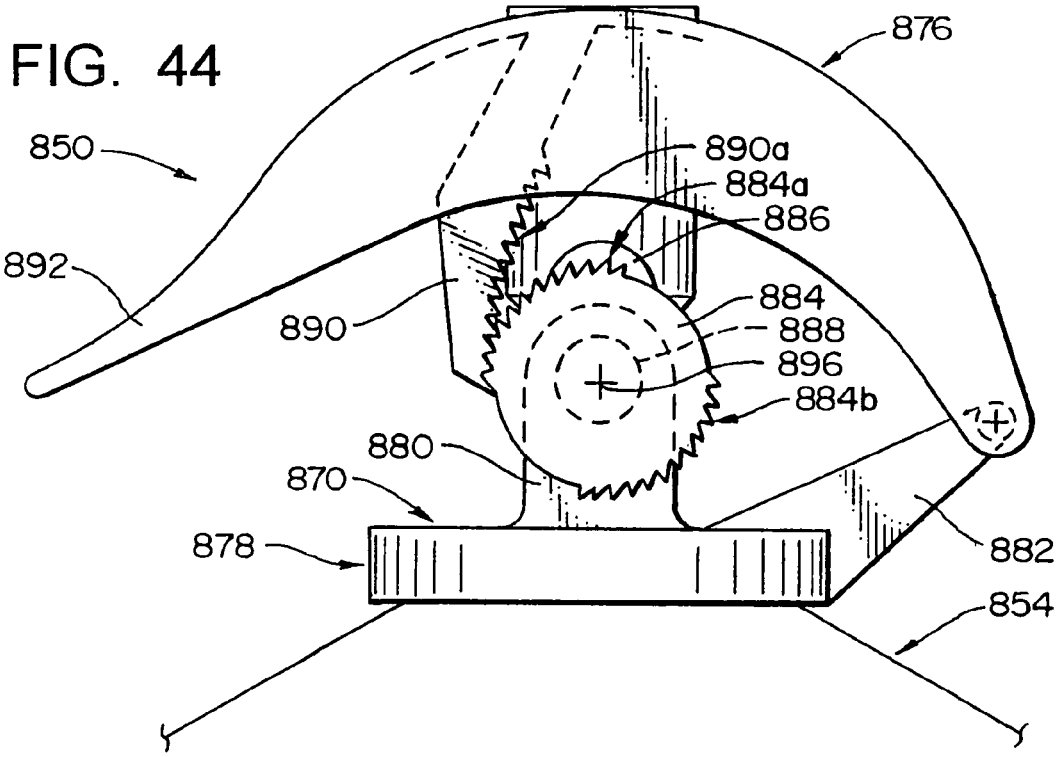
FIG. 44 is a side elevational view of the dispensing system of FIG. 43.
Figure 45:
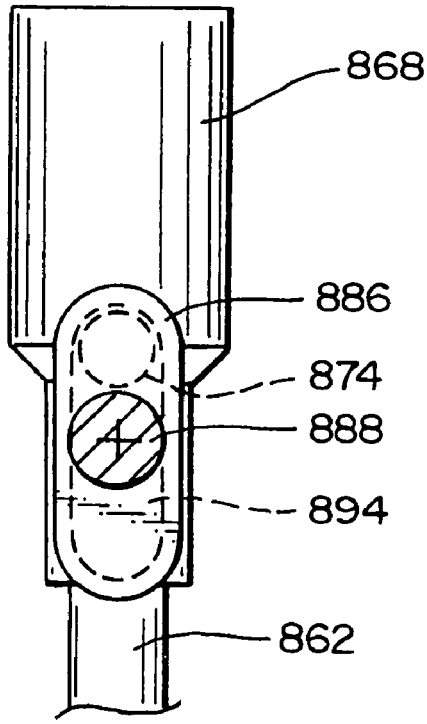
FIG. 45 is a section view taken along lines 45-45 in FIG. 43.

Referring now to FIGS. 43-45, depicted therein at 850 is a fifteenth embodiment of a dispensing system constructed in accordance with, and embodying, the principles of the present invention. The dispensing system 850 comprises a fluid portion as generally described above with reference to FIG. 1 and a mechanical portion 852. The mechanical portion 852 comprises a container assembly 854, a valve assembly 856, an outlet assembly 858, and a metering assembly 860.

The valve assembly 856 comprises a valve stem 862, a valve seal 864, and a valve spring 856. The valve assembly 856 works in the same basic manner as the valve assemblies as a number of other embodiments disclosed herein and will not be described in detail.

The outlet assembly 858 comprises an outlet member 868 and is also constructed and operates in the same manner as various outlet assemblies described above.

The metering assembly 860 comprises a base member 870, a gear member 872, and a yoke member 874.

The base member 870 comprises a mounting flange 878 that allows the base member to be adapted onto the container assembly 854. The base member 870 further comprises gear supports 880 and actuator supports 882. The gear members 872 comprise gear portions 884, a yoke housing 886, and an axle portion 888. The axle portion 888 engages the gear supports 880 such that the gear members 872 are mounted on either side of the outlet member 868 with the yoke housing 886 facing in and the gear portions 884 facing out.

The actuator member 876 comprises a pair of actuator racks 890 and a pair of finger projections 892. The actuator member is mounted on the actuator supports 882 such that the actuator racks 890 are aligned with the gear portions 884. The finger projections 892 extend on either side of the outlet member 868 on the opposite side of the actuator supports 882.

During use, the user presses downward on the finger projections 892 such that teeth 890*a* on the actuator rack 890 engage teeth 884*a* on the gear portion 884. Accordingly, pushing down on the finger projections 892 causes the teeth 890*a* and 884*a* to engage each other such that the gear portions 884 rotate about a trigger axis 896.

As the gear portions 884 rotate, the housing portions 886 also rotate. These yoke housings define yoke channels 894 that receive either end of the yoke member 874. Yoke member 874 is in turn connected to the outlet member 868 such that downward movement of the yoke member 874 is transmitted to the outlet member 868. The outlet member 868 is in turn rigidly connected to the valve stem 862. Accordingly, pushing down on the finger projections 892 places the valve assembly 856 in its open position and allows texture material to be dispensed through the outlet member 868.

The gear member 872 is operatively connected to a spring (not shown) which, when the teeth 890*a* on the actuator rack 890 rotate the gear member 884 90 degrees, rotates the gear member 884 an additional 90 degrees such that a second set of teeth 884*b* on the gear portion 884 engage the teeth 890*a* on the rack 890. The spring then resets itself to be ready for the next cycle.

As the yoke housing 886 rotates through the initial 90 degrees, it drives the yoke member 874 such that the yoke member opens the valve assembly 856. As the yoke housing 886 moves from 90 degrees to 180 degrees, it allows the valve spring 866 to force the valve stem 862 back up, thereby closing the valve assembly 856.

The metering assembly 860 thus opens and closes the valve assembly 856 in response to pressing of the finger projections 892 to allow a predetermined, limited, amount of acoustic texture material to be released from the system 850.

XIX. Sixteenth Embodiment

Figure 46:
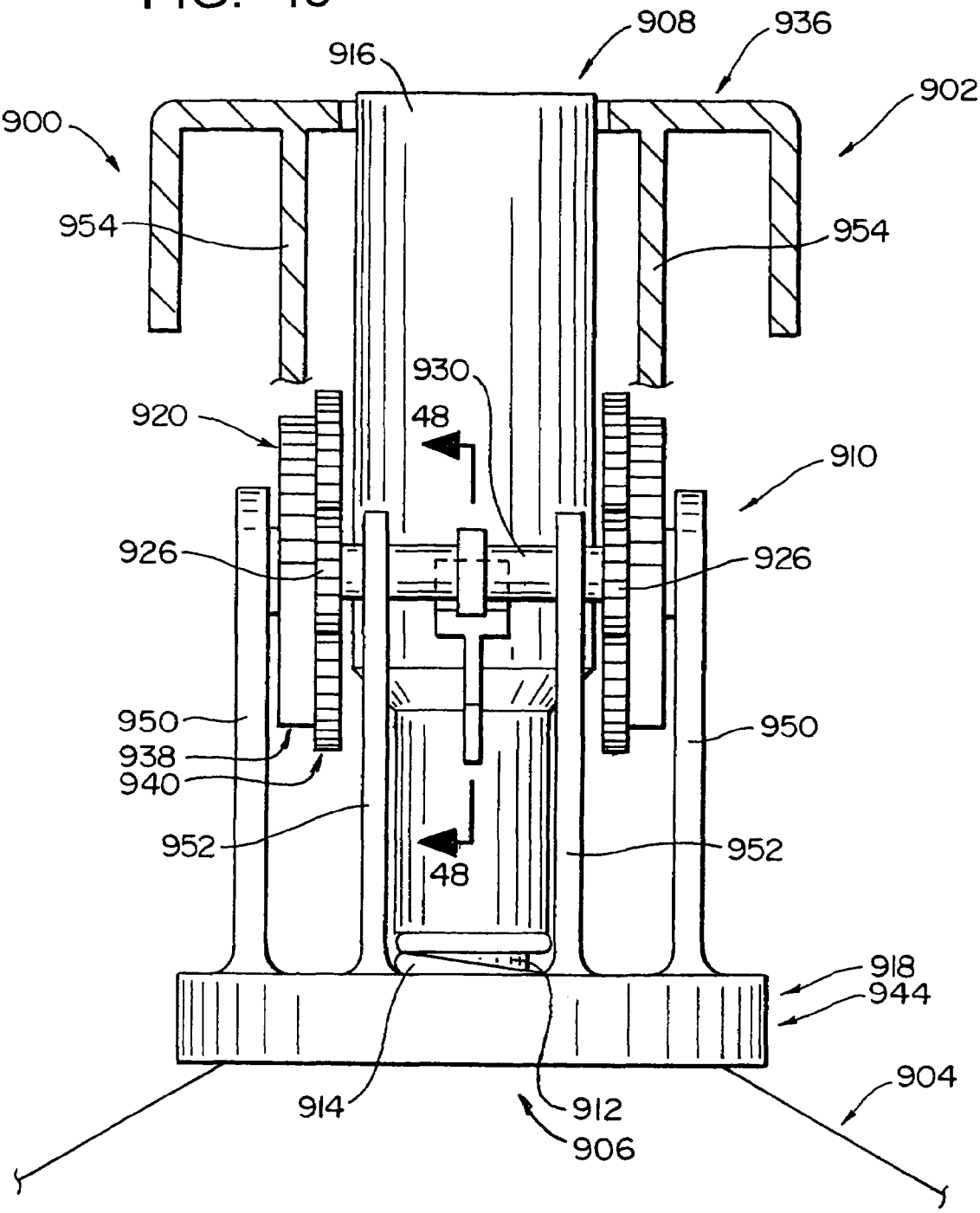
FIG. 46 is a side elevational view of a dispensing system of the sixteenth embodiment of the present invention.
Figure 47:
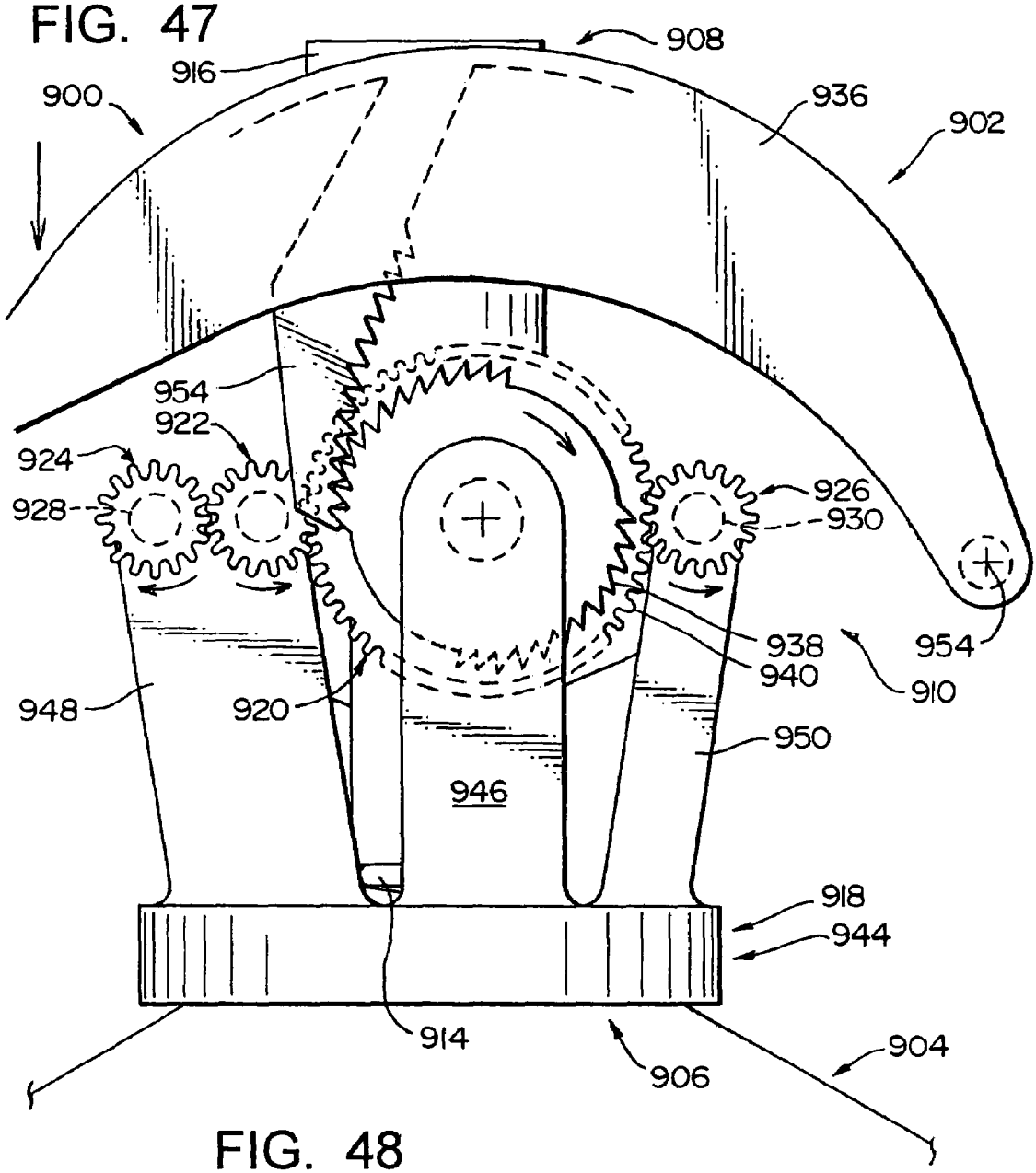
FIG. 47 is a section view of the dispensing system depicted in FIG. 46.
Figure 48:
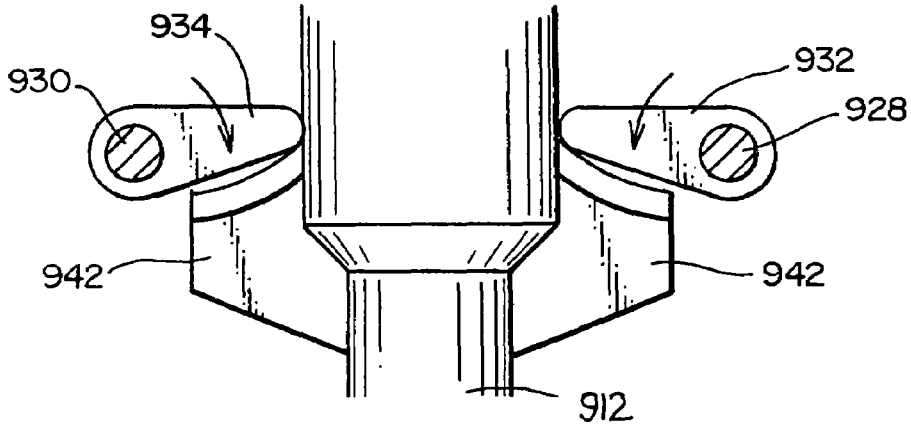
FIG. 48 is a partial section view taken along lines 48-48 in FIG. 46.

Referring now to FIGS. 46-48, depicted therein at 900 is a sixteenth embodiment of a dispensing system constructed in accordance with, and embodying, the principles of the present invention. The dispensing system 900 comprises a fluid portion as described above with reference to FIG. 1 and a mechanical portion 902.

The mechanical portion 902 comprises a container assembly 904, a valve assembly 906, an outlet assembly 908, and a metering assembly 910. The valve assembly 906 comprises a valve stem 912 and a valve spring 914 and operates in the same manner as the valve assemblies of a number of other embodiments described above. The outlet assembly 908 comprises an outlet member 916 that similarly operates in the same basic fashion as the outlet assemblies described above.

The metering assembly 910 comprises a base member 918, a first gear member 920, a second gear member 922, a third gear member 924, a fourth gear member 926, a first drive axle 928, a second drive axle 930, a first drive projection 932 (FIG. 48), a second drive projection 934 (FIG. 48), and an actuator member 936. The actuator member 936 is similar to the actuator member of the fifteenth embodiment described above and will not be discussed below in further detail. The first gear member 920 comprises an outer gear portion 938 and an inner gear portion 904. A pair of drive tabs 942 (FIG. 48) extend from either side of the outlet member 916.

The base member 918 comprises a mounting flange 940 that allows the base member to be securely mounted onto the container assembly 904. Extending from the mounting flange are first, second, and third gear posts 946, 948, and 950. In addition, drive posts 952 extend upwardly from the base member 918.

The first gear posts 946 support the first gear member 920. The second gear posts support the second and third gear members 922 and 924. The third gear post 950 supports the fourth gear members 926. The drive posts 952 support the first and second drive axles 928 and 930.

Actuator racks 954 extending from the actuator member 936 are aligned with the outer gear portions 938 of the first gear members 920. Accordingly, pivoting the actuator member 936 about an actuator axis 954 causes rotation of the first gear member 920. The inner gear portion 940 in turn rotates and engages the second and fourth gear members 922 and 926 to cause these to rotate in the same direction. The second gear member in turn engages the third gear member 924 so that the third and fourth gear members rotate in opposite directions.

As shown in FIG. 46, the first and second drive projections 932 and 934 are mounted on the drive axles 928 and 930 such that rotation of the drive axles 928 and 930 causes the drive projections 932 and 934 to act on the drive tabs 942 and thus place the valve assembly in its open configuration. When the drive projections 932 and 934 rotate slightly less than 90 degrees, they disengage from the drive tabs 942 and allow the valve spring 914 to raise the valve stem 912 and place the valve assembly 906 back into its closed position. The drive projections 932 and 934 are then rotated approximately 270 degrees until they again come into contact with the drive tabs 942. The process may be repeated. Again, the metering assembly 910 opens and closes the valve assembly 906 in a manner that dispenses a limited, controlled amount of texture material and does not allow the user to leave the valve assembly 906 in its open configuration for an extended period of time.

It is apparent that various modifications could be made the present invention without departing from the basic teachings thereof.

APPENDIX A-1

TABLE A

| | | |
|---|---|---|
| WATER | 214.31 | LTRS |
| PMO 30 | 0.06 | KGMS |
| PURTEX | 150.05 | KGMS |
| WATER | 32.32 | LTRS |
| C YELLOW OXIDE | 0.00 | LTRS |

TABLE B

| | | |
|---|---|---|
| WATER | 1862.95 | LTRS |
| PMO 30 | 0.48 | KGMS |
| PURTEX | 1304.35 | KGMS |
| WATER | 283.55 | LTRS |

TABLE C

| | | |
|---|---|---|
| WATER | 1892.00 | LTRS |
| PURE-TEX | 1161.00 | KGMS |
| BENTONE LT | 8.80 | KGMS |
| NUOSEPT 95 | 5.50 | LTRS |
| PMO 30 | 3.40 | LTRS |
| WATER | 46.00 | LTRS |

TABLE D

| | | |
|---|---|---|
| WATER | 993.00 | LTRS |
| BENTONE LT | 9.30 | KGMS |
| KTPP | 4.60 | KGMS |
| COLLOIDS 648 | 5.90 | LTRS |
| BUSAN 11M1 | 70.00 | KGMS |
| TITAN 2101 I | 4.00 | KGMS |
| MINUGEL 400 | 33.00 | KGMS |
| WATER | 933.00 | LTRS |
| PURE-TEX | 1218.00 | KGMS |
| WATER | 49.00 | LTRS |
| BENTONE EW | 0.00 | KGMS |
| WATER | 0.00 | LTRS |

APPENDIX A-2

TABLE E

| | | |
|---|---|---|
| WATER | 1359.00 | LTRS |
| BENTONE LT | 9.30 | KGMS |
| MINUGEL 400 | 33.00 | KGMS |
| KTPP | 4.60 | KGMS |
| COLLOIDS 648 | 5.90 | LTRS |
| BUSAN 11M1 | 70.00 | KGMS |
| TITAN 2101 I | 4.00 | KGMS |
| WATER | 628.00 | LTRS |
| PURE-TEX | 1218.00 | KGMS |
| WATER | 49.00 | LTRS |

TABLE F

| | | |
|---|---|---|
| WATER | 2792.070 | LTRS |
| PURE-TEX | 2974.19 | KGMS |
| WATER | 315.845 | LTRS |
| FOAMASTER 1119A | 7.708 | LTRS |

What is claimed:

1. A texturing system for applying a hardenable acoustic texture material to a surface comprising:

a container assembly defining a container chamber;

acoustic texture material arranged within the container chamber;

propellant material arranged within the container chamber to pressurize the acoustic texture material;

a housing supported within the container chamber, where the housing defines a housing chamber defining a housing inlet, where the housing inlet is configured such that the pressurized acoustic texture material is arranged within the housing chamber;

a valve stem defining an inlet opening and an outlet opening, where the valve stem is supported for movement from a first valve stem position, through an intermediate valve stem position, and into a second valve stem position;

a seal member that supports the valve stem relative to the container assembly; and a metering member supported relative to the valve stem within the housing chamber for movement between a first metering member position relative to the valve stem and a second metering member position relative to the valve stem; wherein when the valve stem is in the first valve stem position, the metering member engages the seal member to prevent fluid flow out of the container chamber by covering the inlet opening of the valve stem;

when the valve stem is in the intermediate valve stem position and the metering member is in the first metering member position, pressurized texture material within the housing chamber flows into the inlet opening of the valve stem; and when the valve stem is in the second valve stem position and the metering member is in the second metering member position, the metering member engages the valve stem to prevent fluid flow out of the container chamber by covering the inlet opening of the valve stem.

2. A texturing system as recited in claim 1, in which the housing engages the metering member to guide the metering member for movement between the first metering member position and the second metering member position.

3. A texturing system as recited in claim 1, in which at least one guide flange extends from the housing, where the at least one guide flange engages the metering member to guide the metering member for movement between the first metering member position and the second metering member position.

4. A texturing system as recited in claim 1, in which the housing engages the valve stem to guide the stem member for movement between the first valve stem position and the second valve stem position.

5. A texturing system as recited in claim 1, in which at least one guide flange extends from the housing, where the at least one guide flange engages the valve stem to guide the valve stem for movement between the first valve stem position and the second valve stem position.

6. A texturing system as recited in claim 1, in which:

the metering member frictionally engages the valve stem such that the metering member moves with the valve stem as the valve stem moves through the intermediate valve stem position; and the metering member engages the housing such that the metering member no longer moves with the valve stem as the valve stem moves into the second valve stem position.

7. A texturing system as recited in claim 1, in which:

a release projection is formed on one of the metering member and the valve stem; and a release groove is formed on the other of the metering member and the valve stem; wherein the release groove receives the release projection such that the metering member moves with the valve stem as the valve stem moves through the intermediate valve stem position; and the metering member engages the housing such that the release projection is not received by the release groove as the valve stem moves into the second valve stem position, where the metering member no longer moves with the valve stem when the release projection is not received by the release groove.

8. A method of applying a hardenable acoustic texture material to a surface comprising:

providing a container assembly defining a container chamber;

arranging acoustic texture material within the container chamber;

pressurizing the acoustic texture material by arranging propellant material within the container chamber;

supporting a housing within the container chamber such that the housing defines a housing chamber defining a housing inlet;

configuring the housing inlet such that the pressurized acoustic texture material is arranged within the housing chamber;

providing a valve stem defining an inlet opening and an outlet opening;

providing a seal member;

arranging the seal member to support the valve stem for movement, relative to the container assembly, from a first valve stem position, through an intermediate valve stem position, and into a second valve stem position; and supporting a metering member relative to the valve stem within the housing chamber for movement between a first metering member position relative to the valve stem and a second metering member position relative to the valve stem;

when the valve stem is in the first valve stem position, causing the metering member to engage the seal member to prevent fluid flow out of the container chamber by covering the inlet opening of the valve stem;

when the valve stem is in the intermediate valve stem position and the metering member is in the first metering member position, allowing pressurized texture material within the housing chamber to flow into the inlet opening of the valve stem; and when the valve stem is in the second valve stem position and the metering member is in the second metering member position, causing the metering member to engage the valve stem to prevent fluid flow out of the container chamber by covering the inlet opening of the valve stem.

9. A method as recited in claim 8, further comprising the step of causing the housing to engage the metering member to guide the metering member for movement between the first metering member position and the second metering member position.

10. A method as recited in claim 8, further comprising the step of providing at least one guide flange that extends from the housing, where the at least one guide flange engages the metering member to guide the metering member for movement between the first metering member position and the second metering member position.

11. A method as recited in claim 8, further comprising the step of causing the housing to engage the valve stem to guide the valve stem for movement between the first valve stem position and the second valve stem position.

12. A method as recited in claim 8, further comprising the step of providing at least one guide flange that extends from the housing, where the at least one guide flange engages the valve stem to guide the valve stem for movement between the first valve stem position and the second valve stem position.

13. A method as recited in claim 8, further comprising the steps of:

causing the metering member frictionally to engage the valve stem such that the metering member moves with the valve stem as the valve stem moves through the intermediate valve stem position; and causing the metering member to engage the housing such that the metering member no longer moves with the valve stem as the valve stem moves into the second valve stem position.

14. A method as recited in claim 8, further comprising the steps of:

forming a release projection on one of the metering member and the valve stem;

forming a release groove on the other of the metering member and the valve stem;

causing the release groove to receive the release projection such that the metering member moves with the valve stem as the valve stem moves through the intermediate valve stem position; and causing the metering member to engage the housing such that the release projection is not received by the release groove as the valve stem moves into the second valve stem position, where the metering member no longer moves with the valve stem when the release projection is not received by the release groove.

15. A texturing system for applying a hardenable acoustic texture material to a surface comprising:

a container assembly defining a container chamber;

acoustic texture material arranged within the container chamber;

propellant material arranged within the container chamber to pressurize the acoustic texture material;

a housing supported within the container chamber, where the housing defines a housing chamber defining a housing inlet, where the housing inlet is configured such that the pressurized acoustic texture material is arranged within the housing chamber;

a valve stem defining an inlet opening and an outlet opening, where the valve stem is supported by the housing for movement from a first valve stem position, through an intermediate valve stem position, and into a second valve stem position;

a seal member that supports the valve stem relative to the container assembly; and a metering member supported by the housing relative to the valve stem within the housing chamber for movement between a first metering member position relative to the valve stem and a second metering member position relative to the valve stem; wherein when the valve stem is in the first valve stem position, the metering member engages the seal member to prevent fluid flow out of the container chamber by covering the inlet opening of the valve stem;

when the valve stem is in the intermediate valve stem position and the metering member is in the first metering member position, pressurized texture material within the housing chamber flows into the inlet opening of the valve stem; and when the valve stem is in the second valve stem position and the metering member is in the second metering member position, the metering member engages the valve stem to prevent fluid flow out of the container chamber by covering the inlet opening of the valve stem.

16. A texturing system as recited in claim 15, in which at least one guide flange extends from the housing, where the at least one guide flange:

engages the metering member to guide the metering member for movement between the first metering member position and the second metering member position; and engages the valve stem to guide the valve stem for movement between the first valve stem position and the second valve stem position.

17. A texturing system as recited in claim 15, in which:

the metering member frictionally engages the valve stem such that the metering member moves with the valve stem as the valve stem moves through the intermediate valve stem position; and the metering member engages the housing such that the metering member no longer moves with the valve stem as the valve stem moves into the second valve stem position.

18. A texturing system as recited in claim 15, in which:

a release projection is formed on one of the metering member and the valve stem; and a release groove is formed on the other of the metering member and the valve stem; wherein the release groove receives the release projection such that the metering member moves with the valve stem as the valve stem moves through the intermediate valve stem position; and the metering member engages the housing such that the release projection is not received by the release groove as the valve stem moves into the second valve stem position, where the metering member no longer moves with the valve stem when the release projection is not received by the release groove.

* * * * *